US005576795A

United States Patent [19]

Kurimoto et al.

[11] Patent Number: 5,576,795

[45] Date of Patent: Nov. 19, 1996

[54] AUTOMATIC PROCESSING APPARATUS FOR SILVER HALIDE PHOTOGRAPHIC LIGHT-SENSITIVE MATERIAL

[75] Inventors: Tetsuya Kurimoto; Ryuji Uesugi; Tsuyoshi Haraguchi, all of Hino, Japan

[73] Assignee: Konica Corporation, Tokyo, Japan

[21] Appl. No.: 489,170

[22] Filed: Jun. 9, 1995

Related U.S. Application Data

[63] Continuation-in-part of Ser. No. 387,112, Feb. 10, 1995.

[30] Foreign Application Priority Data

| | | | |
|---|---|---|---|
| Feb. 15, 1994 | [JP] | Japan | 6-018601 |
| May 11, 1994 | [JP] | Japan | 6-097722 |
| Jun. 13, 1994 | [JP] | Japan | 6-130422 |

[51] Int. Cl.[6] ..... G03D 3/02; G03D 13/00

[52] U.S. Cl. ..... 396/626; 396/570

[58] Field of Search ..... 354/298, 322–324; 134/64 P, 64 R, 122 P, 122 R; 430/393, 30, 398–400, 450, 465, 455; 221/231

[56] References Cited

U.S. PATENT DOCUMENTS

| | | | |
|---|---|---|---|
| 4,227,818 | 10/1980 | Gacki et al. | 366/142 |
| 5,179,406 | 1/1993 | Nakamura | 354/324 |
| 5,185,623 | 2/1993 | Mogi | 354/324 X |
| 5,337,113 | 8/1994 | Kagawa et al. | 354/298 |
| 5,351,103 | 9/1994 | Komatsu et al. | 354/324 |
| 5,400,105 | 3/1995 | Koboshi et al. | 354/324 |

FOREIGN PATENT DOCUMENTS

| | | |
|---|---|---|
| 0517209A3 | 12/1992 | European Pat. Off. . |
| 0531234A1 | 3/1993 | European Pat. Off. . |
| 0595312A1 | 5/1994 | European Pat. Off. . |
| WO92/20013 | 11/1992 | WIPO . |

*Primary Examiner*—D. Rutledge

*Attorney, Agent, or Firm*—Frishauf, Holtz, Goodman, Langer & Chick

[57] ABSTRACT

An automatic developer for developing a light-sensitive material such as a photographic material. The developer includes: a processor tank for accommodating a processing solution so that the processing solution processes the light-sensitive material; a throughput detector for detecting a throughput of the processor on the light-sensitive material, and for generating detection signals when the throughput becomes a predetermined value; a processing agent supplier for supplying a solid processing agent to the processor tank; a water supplier for supplying water to the processor tank; a calculator for calculating an amount of evaporation water of the processing solution; a timer for generating timer signals when a predetermined time period is passed from a reference time; a controller for controlling the processing agent supplier to supply the solid processing agent to the processor tank according to the detection signals, for controlling the water supplier to supply the water to the processor tank according to the detection signals in which an amount of the water for each time is not more than a predetermined supply amount, and for controlling the water supplier to supply the water corresponding the amount of evaporation water in accordance with the timer signals.

25 Claims, 30 Drawing Sheets

AUTOMATIC PROCESSING APPARATUS FOR SILVER HALIDE PHOTOGRAPHIC LIGHT-SENSITIVE MATERIAL

The present application incorporates by reference all of the subject matter of prior application Ser. No. 08/387,112 filed Feb. 10, 1995, of which the present application is a continuation-in-part.

BACKGROUND OF THE INVENTION

The present invention relates to an automatic processing apparatus, and in more detail, to water supply and replenishment processing in the automatic processing apparatus in which light-sensitive material is developing processed by a processing solution in processing tanks.

Conventionally, an automatic processing apparatus, by which a series of development processing such as color development, bleaching, fixing, washing, etc., in silver halide photographic light-sensitive material is automatically carried out, is widely known.

In such an automatic development processing apparatus, light-sensitive material such as film and paper is successively fed into processing tanks in which each processing solution is stored, and development processing is carried out. However, each processing solution becomes weakened while processing the light-sensitive material and the processing ability of the processing solution is decreased. Further, also as the processing procedure advances and processing solution from the previous process is fed, the processing ability is decreased.

Accordingly, a replenisher including processing agents is periodically replenished corresponding to the processed area of the light-sensitive material.

Further, an apparatus by which solid processing agents are replenished, (here, solid means tablet type processing agents in which powders or granules of the processing components are compression-molded into a predetermined shape, the sectional shape of which is a circular), is disclosed in the official gazette of WO 92/20013.

When the processing amount of the light-sensitive material is small and the time between processing is long, sometimes the liquid level of the processing tank is lowered and the processing solution becomes more concentrated. In this case, not the replenisher but the supply of water (which is called water supply, hereinafter) is necessary. Conventionally, water supply is manually carried out by users according to a previously designated amount. Because the above-described evaporation amount is changed due to the effects of temperature or humidity in the environment of the apparatus, in which the automatic processing apparatus is used, or processed amounts or processing temperature of the light-sensitive materials, a problem exists in that it is difficult to accurately carry out the appropriate water supply.

On the other hand, in the automatic processing apparatus structured in such a manner that solid processing agents are replenished, water supply to maintain the concentration of processing solutions corresponding to the replenishment of these processing agents is necessary separately from the above-described water supply for the evaporation. Therefore, water supply tanks, in which water for water supply is stored, are provided in the apparatus, and water supply is carried out from these water supply tanks to each processing tank by pumps. Further, when the automation of the water supply for the evaporation is realized, the above-described water supply tanks are necessary.

Here, it is necessary that processing solutions in the processing tanks are adjusted to a predetermined temperature so that the appropriate processing temperature can be maintained. This is done by a combination of detection of the temperature of the processing solutions by temperature sensors, and control of supplying power to heaters based on the temperature detection.

However, when the ambient temperature in the vicinity of the apparatus is low, the difference between the water temperature in the water supply tanks and that of the processing solutions in each processing tank becomes large. Accordingly, there are possibilities of the following problems, in which: when low temperature water is mixed into the processing solutions in the case of the water supply from the water supply tanks, the temperature of the processing solutions is lowered, and is lower than the allowable temperature range in which developing processing can be carried out; or when solid processing agents are used, a longer period of time is necessary for the dissolution of the solid processing agents when the temperature of the processing solutions is lowered.

The replenishing operations of the processing agents or replenishing solutions are carried out at intervals based on the accumulation value of the number of processed amounts of the light-sensitive materials or processed area. However, when the processed amounts per unit of time is small, there is a problem in which the number of times of replenishment is decreased, and deterioration of the processing solutions is a major concern.

Further, when the water-supply operation is carried out in accompany with the replenishment of the solid processing agents, a relatively long period of time is necessary for dissolution of the processing agents. Accordingly, when an amount of the water supply corresponding to the replenishment of the processing agents is supplied in timed relationship with the replenishment of the processing agents, a surplus water supply is carried out before the processing agents are dissolved. Therefore, there is a potential problem in which variations of the concentration of the processing solutions at the time of replenishment become large.

When, for example, the washing tank is structured by a plurality of tanks, and further, when there is a processing tank (for example, the fixing tank), in which the same kind of water as that in the plural washing tanks can be used, the followings are required: these plural processing tanks should not be individually provided with pumps; the replenishing operations should not be realized by complicated piping; water supply can be supplied to each processing tank by a fairly simple structure; and a large amount of overflow of the water by an ineffective water supply should be extremely prevented.

Further, when the replenishing solution tank or water supply tank is empty, or no solid processing agent is available, the processing solution concentration or processing ability can not be maintained so that processing should be stopped. However,when the apparatus is structured in such a manner that processing is stopped immediately, the operability is not acceptable, and maintenance operation is complicated, which are disadvantageous.

That is, although no problem occurs in the case where the replacement operation is rapidly carried out in the automatic processor, the following problems occur in mini-laboratories, the number of which has greatly increased recently, and which has an automatic processor, called a mini-laboratory. There are almost no cases in which an operator is exclusively in charge of the automatic processor. That is, generally, a working staff operates an automatic processor for negative film processing, and simultaneously carries out printing operations by an automatic processor for processing color paper as an operator. Further, the working staff deals with customers, and carries out print arrangement operations. Accordingly, in many cases, for example, the replacement operation of a container, in which solid processing agents are filled, with an empty container is not rapidly carried out.

In the above case, the chemical activity of the processing solutions in the processing tanks can be kept at a predetermined value by stoppage of continuous processing of photographic material in the case where there is no solid processing agent in the accommodating portion. However, in types of methods which are carried out in mini-laboratories, the continuous processing performance is lowered. Further, in order to keep the continuous processing performance at a predetermined value, it is necessary to continuously observe the automatic processor, and to rapidly carry out the replacement operation. Accordingly, operators can not have a sufficient time and spiritual margin for maintaining the automatic processing system, which is a major problem. With regard to the above problem, a method exists in which the continuous processing performance is not sacrificed, and the replacement operation can be carried out with a time and spiritual margin, when the replacement operation is carried out under conditions in which predetermined amounts of solid processing agents remain in the accommodating portion. However, it has been found that the following problems occur in this system.

That is, it is necessary that space, in which a predetermined amount of solid processing agents are accommodated, is provided for an automatic processor. It adversely affects the desired decrease of the size of the automatic processor, or a predetermined amount of remaining solid processing agents is in contact with the highly humid atmosphere near the automatic processor and absorbs the humidity at the time of replacement operations. Accordingly, the solid processing agents adhere to the apparatus, or the components in the solid processing agents are deteriorated.

The supply amount of the solid processing agents corresponding to the light-sensitive material differs depending on the processing solutions such as developing solution, fixing solution, etc. As a result, the automatic processor is needed, in which the amount of remaining solid processing agents is adjusted for each processing agent, but which results in an apparatus which becomes more complicated, which is another problem.

On the other hand, the replenishment of the replenishment water has a similar problem as next described. It is necessary to determine the amount of remaining replenishment water by considering the total amount of replenishment water for each processing tank, in order to eliminate replenishment tanks for each processing solution and to enable the replenishment water to be supplied from a single replenishment water tank to each processing tank, and to carry out the replacement and replenishment operations for replenishing the replenishment water within a sufficient time, without stopping the continuous processing. This adversely affects the desired decrease of the size of the automatic processor, which is a problem.

When the developing processing is continued within the range in which processing can be smoothly carried out even after no water supply and replenishment have been carried out, the following problem occurs. In the case where processing agents are set in the apparatus, and replenishment and water supply are started again, when ordinary replenishment and water supply are carried out, then, the shortage of replenishment and water supply amounts, which is required when developing processing is continuously carried out under the condition that replenishment and water supply can not be carried out, is not supplied. Accordingly, the concentration of he processing solution can not be satisfactorily maintained, which is a problem.

Further, when solid processing agents are used in the apparatus, characteristics such as dissolving time, or the like, change depending on the kinds of processing agents. Accordingly, when conditions of water supply, replenishment, and processing temperature are fixed, sometimes, the processing conditions are not optimum with respect to the processing agents actually used. Further, in the case where a plurality of processing agents are accommodated in a cartridge, and the processing agents are periodically replenished from the cartridge, when the replenishing time intervals are rather long, or the apparatus stops for a fairly long period of time, processing agents accommodated in the cartridge deteriorate due to temperature or humidity conditions, and therefore there is a possibility in which process conditions of water supply, replenishment, and processing temperature deviate from the optimum value of the processing agents.

SUMMARY OF THE INVENTION

In view of the foregoing problems, an object of the present invention is to automatically carry out the water supply operation corresponding to evaporation amounts in each processing tank according to an appropriate processing amount, in an automatic processing apparatus for developing light-sensitive materials by processing solutions in the processing tanks, and to maintain stably the concentration of the processing solution to an appropriate value.

Further, another objective of the present invention is to prevent temperature variations of the processing solutions in the water supply operation to the processing tanks so that the temperature of the processing solution is stabilized within the range in which developing can be optimally carried out. A further objective of the present invention is to stabilize the dissolving time of the processing agents in the structure of the apparatus in which solid processing agents are used.

Another objective of the present invention is to positively prevent the deterioration of the processing solution even when processed amounts of the light-sensitive materials are small and although only the replenishing operation is carried out according to the accumulated value of the processed amounts, there is a possibility that the processing solution is deteriorated.

A further objective of the present invention is to prevent a large variation of the concentration of the processing solution due to the replenishment of solid processing agents and the water supply operation corresponding to the replenishment, in the structure in which solid processing agents are replenished at a predetermined interval into the processing tanks, and to carry out developing processing of the light-sensitive materials under stable concentration conditions.

Still another objective of the present invention is to effectively carry out the water supply operation by a rather simple structure in the case where, for example, the washing tank is composed of a plurality of tanks.

A further objective of the present invention is to increase the operability and the ease of maintenance of the apparatus in the case where processing agents for replenishment and water for water supply are not available, making maintenance necessary.

That is, the present invention relates to an automatic processing apparatus for silver halide photographic light-sensitive material. An object of the present invention is to maintain the photographic processing performance of the automatic processing apparatus, in which solid processing agents are used, at a predetermined value, and to simplify the replacement operation of solid processing agents or replenishment water, in the automatic processing apparatus in which silver halide photographic light-sensitive material is processed using solid processing agents.

A further objective of the present invention is to appropriately maintain a replenishment/water supply control, and further, to maintain temperature of the processing solution even when kinds of processing agents are changed or processing agents are deteriorated, in the structure in which solid processing agents are replenished in the processing tanks at predetermined time intervals.

As described above, an automatic processing apparatus according to the present invention is structured as follows. The automatic processing apparatus comprises: an evaporation amount correlation parameter detecting means for detecting parameters correlating to the evaporation amount from the processing solution; an evaporation water supply amount setting means for setting the water supply amount due to evaporation based on the detected parameters, and a water supply means supplies water into the processing tank, based on the evaporation water supplying amount adjustably set by the evaporation water supply amount setting means.

The automatic development apparatus according to the present invention is structured as follows. In the apparatus according to the present invention, at least one of processing solution temperature, ambient temperature, ambient humidity or a processing amount of light-sensitive material is detected as a parameter correlating with the evaporation amount.

Further, the automatic processing apparatus according to the present invention is structured as follows. The evaporation amount correlation parameter detecting means detects the waste water amount from the processing tank, and a history of water supply operations by the water supply means as a parameter correlating with the evaporation amount.

The automatic processing apparatus according to the present invention is structured as follows. The waste water amount described above is detected as the number of replacement of the waste water in a waste water tank in which the waste water from the processing tank is stored.

The automatic processing apparatus according to the present invention is structured as follows. The water supply means is structured so as to carry out water supply operations into the processing tank at a predetermined time interval, and the evaporation water supply amount setting means adjustably sets at least either the predetermined time intervals of the water supply operations for evaporation by the water supply means or the evaporation water supply amount per single water supply operation, based on the parameters detected by the evaporation amount correlation parameter detecting means.

Another example of the automatic processing apparatus according to the present invention comprises: a processing solution temperature adjusting means for adjusting the temperature of the processing solution in the processing tank to a setting temperature; a water supply tank for storing the water to be supplied into the processing tank; a water supply means for supplying the water stored in the water supply tank into the processing tank at predetermined time intervals; and a water supply tank heating means for heating the water stored in the water supply tank.

The automatic processing apparatus having the water supply tank heating means further comprises a solid processing agent replenishing means for replenishing solid processing agents into the processing tank at a predetermined time interval.

The automatic processing apparatus according to the present invention is structured as follows. The automatic processing apparatus having the water supply tank heating means further comprises: a processing solution temperature detecting means for detecting the processing solution temperature in the processing tank; a water supply temperature detecting means for detecting the water supply temperature in the water supply tank; and a water supply heat adjusting means to adjust heating by the water supply tank heating means based on the detected processing solution temperature and water temperature.

An automatic processing apparatus in other examples comprises: a processing component replenishing means for replenishing processing components into the processing tank at predetermined time intervals; a throughput detection means for detecting the processed amounts of the light-sensitive material per unit of time; and a processing agent replenishing time interval reduction means for reducing the processing agent replenishing time interval in the processing component replenishing means when the throughput per unit of time detected by the throughput detection means is less than a predetermined amount.

The automatic processing apparatus according to the present invention is structured as follows. In the apparatus, the processing component replenishing means replenishes the processing components at time intervals based on an accumulated value of the processed amounts of light-sensitive material.

Further, the automatic processing apparatus according to the present invention is structured as follows. In the apparatus, the processing component replenishing means is structured so that solid processing agents are supplied into the processing tank at predetermined time intervals; and a water supply means for supplying the water into the processing tank at predetermined time intervals, and a water supply amount increasing means for increasing the water supply amount by the water supply means at the time when the throughput per unit time detected by the throughput detection means is less than a predetermined value, are provided.

An automatic processing apparatus in other examples comprises: a processing agent replenishment means for replenishing solid processing agents into the processing tank at predetermined time intervals; and a water supply means for processing agents for supplying water corresponding to the replenishment of processing agents by the processing agent replenishment means at predetermined time intervals in timed relationship with the processing agent replenishment interval.

The automatic processing apparatus in other examples comprises a divided-water supply means for processing agents for supplying the water, the amount of which corresponds to the amount of individual replenishment of processing agents by the processing agent replenishing means and is divided into a plurality of amounts, at a plurality of times.

The automatic processing apparatus according to the present invention is structured as follows. In the apparatus, the processing agent replenishment means and the water supply means for processing agents or the divided-water supply means for processing agents replenish the processing agent and supply the water at the interval based on the accumulated processed area of the light-sensitive material.

Further, the automatic processing apparatus according to the present invention is structured as follows. In the apparatus, the replenishment and water supply intervals in the processing agent replenishment means and the water supply means for processing agent or the divided-water supply means for processing agent are set for each processing tank.

The automatic processing apparatus in other examples, which is an automatic processing apparatus for developing light-sensitive materials by processing solutions in the processing tank, includes a plurality of washing tanks and a fixing tank. The automatic processing apparatus comprises a washing water supply means for supplying washing water from a washing water tank to the farthest washing tank from the fixing tank in the plurality of washing tanks. The automatic processing apparatus is structured so that overflowed washing water is supplied successively from the washing tank located farthest from the fixing tank to adjoining washing tanks. The automatic processing apparatus further comprises: a fixing tank water supply means for supplying washing water from the washing tank, to which washing water is finally supplied by the overflow, to the fixing tank; and a water supply operation start timing control means for starting the water supply operation of the washing water supply means in delayed timed relationship with the water supply operation by the fixing tank water supply means.

The automatic processing apparatus according to the present invention comprises: the washing water supply means; the fixing tank water supply means; and the water supply operation start timing control means. The automatic processing apparatus further comprises: a liquid level sensor for detecting the liquid level of the washing tank for supplying the washing water to the fixing tank, and for outputting a water supply requirement signal to the washing water supply means; and a water supply requirement overriding means for overriding the water supply requirement signal from the liquid level sensor within a predetermined period of time from the start of the operation of the fixing tank water supply means.

The automatic processing apparatus according to the present invention comprises: the washing water supply means; the fixing tank water supply means; and the water supply operation start timing control means. The automatic processing apparatus further comprises a liquid level sensor for detecting the liquid level of the washing tank for supplying the washing water to the fixing tank, and for outputting a water supply requirement signal to the washing water supply means. In the automatic processing apparatus, the liquid level to be detected by the liquid level sensor is located below the liquid level corresponding to a predetermined supply amount supplied from the overflow liquid level of the washing tank to the fixing tank.

The automatic processing apparatus according to the present invention comprises a processing agent replenishing means for replenishing solid processing agents into the processing tank at predetermined intervals. In the automatic processing apparatus, the processing agent replenishing means replenishes the processing agents at intervals based on the accumulated value of the processed amounts of the light-sensitive material.

The automatic processing apparatus according to the present invention is structured so that the washing water stored in the washing tank is distilled water obtained by processing the waste water overflowing from each processing tank.

The above object can be attained by the following means. The 1st embodiment of an automatic processing apparatus for a silver halide photographic light-sensitive material comprises: processing tanks in which processing solutions for silver halide photographic light-sensitive material are accommodated; and a solid processing agent supplying means for supplying solid processing agents into processing tanks, wherein processing of the silver halide photographic light-sensitive material is inhibited when an insufficient supply amount of the solid processing agents is equal to a predetermined value.

The 2nd embodiment of the present invention comprises processing tanks in which processing solutions for silver halide photographic light-sensitive material are accommodated, and a solid processing agent supplying means for supplying solid processing agents into processing tanks, wherein an amount equal to the insufficient supply amount of solid processing agents is replenished after the supply of the solid processing agents by the solid processing agent supplying means has been stopped and the supply is started again.

The 3rd embodiment of the present invention is the automatic processing apparatus for silver halide photographic light-sensitive material according to the 1st embodiment, and comprises: a solid processing agent supplying means for supplying the solid processing agents into the processing tanks according to a predetermined control; a computing means for computing the insufficient supply amount of the solid processing agents with respect to the predetermined control by the solid processing agent supplying means; and a processing inhibition means for inhibiting processing for silver halide photographic light-sensitive material when an insufficient supply amount computed by the computing means is equal to a predetermined value.

The 4th embodiment of the present invention is the automatic processing apparatus for silver halide photographic light-sensitive material according to the 2nd embodiment, and has: the solid processing agent supplying means for supplying the solid processing agents into the processing tanks according to a predetermined control; the computing means for computing the insufficient supply amount of the solid processing agent with respect to the predetermined control by the solid processing agent supplying means; and a solid processing agent increased amount supply means for supplying the solid processing agents, the amount of which is increased corresponding to the insufficient supply amount computed by the computing means, into processing tanks.

The 5th embodiment of the present invention is the automatic processing apparatus for silver halide photographic light-sensitive material according to the 3rd or the 4th embodiment, wherein the computing means detects that no solid processing agent is supplied according to a predetermined control, and computes the insufficient supply amount.

The 6th embodiment of the present invention is the automatic processing apparatus for silver halide photographic light-sensitive material according to the 3rd or the 4th embodiment, wherein the computing means computes the insufficient supply amount from an operation amount of the solid processing agent supplying means when the remaining amount of the solid processing agent is less than a predetermined amount.

The 7th embodiment of the present invention is the automatic processing apparatus for silver halide photographic light-sensitive material, wherein the computing means computes the insufficient supply amount from the operation amount of the solid processing agent supplying means after a predetermined amount of the solid processing agents has been replenished.

The 8th embodiment of the present invention is the automatic processing apparatus for silver halide photographic light-sensitive material according to the 4th to the 7th embodiment, wherein the solid processing agent increased amount supply means supplies an amount of the solid processing agents equal to the insufficient supply amount, separately from the predetermined control, after the solid processing agents have been replenished.

The 9th embodiment of the present invention is the automatic processing apparatus for silver halide photographic light-sensitive material according to the 4th to the 7th embodiment, wherein the solid processing agent increased amount supply means adds an amount equal to the insufficient supply amount to the supply amount according to the predetermined control, and the total of two supply amounts is supplied into the processing tanks in such a manner that the supply amount is increased by the amount equal to the insufficient amount, after the solid processing agents have been replenished, and the increased amount supply operation is completed when the amount equal to the insufficient supply amount has been supplied into the processing tanks.

The 10th embodiment of the present invention is the automatic processing apparatus for silver halide photographic light-sensitive material according to the 4th to the 9th embodiment, wherein the solid processing agent increased amount supply means supplies the solid processing agents in such a manner that the insufficient supply amount of the solid processing agents is replenished, only when processing for the silver halide photographic light-sensitive material is inhibited by the processing inhibition means.

The 11th embodiment of the present invention is the automatic processing apparatus for silver halide photographic light-sensitive material according to the 4th to the 7th embodiment, wherein the solid processing agent increased amount supply means supplies the solid processing agents in such a manner that the insufficient supply amount of the solid processing agents is replenished, separately from the predetermined control, when the throughput of the light-sensitive material is equal to a predetermined value.

The 12th embodiment of the present invention is the automatic processing apparatus for silver halide photographic light-sensitive material according to the 1st to the 11th embodiment, wherein the predetermined value of the insufficient supply amount of the solid processing agents is set depending on the type of the processing agents and/or the amount of the processing solution in the processing tanks.

The 13th embodiment of the present invention is the automatic processing apparatus for silver halide photographic light-sensitive material according to the 1st to the 12th embodiment, wherein the solid processing agent is a tablet.

The 14th embodiment of the present invention is the automatic processing apparatus for silver halide photographic light-sensitive material according to the 1st embodiment, and comprises: processing tanks in which the processing solution of the silver halide photographic light-sensitive material is accommodated; the solid processing agent supplying means for supplying the solid processing agents into the processing tanks; and a replenishment water supplying means for supplying replenishment water into the processing tanks, wherein processing of the silver halide photographic light-sensitive material is inhibited when the insufficient supply amount of the replenishment water reaches a predetermined value.

The 15th embodiment of the present invention is the automatic processing apparatus for silver halide photographic light-sensitive material according to the 1st embodiment, and comprises: processing tanks in which the processing solution of the silver halide photographic light-sensitive material is accommodated; the solid processing agent supplying means for supplying the solid processing agents into the processing tanks; and the replenishment water supplying means for supplying replenishment water into the processing tanks, wherein the replenishment water is supplied in such a manner that the insufficient supply amount of the replenishment water is replenished, after the replenishment water supply by the replenishment water supply means has been stopped, and then the replenishment water supply is started again.

The 16th embodiment of the present invention is the automatic processing apparatus for silver halide photographic light-sensitive material according to the 14th embodiment, and comprises: the replenishment water supplying means for supplying the replenishment water into the processing tanks according to a predetermined control; a computing means for computing the insufficient supply amount of the replenishment water with respect to the predetermined control by the replenishment water supplying means, and a processing inhibition means for inhibiting processing for silver halide photographic light-sensitive material when the insufficient supply amount computed by the computing means is equal to a predetermined value.

The 17th embodiment of the present invention is the automatic processing apparatus for silver halide photographic light-sensitive material according to the 15th embodiment, and comprises: the replenishment water supplying means for supplying the replenishment water into the processing tanks according to a predetermined control; the computing means for computing the insufficient supply amount of the replenishment water with respect to the predetermined control by the replenishment water supplying means; and a replenishment water increased amount supplying means for supplying the insufficient supply amount computed by the computing means into the processing tanks in such a manner that the insufficient supply amount of the replenishment water is replenished.

The 18th embodiment of the present invention is the automatic processing apparatus for silver halide photographic light-sensitive material according to the 16th or the 17th embodiment, wherein the computing means detects that there is no replenishment water supply according to the predetermined control, and computes the insufficient supply amount of the replenishment water.

The 19th embodiment of the present invention is the automatic processing apparatus for silver halide photographic light-sensitive material according to the 16th or the 17th embodiment, wherein the computing means computes the insufficient supply amount from the operation amount of the replenishment water supplying means when the remaining amount of the replenishment water is less than a predetermined value.

The 20th embodiment of the present invention is the automatic processing apparatus for silver halide photographic light-sensitive material according to the 16th or the 17th embodiment, wherein the computing means is a means for computing the insufficient supply amount from the operation amount of the replenishment water supplying means after the replenishment water, the amount of which has been previously set, has been replenished.

The 21st embodiment of the present invention is the automatic processing apparatus for silver halide photographic light-sensitive material according to the 16th or the 17th embodiment, wherein the replenishment water increased amount supply means supplies the same amount of the replenishment water as the insufficient supply amount, separately from the predetermined control, after the replenishment water has been replenished.

The 22nd embodiment of the present invention is the automatic processing apparatus for silver halide photographic light-sensitive material according to the 17th to the 20th embodiment, wherein the replenishment water increased amount supply means adds the amount equal to the insufficient supply amount to the supply amount according to the predetermined control, and supplies the total amount of replenishment water into the processing tanks in such a manner that the insufficient supply amount is replenished, after the replenishment water has been replenished, and the increased amount supply operation is completed when the insufficient supply amount has been completely replenished into the processing tanks.

The 23rd embodiment of the present invention is the automatic processing apparatus for silver halide photographic light-sensitive material according to the 15th to the 22nd embodiment, wherein the replenishment water increased amount supply means supplies the replenishment water in such a manner that the insufficient supply amount is replenished, only when processing of the silver halide photographic light-sensitive material is inhibited by the processing inhibition means.

The 24th embodiment of the present invention is the automatic processing apparatus for silver halide photographic light-sensitive material according to the 14th to the 23rd embodiment, wherein a predetermined value of the insufficient supply amount of the replenishment water is set depending on the type of the processing agent and/or the amount of processing solutions in the processing tanks.

The automatic processing apparatus in other examples comprises: a processing agent replenishing means for replenishing solid processing agents into the processing tank at predetermined intervals; a water supply means for supplying the water in the water supply tank into the processing tank at predetermined intervals; and a processing inhibition means to stop processing of the light-sensitive material when replenishment of the processing agent or water supply is continuously carried out less than a predetermined number of times at predetermined intervals.

The automatic processing apparatus according to the present invention further comprises an increased amount supply means for collectively supplying processing agents or water, the amount of which corresponds to the amount in which no replenishment of the processing agents or no water supply has been carried out at the predetermined intervals, into the processing tank, when the initial replenishment of the processing agents or water supply is carried out after processing of light-sensitive material has been interrupted by the processing inhibition means.

The automatic processing apparatus according to the present invention is structured so that the predetermined number of times in the processing inhibition means is adjusted corresponding to, at least, one of the types of processing tanks or the types of processing agents.

An automatic processing apparatus in other examples comprises: a processing agent replenishment means for replenishing solid processing agents into the processing tank at predetermined time intervals; and a water supply means for supplying the water in the water supply tank into the processing tank at the predetermined time intervals; a processing temperature adjusting means for adjusting the temperature of the processing solution in the processing tank to a predetermined temperature; and a control means, depending on the condition of the processing agent for adjusting, at least, one of the water supply amount by the water supply means, a processing agent replenishment interval by the processing agent replenishment means or the setting temperature by the processing temperature adjusting means.

The automatic processing apparatus according to the present invention is structured so that the control means, depending on processing agent condition, adjusts, at least, one of the water supply amount, the replenishment interval or the setting temperature.

Further, the automatic processing apparatus according to the present invention is structured as follows. In the apparatus, a plurality of solid processing agents are accommodated in a cartridge as a single unit, the detachable cartridge is set into the apparatus main body, the processing agent replenishing means replenishes the processing agents accommodated in the cartridge into the processing tank at predetermined intervals, and the control means depending on processing agent condition, adjusts, at least, one of the water supply amount, the replenishment interval and the setting temperature, based on, at least, one of the elapsed time after the cartridge has been set in the apparatus main body, the ambient temperature condition of the cartridge, or the ambient humidity condition of the cartridge.

An automatic processing apparatus, in other examples, for developing light-sensitive materials by processing solutions in a processing tank, comprises: a processing agent replenishing means for replenishing solid processing agents into the processing tank at predetermined intervals during processing of the light-sensitive material; a circulation pump for circulating the processing solution in the processing tank; and a circulation pump continuous control means for continuously operating the circulation pump during processing of the light-sensitive material and within a predetermined period of time after stoppage of processing.

The automatic processing apparatus according to the present invention is structured so that the predetermined period of time in the circulation pump continuous control means is the time elapsed from the time when processing of the light-sensitive material has stopped to the time when a predetermined period of time has passed.

The automatic processing apparatus according to the present invention is structured so that the predetermined period of time in the circulation pump continuous control means is the elapsed time from the timing of replenishment of the processing agent by the processing agent replenishing means just before processing of the light-sensitive material stops to the time when a predetermined period of time has passed.

An automatic processing apparatus, in other examples, for developing light-sensitive materials by processing solutions in a processing tank, comprises: a circulation pump for circulating the processing solution in the processing tank; and an intermittent circulation means during stoppage of processing for intermittently operating the circulation pump during stoppage of processing of the light-sensitive material.

The automatic processing apparatus according to the present invention further comprises the water supply means for supplying the water into the processing tank at predetermined intervals, and the intermittent circulation means during processing stop intermittently operates the circulation pump in timed relationship with the water supply operation by the water supply means during stoppage of the processing of the light-sensitive material.

An automatic processing apparatus in other examples comprises: a processing agent replenishment means for replenishing solid processing agents into the processing tank at predetermined time intervals; a water supply means for supplying the water into the processing tank at predetermined time intervals; and a water supply timing delay means for forcibly delaying the timing of the water supply by the water supply means when the timing of the processing agent replenishment by the processing agent replenishing means overlaps the timing of the water supply by the water supply means.

In the automatic processing apparatus according to the present invention, a parameter correlating with the evaporation amount from the processing tank is detected, and a water supply operation is carried out according to the parameter. Accordingly, an adequate amount of water, corresponding to the evaporation amount, can be automatically supplied, and thereby, lowering of the surface of the processing solution and changes of the concentration of the processing solution due to evaporation can be avoided.

In the automatic processing apparatus according to the present invention, at least one of the processing solution temperature, the ambient temperature, ambient humidity, or the throughput of the light-sensitive materials is detected as the above-described parameter. Thereby, the water supply operation accurately corresponding to the evaporation amount can be carried out corresponding to changes of the evaporation amount due to variations of the processing temperature, ambient conditions (the temperature and humidity in the vicinity of the apparatus), and the throughput.

In the apparatus according to the present invention, the waste water amount from the processing tank and the history of water supply operations are detected as a parameter correlating with the evaporated amount. The total evaporation amount can be assumed from the difference between the waste water amount and the water supply amount. Accordingly, it is unnecessary to minutely detect various conditions for changing the evaporation amount, and water supply operations, accurately corresponding to variations of the evaporation amount, can be carried out.

In the apparatus according to the present invention, the waste water amount is detected as the number of exchanges of the waste water in the waste water tank. Thereby, it is unnecessary to directly detect the waste water amount, and the detection of the waste water amount becomes easier.

In the apparatus according to the present invention, the intervals of the water supply operations or the water supply amount per one water supply operation are adjustably set based on the parameter correlating with the evaporation amount. The water supply control is carried out in such a manner that the evaporation amount is adjusted by an increase or decrease of the interval of the water supply operation or the water supply amount per one water supply operation.

In the automatic processing apparatus according to the present invention, a heating means, for heating the water for water supply stored in the water supply tank, is provided in the apparatus. The difference between the temperature of the supplied water and that of the processing solution in the processing tank can be stably made small without being overly affected by the ambient temperature. Accordingly, it can be avoided that the processing solution temperature is lowered by the temperature difference between the water for water supply and the processing solution when water is supplied into the processing tank, and the processing solution temperature can be stabilized within the optimum range in which excellent developing processing can be carried out.

In the apparatus according to the present invention, solid processing agents are supplied into the processing tank at predetermined time intervals. As described above, the processing solution temperature can be stabilized by heating the supply water. Accordingly, the dissolving temperature of solid processing agents can be maintained at a predetermined temperature, and the dissolving time of processing agents can be stabilized.

In the apparatus according to the present invention, the processing solution temperature in the processing tank and the water temperature in the water supply tank can be respectively detected. Accordingly, the water supply temperature can be accurately equal to the processing solution temperature, and variations of the processing solution temperature due to the water supply operation can be accurately controlled.

In the apparatus in other examples, the supply interval of processing components is shortened when the processing amount of the light-sensitive materials per unit of time is less than a predetermined value. Accordingly, the deterioration of the processing solution, due to the decrease of the number of the supplying times, can be positively avoided.

In the apparatus in other examples, the processing component supplying time interval is determined based on the accumulated value of the processed amounts of the light-sensitive material. Thereby, the processing agent can be supplied at the time interval based on the specification of solid processing agents corresponding to deterioration of the processing solution depending on the throughput, (the basic interval). Further, even when the throughput is decreased, deterioration of the processing solution can be avoided by the reduction of the supplying interval.

In the apparatus according to the present invention, solid processing agents are supplied into the processing tank at predetermined time intervals. The water supply amount in the water supply control at the time of the supply of solid processing agents is increased when the supplying interval is reduced based on the throughput per unit of time, and the water can be supplied corresponding to the reduction of the supplying intervals.

In the automatic processing apparatus in other examples, solid processing agents are supplied at a predetermined time interval. In this case, the water supply corresponding to the supply of the processing agents is carried out in a shifted timed relationship with the processing agent supplying timing. The water supply operation is carried out before solid processing agents are dissolved, and large variations of the processing solution concentration can be avoided.

In the apparatus according the present invention, the water supply corresponding to the supply of the processing agents is carried out at a plurality of times, and the water is supplied gradually corresponding to the degree of dissolution of the solid processing agents. That is, since processing agents are gradually dissolved during a predetermined time, the water supply amount, corresponding to replenishment of the processing agents at a single operation, is not supplied at single time, but the water supply amount is divided into a plurality of small amounts and these amounts of water are gradually supplied corresponding to the progress of dissolution of the processing agents. Thereby, variations of the processing solution concentration due to dissolution of the solid processing agents and the water supply operation can be sufficiently controlled.

In the apparatus according to the present invention, intervals of replenishment of the processing agents and the supply of the water corresponding to the replenishment of the processing agents are determined based on the accumulated processed area of the light-sensitive material, replenishment of the processing agents and the supply of water are carried out corresponding to lowering of the processing ability of the processing solution due to light-sensitive material processing.

In the apparatus according to the present invention, intervals of replenishment of the processing agents and the water supply are set for each processing tank, and the apparatus can meet requirements for replenishment of the processing agents and the water supply for each tank.

In the automatic processing apparatus in other examples, the washing tank is composed of a plurality of tanks. The water is supplied into one of the plurality of washing tanks. Washing water is supplied to other washing tanks by overflow between respective washing tanks. The overflow-water is supplied from the finally overflowed washing tank to the fixing tank by a pump. Further, the washing water is supplied from the finally overflowed washing tank to the fixing tank before the water is supplied to the initially overflowed washing tank. Accordingly, the following can be controlled: excessive water is not supplied to the washing tank in order to supply the water to the fixing tank; and a large amount of washing water does not overflow from the washing tank and can therefore not be discharged.

In the automatic processing apparatus in other examples, a water supply requirement signal, outputted from the liquid level sensor provided in the washing tank in the final stage of overflow, is invalidated for a predetermined period of time from the time of the water supply operation to the fixing tank. Even in the case where the liquid level of the washing tank is lowered when water is supplied from the washing tank to the fixing tank, it is prevented from being detected as an error of the water supply operation.

In the apparatus according to the present invention, the liquid level to be detected by the liquid level sensor, provided in the washing tank in the final stage of overflow, is determined to be lower than the liquid level corresponding to a predetermined supply amount from the washing tank to the fixing tank at the time of the final stage overflow. Accordingly, the lowering of the liquid level in the final washing tank is not detected by the liquid level sensor when the water is supplied to the fixing tank.

Further, in the apparatus according to the present invention, solid processing agents are supplied to the tank at the time interval corresponding to the accumulated value of the processing amount so that the apparatus can cope with the deterioration of the processing solution corresponding to the processing amount of the light-sensitive material.

Further, in the apparatus according to the present invention, water to be supplied to the washing tank is distilled water obtained by processing the discharged water collected by overflowing, and that water can be recycled in the apparatus.

Due to the foregoing compositions, the automatic processing apparatus for silver halide photographic light-sensitive material according to the 1st embodiment has processing tanks in which processing solutions for the silver halide photographic light-sensitive material are accommodated, and the solid processing agent supplying means for supplying the solid processing agents into the processing tanks, and is structured such that the apparatus inhibits the processing for silver halide photographic light-sensitive material when the insufficient supply amount of the solid processing agents is equal to a predetermined value. Accordingly, when the insufficient supply of the solid processing agents occurs, and the insufficient supply amount is equal to a predetermined value, further processing of the silver halide photographic light-sensitive material is inhibited. Therefore, there is no possibility that silver halide photographic light-sensitive material, the photographic property of which is deteriorated, is produced when the developing operation continues while the replacement operation is delayed and the chemical activity of the processing solution is being lowered.

The automatic processing apparatus for silver halide photographic light-sensitive material according to the 2nd embodiment has processing tanks in which processing solutions for the silver halide photographic light-sensitive material are accommodated, and has the solid processing agent supplying means for supplying the solid processing agents into the processing tanks, and is structured such that the supply of the solid processing agents by the solid processing agent supplying means is stopped, and after the supply of the solid processing agents has started again, the insufficient supply amount is supplied. Therefore, even when processing of the silver halide photographic light-sensitive material is advanced while the supply of the solid processing agents is stopped, and the activity of the processing solutions is lowered a little, the somewhat-lowered activity can be recovered after the supply of the solid processing agents is started again. In this connection, the expression that the activity of the processing solution is lowered a little, means conditions in which the chemical activity of the processing solution is lowered to less than ideal conditions, however the photographic property is not adversely affected.

The automatic processing apparatus for silver halide photographic light-sensitive material according to the 3rd embodiment has: a solid processing agent supplying means for supplying the solid processing agents into the processing tanks according to a predetermined control; a computing means for computing the insufficient supply amount of the solid processing agents with respect to the predetermined control by the solid processing agent supplying means; and a processing inhibition means for inhibiting processing for silver halide photographic light-sensitive material when the insufficient supply amount computed by the computing means is equal to a predetermined value. Accordingly, even when the amount of the solid processing agents is insufficient, processing is continued until the insufficient supply amount is equal to a predetermined value, and only when the insufficient supply amount is equal to a predetermined value, processing is inhibited. Even when the amount of the solid processing agents is insufficient, and the solid processing agents are not supplied according to a predetermined control, the continuous processing can be carried out during the period of time in which the normal processing property can be obtained. Therefore, the replenishment operations can be carried out in plenty of time. Further, even when the apparatus is structured such that the replenishment is carried out while a specified amount of solid processing agents is remaining, the specified remaining amount which does not affect the operability, can be minimized, and reduction of the size of the automatic processor is not adversely affected. Further, deterioration of the solid processing agent due to humidity can be minimized. The predetermined control in the present invention includes: a control corresponding to the throughput of light-sensitive material; a control corresponding to the operation time of the automatic processor; and a control corresponding to the concentration of the processing solution in the processing tank, and a predetermined amount of solid processing agents is supplied by a control in which a single arbitrary method or combined method is used. In the present invention, the processing inhibition means is a means in which a new processing operation of the light-sensitive material is not further accepted in the automatic processor.

The automatic processing apparatus for silver halide photographic light-sensitive material according to the 4th embodiment has: a solid processing agent supplying means for supplying the solid processing agents into the processing tanks according to a predetermined control; a computing means for computing the insufficient supply amount of the solid processing agent with respect to the predetermined control by the solid processing agent supplying means; and a solid processing agent increased amount supply means for supplying the solid processing agents, the amount of which is increased corresponding to the insufficient supply amount computed by the computing means, into processing tanks. Accordingly, even when the insufficient supplying amount of the solid processing agents occurs, the solid processing agent increased amount supply means supplies the insufficient supplying amount into the processing tanks in such a manner that the supplying amount is increased, so that the chemical activity of the processing solutions in the processing tanks can be kept to an ideal value, and stability of the photographic processing performance can be attained.

The automatic processing apparatus for silver halide photographic light-sensitive material according to the 14th embodiment comprises: processing tanks in which the processing solution of the silver halide photographic light-sensitive material is accommodated; the solid processing agent supplying means for supplying the solid processing agents into the processing tanks; and a replenishment water supplying means for supplying replenishment water into the processing tanks, wherein processing of the silver halide photographic light-sensitive material is inhibited when the insufficient supply amount of the replenishment water reaches a predetermined value. Accordingly, when the insufficient supply of the replenishment water occurs, and the insufficient supply amount is equal to a predetermined value, further processing of the silver halide photographic light-sensitive material is stopped. Therefore, there is no possibility in which silver halide photographic light-sensitive material, the photographic property of which is deteriorated, is produced when the developing operation is continued while the replacement operation is delayed and the chemical activity of the processing solution is being lowered.

The automatic processing apparatus for silver halide photographic light-sensitive material according to the 15th embodiment comprises: processing tanks in which the processing solution for the silver halide photographic light-sensitive material is accommodated; a solid processing agent supplying means for supplying the solid processing agents into the processing tanks; and the replenishment water supplying means for supplying replenishment water in the processing tanks, wherein the insufficient supply amount of the replenishment water is supplied in such a manner that the insufficient supply amount is replenished, after the replenishment water supply has been stopped by the replenishment water supply means, and then the replenishment water supply is started again. Therefore, even when processing of the silver halide photographic light-sensitive material continues while the supply of the replenishment water is stopped, and the chemical activity of the processing solutions is slightly lowered, the activity which is somewhat lowered can be recovered after the supply of the solid processing agents is started again. In this connection, the expression that the activity of the processing solution is slightly lowered, means conditions that the chemical activity of the processing solution is lowered to less than ideal conditions, however the photographic property is not greatly affected.

The automatic processing apparatus for silver halide photographic light-sensitive material according to the 16th embodiment comprises: a replenishment water supplying means for supplying the replenishment water into the processing tanks according to a predetermined control; a computing means for computing the insufficient supply amount of the replenishment water with respect to the predetermined control by the replenishment water supplying means; and a processing inhibition means for inhibiting processing for silver halide photographic light-sensitive material when the insufficient supply amount computed by the computing means is equal to a predetermined value. Accordingly, even when the amount of the replenishment water is insufficient, processing continues until the insufficient supply amount is equal to the predetermined value, and only when the the insufficient supply amount is equal to a predetermined value, processing is inhibited. Even when the amount of the replenishment water is insufficient, and the replenishment water is not supplied according to a predetermined control, continuous processing can be carried out during the period of time in which the normal processing property can be obtained. Therefore, the replenishment operations can be carried out in plenty of time. Further, even when the apparatus is structured such that the replenishment is carried out while a specified amount of replenishment water is remaining at the time of replenishment, the specified remaining amount which does not affect operability, can be minimized, and reduction of the size of the automatic processor is not adversely affected.

The automatic processing apparatus for silver halide photographic light-sensitive material according to the 17th embodiment comprises: the replenishment water supplying means for supplying the replenishment water into the processing tanks according to a predetermined control; the computing means for computing the insufficient supply amount of the replenishment water with respect to the predetermined control by the replenishment water supplying means; and a replenishment water increased amount supplying means for supplying the amount equal to the insufficient supply amount computed by the computing means into the processing tanks in such a manner that the insufficient supply amount of the replenishment water is compensated. Accordingly, even when the insufficient supplying amount of replenishment water occurs, the replenishment water increased amount supply means supplies the amount equal to the insufficient supply amount into the processing tanks in such a manner that the insufficient supply amount is compensated, so that the chemical activity of the processing solutions in the processing tanks can be kept at an ideal value, and the stability of the photographic processing performance can be attained.

In the automatic processing apparatus in other examples, even when water in the processing tank or the water supply tank, to which the processing agents or water should be replenished or supplied according to the time interval corresponding to the accumulated value of the processed amounts, does not exist, processing is continued until the number of times of replenishment and water supply, actually not conducted at the replenishment/water supply timing according to the above-described time interval, is equal to a predetermined number, and then processing is interrupted after the above-described number of times is equal to the predetermined number.

In the apparatus according to the present invention, in the case where processing is continued allowing the plurality of replenishment/water supply which are not conducted as described above, all the amount to replenish the processing agents and to supply water at the timing of replenishment/water supply, at which the replenishment/water supply has not actually been conducted, are supplied to the processing tank, and the condition of the processing solution in the processing tank can be returned to the normal condition.

Accordingly, interruption of processing can be avoided in the process, and the replenishment operation of the processing agents and the water supply operation can be carried out in sufficient time.

Further, in the apparatus according to the present invention, the above-described predetermined number of times, in which no replenishment/water supply is allowed, is changed for each processing tank, or is changed corresponding to the kinds of processing agents, and processing is continued by the number of times corresponding to the maximum time interval in which the processing performance can be positively maintained.

The present invention has been made to an automatic processor structured with two supply systems for solid processing agent and replenishment water, while conventional automatic processors have only one supply system for the replenishment solution. The present invention has advantages to an increase in the probability of stoppage of continuous processing when the number of replenishment operations is increased.

In a specific tank, in some cases, a supply means for supplying the replenishment water is not provided, for example, an overflowing solution is supplied from the successive tank and the solid processing agent is supplied to the tank. However, in this case, the following effect is obtained. Because the solid processing agent is dispensed appropriately, a change in the photographic characteristics caused by dilution of the processing solution can be prevented.

In conventional replenishment water supply systems, dispersion occurs instantaneously when the replenishment water is supplied into the processing tanks. Accordingly, the concentration of the processing solution in the processing tank is rapidly changed when the replenishment water is supplied. In contrast to this, solid processing agents, in which a predetermined period of time is necessary for dissolution, are used in the present invention. When these solid processing agents are supplied, the rapid change of the concentration of the processing solution can be eliminated. Therefore, the processing solution concentration control, in which the dissolution time of the solid processing agents is considered, can be carried out in plenty of time, and then, the present invention can be accomplished.

In the automatic processing apparatus in other examples, the apparatus is structured in such a manner that the water supply amount, developing agent replenishing intervals and processing solution setting temperature is adjustably set corresponding to the condition of the processing agents, and the adequate water supply, replenishment, and temperature control can be carried out depending on the condition of the processing agents.

Further, in the apparatus according the present invention, the kinds of the precessing agents are included in the above-described condition of the processing agents, and the apparatus can be adequately controlled even when the kinds of processing agents are changed.

Further, in the apparatus according to the present invention, into which a cartridge having solid processing agents therein is set, the water supply amount, processing agent replenishment interval, processing solution setting temperature can be adjustably set corresponding to the elapsed time after the cartridge is set into the apparatus, or temperature and humidity around the cartridge. Accordingly, solid processing agents accommodated in the cartridge can be controlled corresponding to deterioration during the preparation condition.

In the automatic processing apparatus in other examples, concentration and temperature of the processing solution during processing, and further dissolution time of the processing agents can be stabilized when the circulation pump is continuously operated during processing of light-sensitive material. Further, the circulation pump is not stopped immediately even when processing of the light-sensitive material is stopped, and is continuously operated for a predetermined period of time. Accordingly, solid processing agents replenished immediately before stoppage of processing can be securely dissolved under the condition that the processing solution is circulated.

Further, in the apparatus according to the present invention, the circulation pump is continuously operated until a predetermined period of time passes after stoppage of processing. Accordingly, processing agents can be securely dissolved under the condition that the processing solution is circulated without depending on the replenishment timing of processing agents during processing.

Further, in the apparatus according to the present invention, the circulation pump is continuously operated until a predetermined period of time passes from the timing at which processing agents have been finally replenished. Accordingly, the circulation pump can be continuously operated after stoppage of processing for at least the minimum necessary operation.

In the automatic processing apparatus in other example, the circulation pump is intermittently operated even when the processing of the light-sensitive material is stopped, and the processing solution in the processing tank is circulated. Accordingly, concentration and temperature of the processing solution can be maintained constant during stoppage of processing.

Further, in the apparatus according to the present invention, the circulation pump is operated in timed relationship with the water supply operation to the processing tank in which processing is stopped, variations of concentration and temperature of the processing solution due to the water supply can be sufficiently prevented.

In the automatic processing apparatus in other example, water supply timing is forcibly delayed when the replenishment timing of solid processing agents is overlapped with the water supply timing, and water can be supplied while solid processing agents are dissolving. Accordingly, variations of concentration of the processing solution can be prevented.

DETAILED DESCRIPTION OF THE INVENTION

Examples of the present invention will be described as follows.

Figure 1:
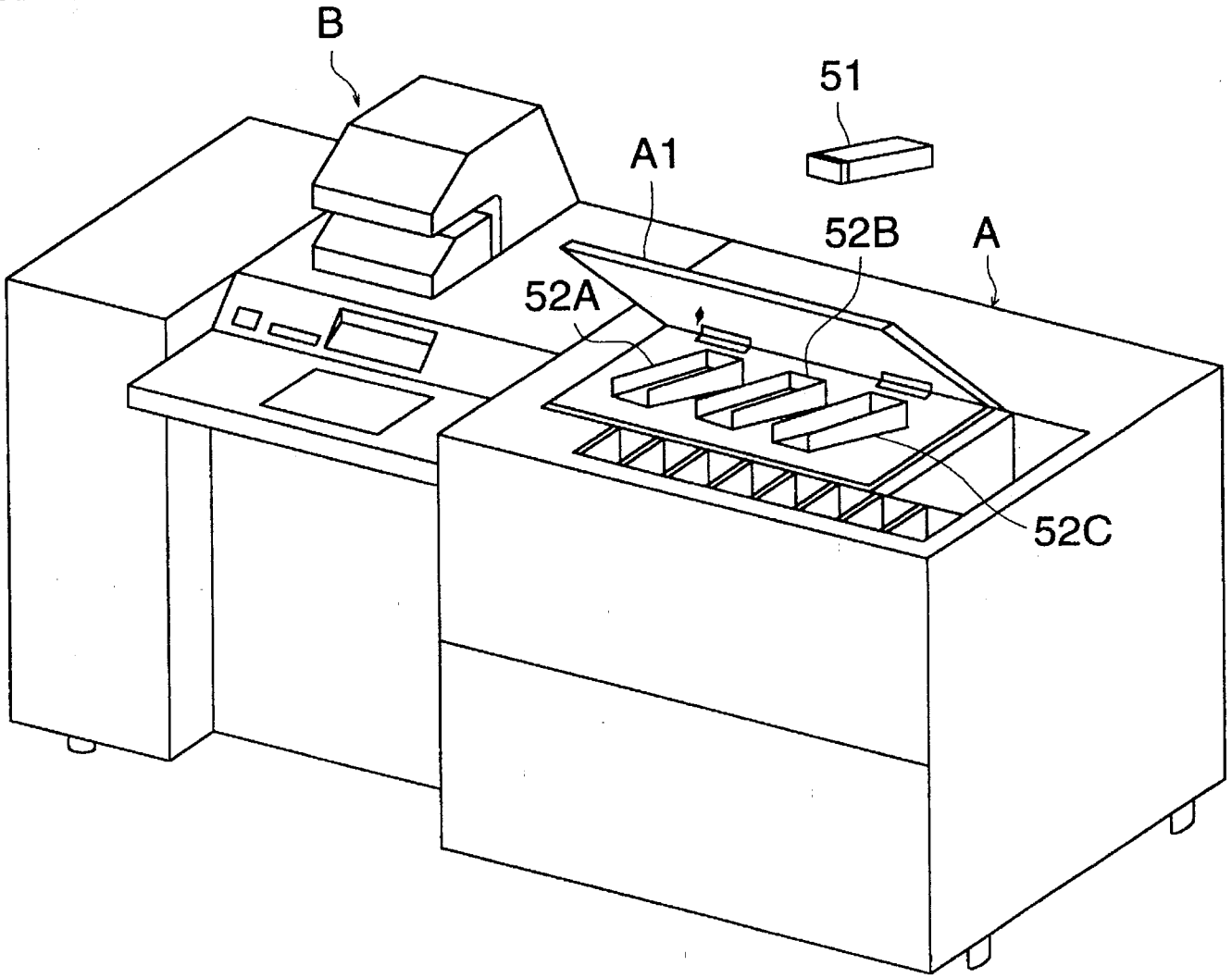
FIG. 1 is a perspective view showing the external appearance of the apparatus in an example of the present invention.

FIG. 1 is a schematic illustration showing the apparatus according to the examples. The apparatus shown in FIG. 1 is a light-sensitive material processing apparatus in which printing apparatus B is integrally provided with an automatic processing apparatus A.

In the automatic processing apparatus A, a plurality of processing tanks are provided in which processing solutions are stored in order to conduct various processing (bleaching, fixing and washing) in the developing process. The light-sensitive material successively passes through these processing tanks and developing processing is carried out.

Here, the processing solution is weakened when the light-sensitive material is processed. Accordingly, it is necessary that processing components are replenished at predetermined time intervals. In the automatic processing apparatus in the present example, the processing components are replenished into the processing tanks as solid processing agents. The solid processing agent is a tablet type processing agent having a circular cross section in which powders or granules of the processing component are compression molded into a predetermined shape, and is called a tablet type processing agent hereinafter.

Tablet charging apparatus 52A, 52B and 52C are respectively provided for each processing tank in the automatic processing apparatus A. In the tablet charging apparatus 52A, 52B and 52C, a cartridge 51 is equipped in which a plurality of tablet type processing agents are accommodated. The tablet type processing agents accommodated in the cartridge 51 are successively supplied into processing tanks and dissolved in the processing solution for replenishment of the process components.

Figure 2:
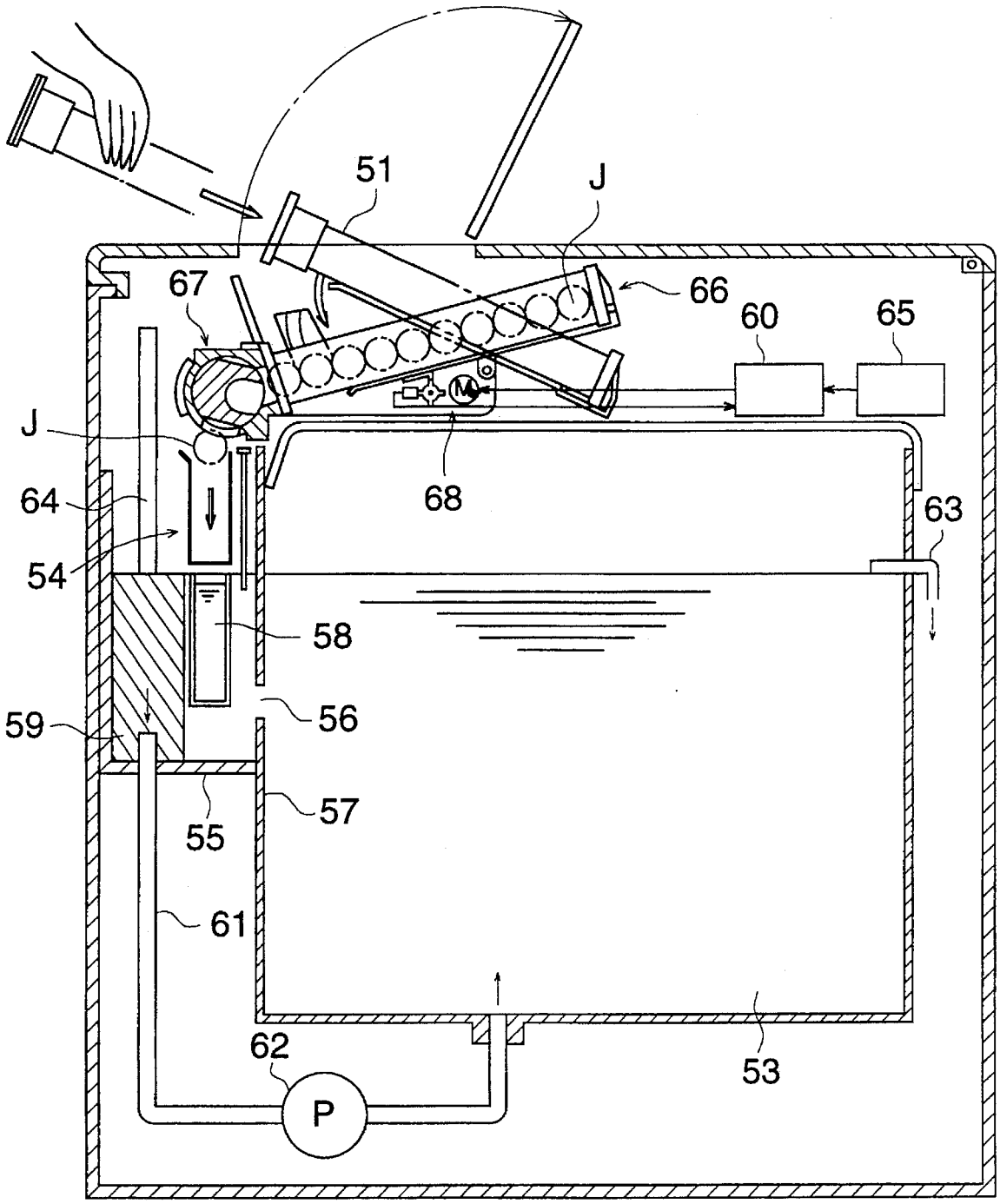
FIG. 2 is a sectional view showing a processing agent replenishment system, a circulation system, etc., in a processing tank in the example.

FIG. 2 is a sectional view showing a processing tank, a tablet charging section, a tablet charging apparatus, and a circulation system. The processing tank 53 includes the tablet charging section 54 integrally provided outside a separation wall of the processing tank 53, and a constant temperature tank 55.

The processing tank 53 and the constant temperature tank 55 are separated by the separation wall 57 in which an opening 56 is formed so that the processing solution can pass between the processing tank 53 and the constant temperature tank 55. Here, the processing tank 53, the constant temperature tank 55, the circulation pipe 61 and the circulation pump 62, which contribute to effective dissolution of solid processing agents, are defined as a processing section.

Since an enclosure 58 for receiving the tablet type processing agents J is provided in the tablet charging section 54 disposed at an upper portion of the constant temperature tank 55, the tablet type processing agents J are not moved to the processing tank 53 in the form of a solid body, but are dissolved in the constant temperature tank 55. That is, the enclosure 58 is made of material such as a net or filter so that the processing solution can pass through the enclosure 58, however, the tablet type processing agent J in the form of a solid body can not pass through the enclosure 58 until it is dissolved.

A cylindrical filter 59 is disposed below the constant temperature tank 55 in such a manner that the cylindrical filter 59 can be replaced. The cylindrical filter 59 removes insoluble matter such as paper scraps and other material in the processing solution. The inside of the filter 59 is communicated with the suction side of a circulation pipe 61 provided through a lower wall of the constant temperature tank 55. The circulation system includes the circulation pipe 61 forming a circulation passage of the processing solution, and also includes a circulation pump 62 and the processing tank 53. One end of the circulation pipe 23 is communicated with the delivery side of the circulation pump 62, and the other end penetrates a lower wall of the processing tank 53, so that the circulation pipe 61 is communicated with the processing tank 53. Due to the foregoing construction, when the circulation pump 62 is operated, the processing solution is sucked from the constant temperature tank 55 and discharged into the processing tank 53, so that the discharged processing solution is mixed with the processing solution in the processing tank 53, and then sent to the constant temperature tank 55. In this way, the processing solution is circulated.

A waste water pipe 63 is provided for permitting the processing solution in the processing tank 53 to overflow, so that the solution level can be maintained constant and an increase in the components conveyed from other processing tanks, being attached to the light-sensitive material, into the processing tank can be prevented. Further, an increase in the components oozing out from the light-sensitive material can be prevented.

A rod-shaped heater 64 penetrates an upper wall of the constant temperature tank 55, and dips into the processing solution in the constant temperature tank. The processing solution in the constant temperature tank 55 and the processing tank 53 is heated by this heater 64, and the temperature of the processing solutions is adjusted to the required temperature for each processing tank by this heater 64.

A throughput information detecting means 65 is disposed at an entrance of the automatic processing apparatus A, and detects the throughput of the light-sensitive material being processed. This throughput information detecting means 65 is composed of a plurality of detecting members that are disposed in a traverse direction of the conveyance direction of the light-sensitive material so as to detect the width of the light-sensitive material. The result of the detection is used for counting the detection time. Since the conveyance speed of the light-sensitive material is previously set in a mechanical manner, the throughput of the light-sensitive material, that is, the area of processed light-sensitive material can be calculated from the width and time information.

An infrared ray sensor, micro switch and ultrasonic sensor capable of detecting the width and conveyance time of the light-sensitive material can be used for this throughput information detecting means 65. A means for indirectly detecting the area of the processed light-sensitive material may also be used for this throughput information detecting means 65. For example, a means for detecting an amount of printed light-sensitive material in a printer processor may be adopted, or alternatively, a means for detecting the number of sheets of the processed light-sensitive material, the area of which is predetermined, may also be adopted. Further, concerning the detection timing, in this example, detection is carried out before processing, however, detection may be carried out after processing or while the light-sensitive material is being dipped in the processing solution.

The control apparatus 60 receives the detection signal outputted from the throughput information detecting means, and causes the tablet charging apparatus 52 to charge the tablet type processing agents into the processing tank whenever the accumulated value of the processed area is equal to a predetermined value. Processing agents are replenished at adequate intervals corresponding to deterioration of the processing solution due to an increase of the processed area.

The tablet charging apparatus 52 is disposed at the upper portion of the processing tank 53, and is composed of a cartridge 51, a cartridge loading means 66, a supply means 67, and a drive means 68. Here, the cartridge 51 is inserted into the tablet charging apparatus 52 by an operator, and then, the cartridge 51 is loaded into the supply means 67 by the cartridge loading means 66 in such a manner that the tablet can be charged into the enclosure. Specifically, the tablet type processing agent J is loaded, individually, from the cartridge 51 into a pocket portion of a rotor, which composes the supply means 67, and is charged into the enclosure 58 when the rotor is rotated.

Figure 3:
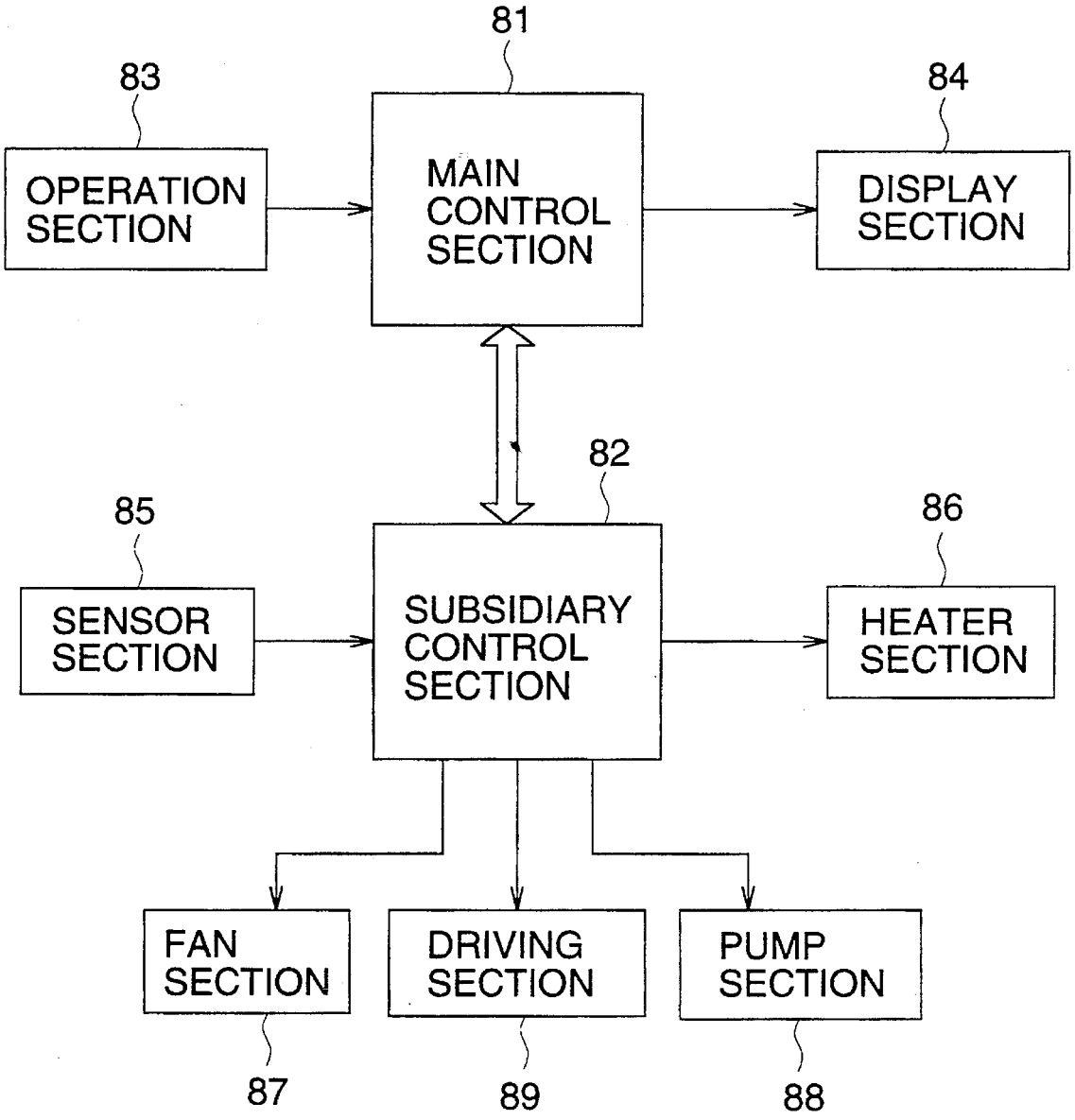
FIG. 3 is a block diagram showing a basic structure of a control system in the example.

As shown in FIG. 3, the control apparatus 60 is composed of a main control section 81 and a subsidiary control section 82. The main control section 81 reads the operation direction signal outputted from an operation section 83 operated by the operator, and displays various setting conditions or information of processing conditions on a display section 84. Detection signals outputted from the throughput information detecting means 65 or a sensor portion 85 such as a liquid level sensor and temperature sensor provided in the processing tank, are inputted into the subsidiary control section 82, and the subsidiary control section 82 controls a heater section 86, a fan section 87 a pump section 88, a conveyance drive section 89 of the light-sensitive material, and the like, in the apparatus.

The main control section 81 and the subsidiary control section can be mutually communicated, and can judge the normality/abnormality of the condition of communication by the following sequence.

Initially, data for checking is transmitted from the main control section 81 side to the subsidiary control section 82 side, and the transmitted data are checked by the subsidiary control section 82 and the result of discrimination of the normality/abnormality is sent to the main control section 81. When the result of the data checking is normal, the main control section checks the data sent from the subsidiary control section 82, and stores the data in the memory, which is shared with both control sections, when the data is normal.

Figure 16:
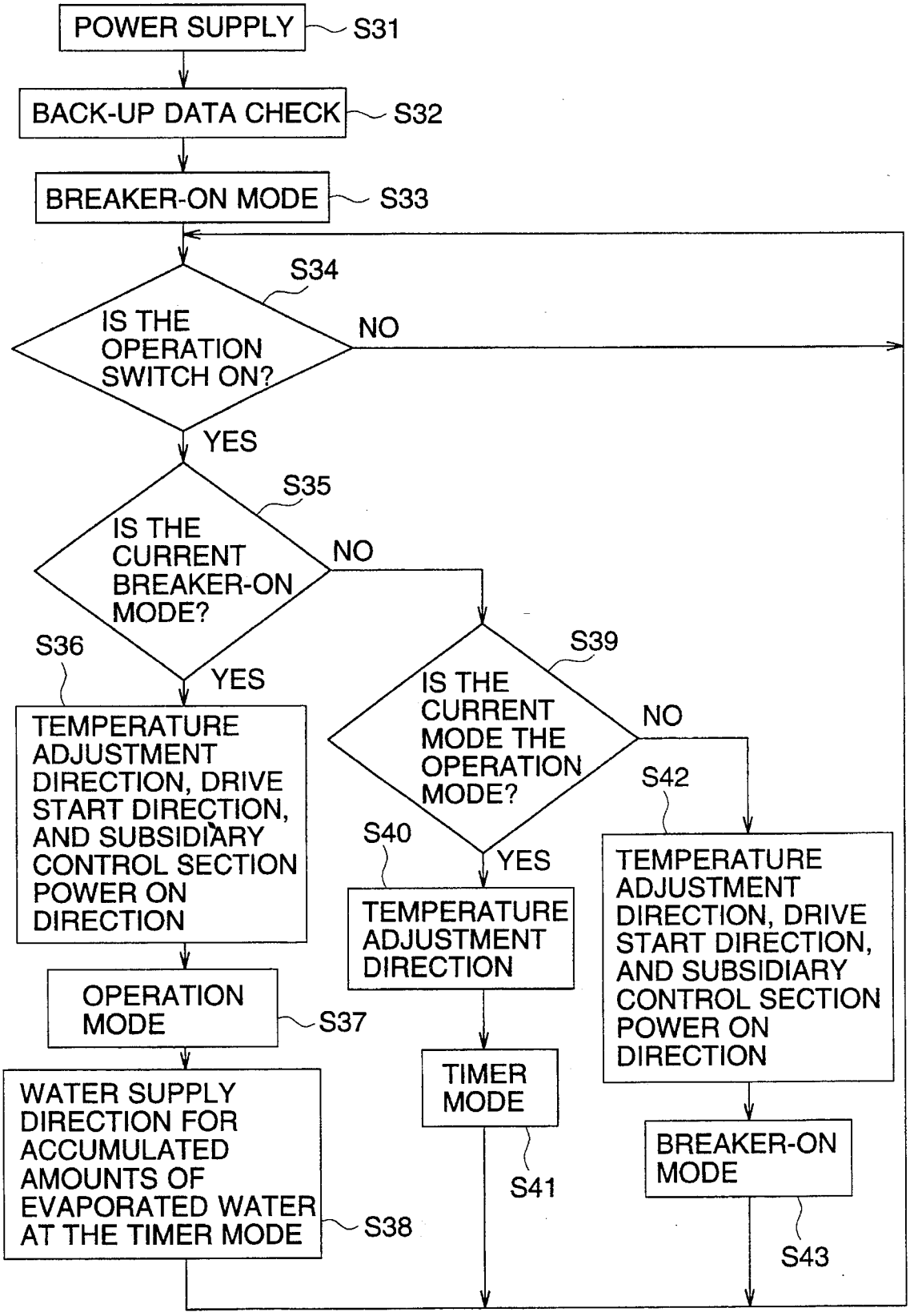
FIG. 16 is a flow chart showing the mode conditions provided in the apparatus in the example.

The apparatus of this example has, as shown by the flow chart in FIG. 16, three kinds of operation conditions of a breaker-On mode, a timer mode, and an operation mode.

The breaker-On mode is a mode (S33) corresponding to a power supply (S31). In this mode, when the operation switch is switched (from S34 to S35), the mode is switched to the operation mode in which the light-sensitive material can be processed actually (S37). The timer mode (S41) is a mode in which the temperature of the processing solution is adjusted by a heater (S40) and the apparatus prepares for the actual developing processing.

As a recovery measure in case of a power failure, when the power is supplied (S31), the main control section 81 checks backup data in which mode the processing is stopped (S32). Due to this mode checking, the mode of the apparatus advances to any of the breaker-On mode, the timer mode or the operation mode.

In the breaker-On mode (S43), this mode condition is displayed, and the command to stop the temperature adjustment of the processing solution or drive of the light-sensitive material is outputted to the subsidiary control section 82. Then, the power-off command is outputted to the subsidiary control section 82 (S42), and the apparatus stands by for switching of the operation switch (S34).

In the timer mode (S41), this mode condition is displayed and the command of the temperature adjustment is outputted to the subsidiary control section 82 (S40). The apparatus stands by for switching to the operation mode while the temperature of the processing solution is being adjusted (S34).

When the timer mode is switched to the operation mode, the main control section 81 gives the command for temperature adjustment and the command for automatic driving for the conveyance of light-sensitive material to the subsidiary control section 82 to correspond to the actual developing processing, so that the developing operation can be carried out.

In the breaker-On mode or timer mode, when a cold area mode for use in cold environmental conditions in which the apparatus is used is set, the temperature control for the cold area may be carried out. The cold area mode may be set by the operator, or it may be set when the ambient temperature is detected by a sensor.

In the operation mode, the subsidiary control section 82 causes the tablet type processing agents to be replenished into each processing tank, and causes water to be supplied into the processing tank corresponding to the replenishment of the processing agents, based on the result of accumulation of the processed surface area of the light-sensitive material (S38).

A switch for replenishing the processing agent and supplying water when necessary, by the command of the operator, is provided in the operation section, independently of the above-described automatic replenishment and water supply operation.

Further, in this example, the apparatus is structured in such a manner that the water supply (evaporation water supply) is carried out corresponding to the evaporation of water from the processing tank independently of the water supply corresponding to the replenishment of the processing agents, as will be described later.

Further, when it is detected that no tablet processing agent is available at the tablet processing agent charging timing by the tablet processing agent charging apparatus, the number of times of no tablet processing agent are counted and memorized. When the tablet processing agents can be supplied into the tank by the replacement of the cartridge, the tablet processing agents are successively replenished by the memorized number of times of no tablet processing agent.

Figure 17:
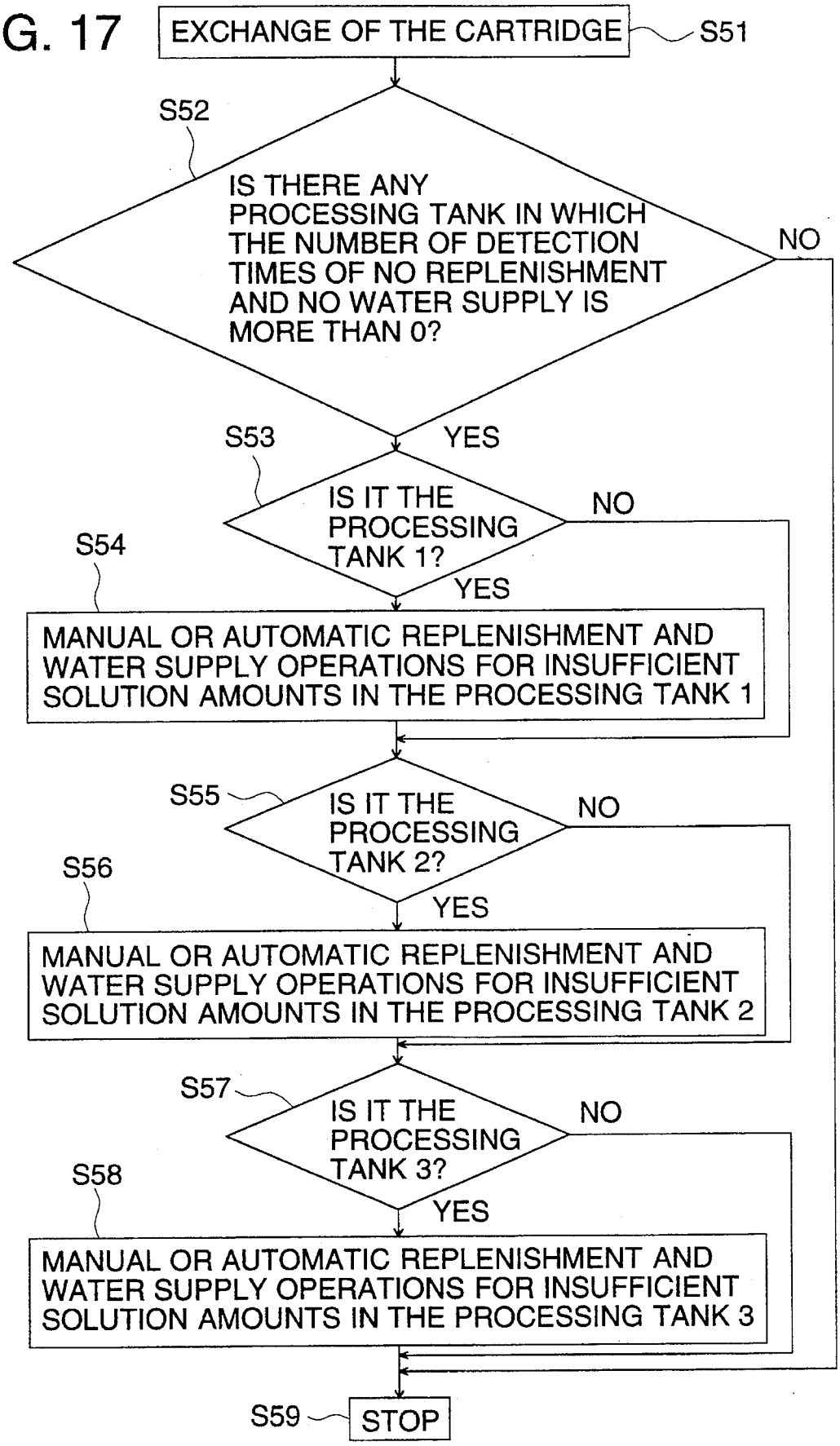
FIG. 17 is a flow chart showing the replenishment operation when a cartridge is replaced.

That is, as shown by the flow chart in FIG. 17, when the cartridge is replaced (S51), the existence of the processing tank, in which the number of times of detection of no tablet processing agent set for each processing tank is counted and memorized, is discriminated (S52). When the processing tank, into which the processing agent could not be replenished at a predetermined interval, exists, the processing agents corresponding to the amount, in which replenishment of the processing agents could not be carried out at the predetermined interval, are successively replenished collectively (S53 through S59). Here, a trigger signal of the replenishment may be the command of the automatic replenishment based on the detection of replacement of the cartridge, or the arbitrary command of replenishment by a manual switch.

The details of the characteristic replenishment and water supply control in the automatic processing apparatus of this example having the outline of the structure as described above, will be described below.

Figure 4:
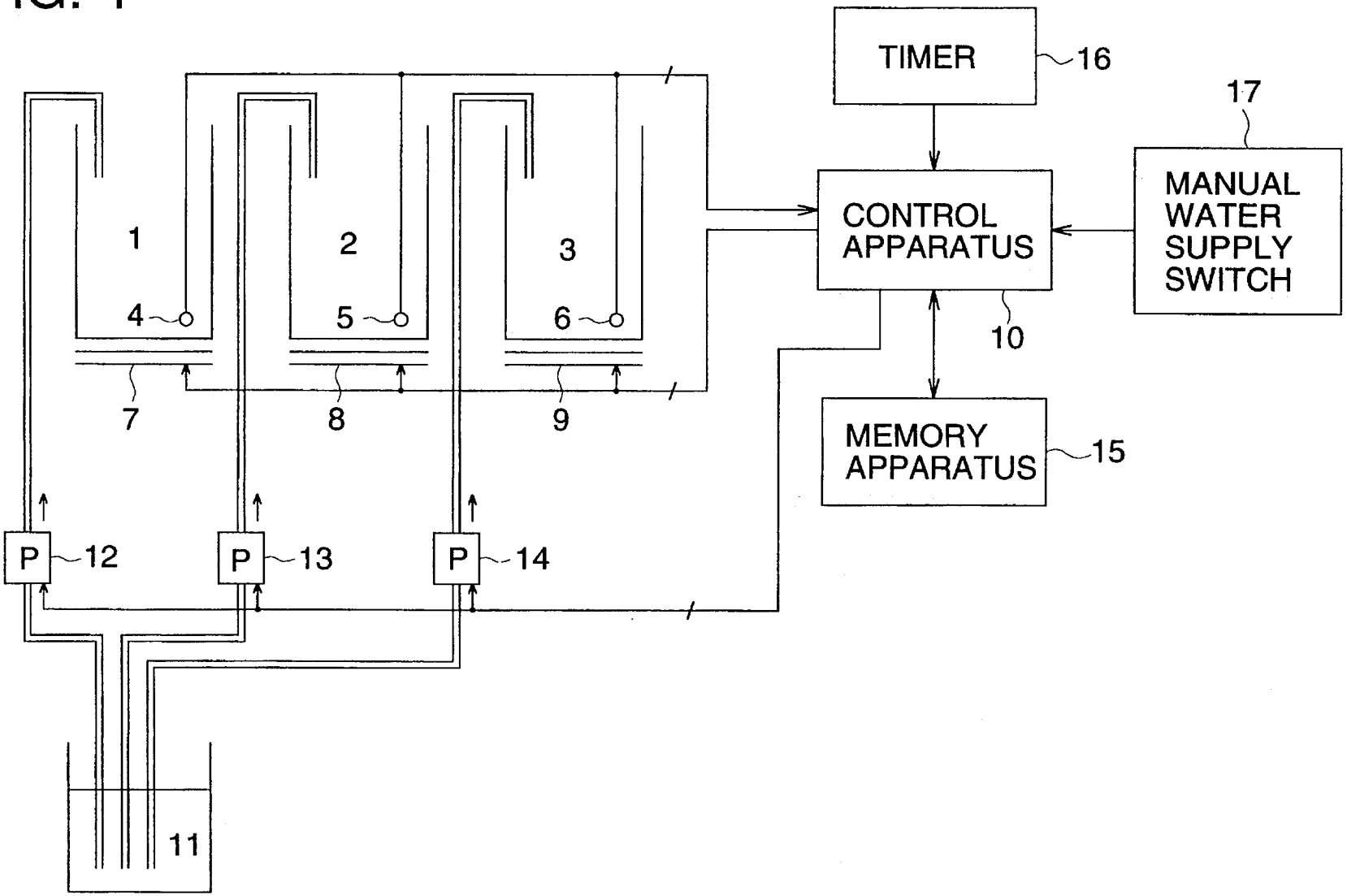
FIG. 4 is a view of the system structure showing the structure in which a temperature control system and a water supply system are provided.

FIG. 4 is a view showing the structure of the processing tank and a water supply system in the automatic processing apparatus. In FIG. 4, the first processing tank 1 is a bleaching processing tank, the second processing tank 2 is the fixing processing tank, and the third processing tank 3 is the washing processing tank. When the light-sensitive material such as a film, or sheet, is sent successively to the first processing tank 1, the second processing tank 2, and the third processing tank 3, the light-sensitive material is processed by each processing solution, and the bleaching, fixing, and washing processes progress, so that developing processing is carried out. Then, after washing processing in the third processing tank 3, drying processing is carried out by the structure not shown, and developing processing of the light-sensitive material is completed.

Temperature sensors 4 through 6 for respectively detecting the temperature of processing solutions, and heaters 7 through 9 for heating respective processing solutions are provided in the processing tanks 1 through 3. These heaters 7 through 9 correspond the heater 64 shown in FIG. 2, and are actually disposed in the constant temperature tank. The electric power supplied to the heaters 7 through 9 are individually feed-back-controlled by the control apparatus 10 (which corresponds the subsidiary control section 82 shown in FIG. 3) so that the temperature of the processing solutions in processing tanks 1 through 3 is respectively maintained at a predetermined temperature for each processing tank, based on the temperature of each processing solution detected by the temperature sensors 4 through 6.

A water supply tank 11 for supplying water into processing tanks 1 through 3 is provided as a common tank which is common to processing tanks 1 through 3. Water stored in the water supply tank 11 can be independently supplied into each processing tanks 1 through 3 by 3 water supply pumps 12 through 14 provided correspondingly to processing tanks 1 through 3.

An individual circulation pump 62 (refer to FIG. 2) is provided in processing tanks 1 through 3 so that the processing solutions in the processing tanks are circulated as described above.

While the light-sensitive material is being processed, it is preferable that the circulation pump 62 is continuously operated so that the processing solution in the processing tank is continuously circulated, and thereby the dissolving time of the tablet type processing agents, and concentration and temperature of the processing solution are stabilized.

Further, when no light-sensitive material is conveyed and processing stops, it is preferable that the circulation pump 62 is not immediately stopped, but that the circulation pump 62 is continuously operated for a predetermined period of time after the stoppage of processing, and then the circulation pump 62 is stopped (a circulation pump continuous control means). This prevents stoppage of the circulation pump 62 before complete dissolution of the tablet type processing agents replenished during processing. Accordingly, the processing agents are dissolved while the processing solution is circulating.

Figure 18:
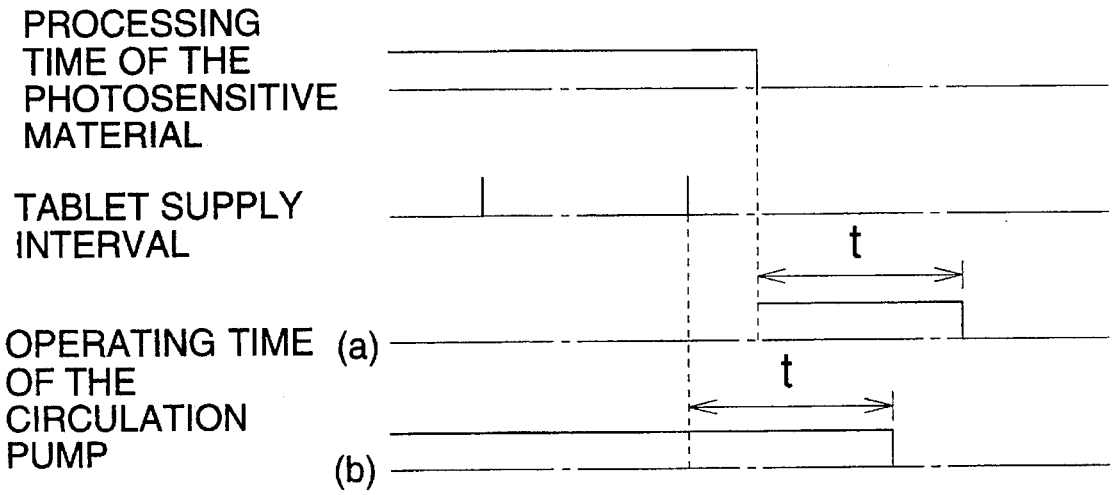
FIG. 18 is a time chart showing the conditions of the operation control of a circulation pump.

Here, a period of time, during which the circulation pump 62 is continuously operated after processing of the light-sensitive material has been stopped, may be a predetermined period of time after the stoppage of processing, for each processing tank, as shown in FIG. 18, or the period of time may be a period of time sufficient for dissolution of the tablet type processing agent from the time the tablet type processing agents are finally supplied (replenished) into each processing tank during processing. When the apparatus is structured so that the timing for the stoppage of the circulation pump 62 is determined depending on the time passed after the time of the final supply of tablet processing agents, the circulation pump 62 is necessarily operated at the minimum operation time.

In FIG. 18, operating time "a" of the circulation pump shows that the circulation pump 62 is stopped when a predetermined time has passed after the processing time of the light-sensitive material has been finished (process has been stopped). Operating time "b" of the circulation pump shows that the circulation pump 62 is continuously operated when the time, which is previously set as a time sufficient for dissolution of the tablet type processing agent, finally supplied into the processing tank during processing, has not passed after the time of charging, even when the processing time of the light-sensitive material has been finished, and the circulation pump 62 is stopped only when the predetermined period of time has passed after the final supply.

Further, in the automatic processing apparatus of the present example, processing components are replenished corresponding to the weakness of processing solutions in the processing tanks 1 through 3 as follows. That is, as described above, tablet-shaped solid processing agents are supplied into the processing tanks 1 through 3 at predetermined time intervals, and the tablet-shaped processing agents are dissolved in the processing solutions. For this purpose, tablet processing agent charging apparatus 52A, 52B and 52C (refer to FIGS. 1 and 2) for charging the tablet type processing agents are respectively provided on processing tanks 1 through 3.

Charging (replenishing) of the tablet processing agents by the tablet processing agent charging apparatus is carried out whenever the accumulated value of the processed sheet area is equal to a predetermined value determined for each processing tank. Further, water supply corresponding to the replenishment of the tablet processing agents is also carried out whenever the accumulated value of the processed sheet area is equal to a predetermined value. Further, the basic water supply amount for one operation which is based on the specification of the solid processing agent in the water supply operation at a predetermined interval, depending on the processed sheet area, may be set based on, for example, a predetermined number of processed sheets having a predetermined size.

Further, when a plurality of kinds of light-sensitive material are processed, it is preferable that the time interval for water supply and replenishment, and the basic water supply amount are set for each kind of light-sensitive material. However, when a plurality of kinds of light-sensitive material are irregularly processed, it is preferable that the above setting is carried out for the light-sensitive material in which the time interval of water supply and replenishment is the shortest in the plurality of kinds of light-sensitive material (the requirement for replenishment amounts is maximum), and the requirement for the basic water supply amount is maximum.

As described above, information corresponding to the processed sheet area is inputted into the control apparatus 10 for the replenishment and water supply control according to the processed sheet area.

Further, information of the accumulated value of the processed sheet area for determining the replenishment and water supply timing (the time interval of replenishment and water supply), the basic water supply amount, and the set temperature of the processing solutions for the heater control, is stored into a detachable memory apparatus 15 such as a floppy disk or the like. This automatic processing apparatus may be structured so that the setting of the processing conditions can be changed, if necessary, when the floppy disk is exchanged corresponding to kinds of light-sensitive material, environmental conditions, required capacity, types of the apparatus, kinds of processing agents, etc.

Further, a timer apparatus 16 is disposed in the control apparatus 10 for carrying out water supply due to evaporation, which will be described later, at every predetermined time.

In this connection, when throughput is large, the replenishment of tablets and water supply is frequently carried out. However, there is the following case: the time interval of the replenishment and water supply becomes longer when the throughput is small; water in the processing tanks evaporates and the solution level is lowered during the above interval; and concentration of the processing solution becomes higher. When the concentration of the processing solution becomes higher due to the water evaporation, the tablet type processing agent can barely be dissolved when it is supplied into the tank. Accordingly, it is necessary to supply the amount of water which is lost by the water evaporation, (which is called evaporation water supply, hereinafter).

Accordingly, the control apparatus 10 is structured so that the evaporation water supply corresponding to the evaporation is carried out into each processing tank at a predetermined interval by the pumps 12 through 14, independently of the water supply control corresponding to replenishment of the tablet type processing agent.

The control apparatus 10 assumes the amount of evaporation for the evaporation water supply control using information of the temperature of the processing solution detected by the temperature sensors 4 through 6 and the processed sheet area (throughput of the light-sensitive material), and information of the environmental temperature and humidity (the ambient temperature and humidity) of the automatic processing apparatus, as parameters correlating with the amount of the evaporation.

Here, the information of the environmental temperature and humidity may be directly obtained when sensors for respectively detecting the ambient temperature and humidity are provided. Alternatively, information of the environmental conditions, area of use, or season is previously inputted into the memory apparatus 15, and the control apparatus 10 may detect the information of environmental temperature and humidity through the memory apparatus 15.

The evaporation water supply control conducted by the control apparatus 10 will be explained below according to the flow chart shown in FIG. 5.

In this example, the temperature sensors 4 through 6, sheet size sensor (a throughput information detection means 65), sensors for detecting the ambient temperature and humidity of the apparatus, or the memory apparatus 15 is used as an evaporation amount correlation parameter detection means. Further, the water supply means is composed of pumps 12 through 14, a water supply tank 11, and a control apparatus 10. The control apparatus 10 functions as an evaporation water supply amount setting means as shown in the flow chart shown in FIG. 5.

Figure 5:
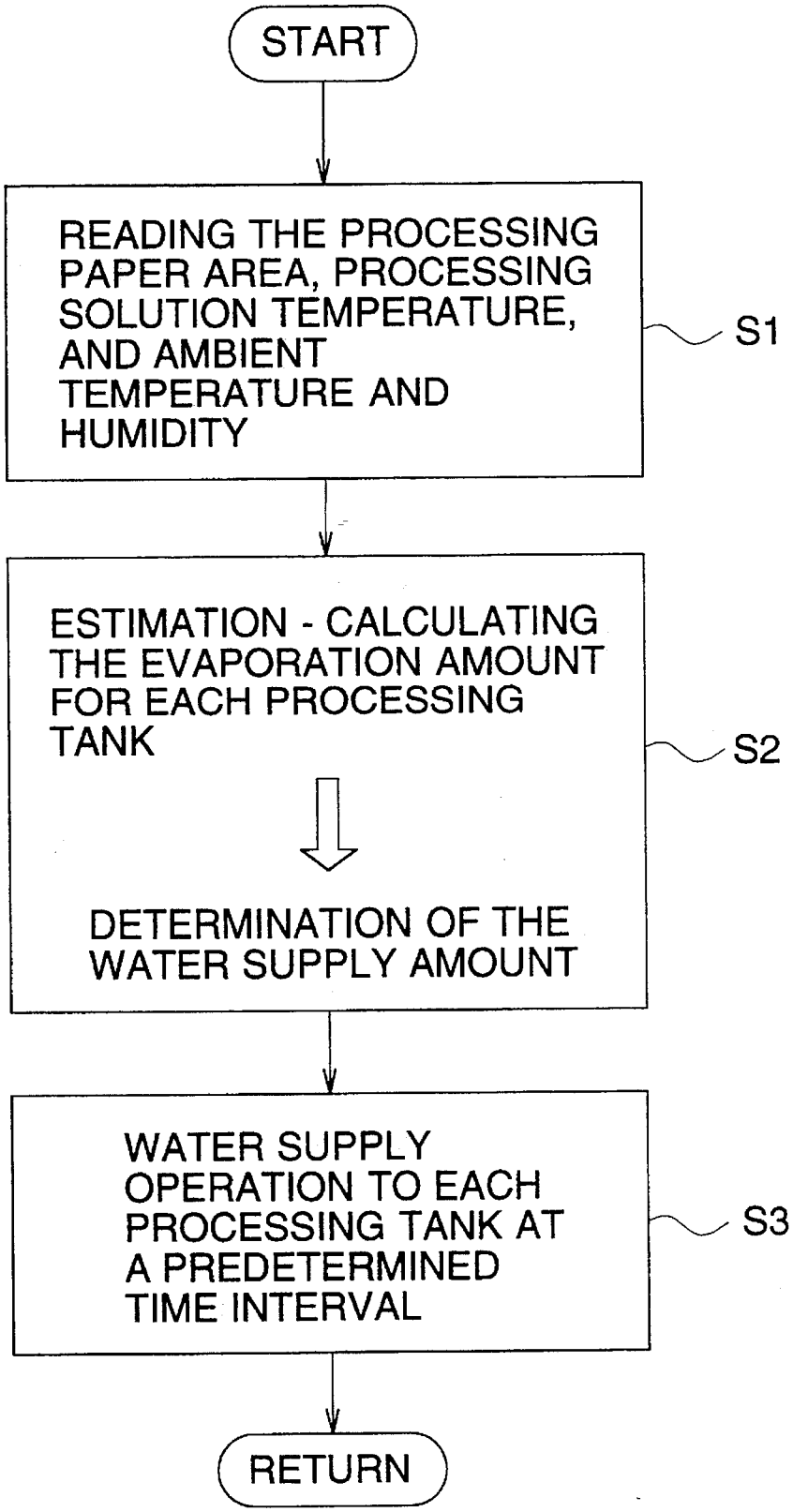
FIG. 5 is a flow chart showing an evaporation water supply control

In the flow chart shown in FIG. 5, initially, the control apparatus 10 reads the processed sheet area (throughput of the light-sensitive material), temperature of the processing solution, and atmospheric conditions (ambient temperature and humidity of the apparatus) (S1). Next, the evaporation water supply amount for one operation at the time when the evaporation water supply is carried out for every predetermined time (for example, one hour) is calculated for processing tanks 1 through 3, based on the amount of evaporation assumed based on parameters correlating with the previously read amount of evaporation (S2).

The evaporation water supply is carried out into processing tanks 1 through 3 at every predetermined time according to the calculated amount (S3). Specifically, water supply pumps 12 through 14 respectively provided in processing tanks 1 through 3 are driven according to an evaporation water supply interval measured by the timer 16, for periods of time corresponding to the the amounts of water supply respectively set for each processing tanks, and the amount of water corresponding to the amount of evaporation is respectively supplied into each of processing tanks 1 through 3.

In the above example, the time interval of evaporation water supply is constant, and the amount of water supply at one operation is adjustably set based on the assumption of the amount of evaporation. However, the amount of water supply at one operation may be fixed, and the water supply interval may be adjustably set. Further, both of the evaporation water supply interval and the amount of water supply at one operation may be changed corresponding to the result of the assumption of the evaporation.

Further, the processing temperature (the temperature of the processing solution), ambient conditions (the ambient temperature and humidity of the apparatus), and the throughput are used as parameters correlating with the amount of evaporation. However, it is not necessary to detect all of the above-described parameters, alternatively, a combination of the above-described parameters or only one parameter may be used.

In the above example, the water supply corresponding to evaporation (evaporation water supply) is automatically carried out based on parameters correlating with the amount of evaporation from the processing tanks 1 through 3. Accordingly, even when throughput is smaller and evaporation is larger, the increase of concentration of the processing solution or lowering of the liquid surface due to evaporation can be securely avoided. Accordingly, it is not necessary for operators to adjust the evaporation water supply according to their experience, this greatly lightens their maintenance burden.

Further, the processing temperature (temperature of the processing solution), atmospheric conditions (ambient temperature and humidity of the apparatus), and throughput are used as parameters correlating with the amount of evaporation. Accordingly, the control apparatus can be set in accordance with variations of the amount of evaporation due to environmental variations, differences of setting of the processing temperature, and variations of throughput, so that evaporation water supply can be accurately carried out.

The evaporation water supply is carried out on the condition that developing processing can be carried out in the automatic processing apparatus (operation mode). For example, the water supply corresponding to the amount of evaporation while processing is stopped, may be controlled in the same way as that conducted during ordinary processing of light-sensitive material, or the water supply may be carried out at the start of processing according to the result of calculation of the presumed amount of evaporation during the processing stoppage.

Figure 19:
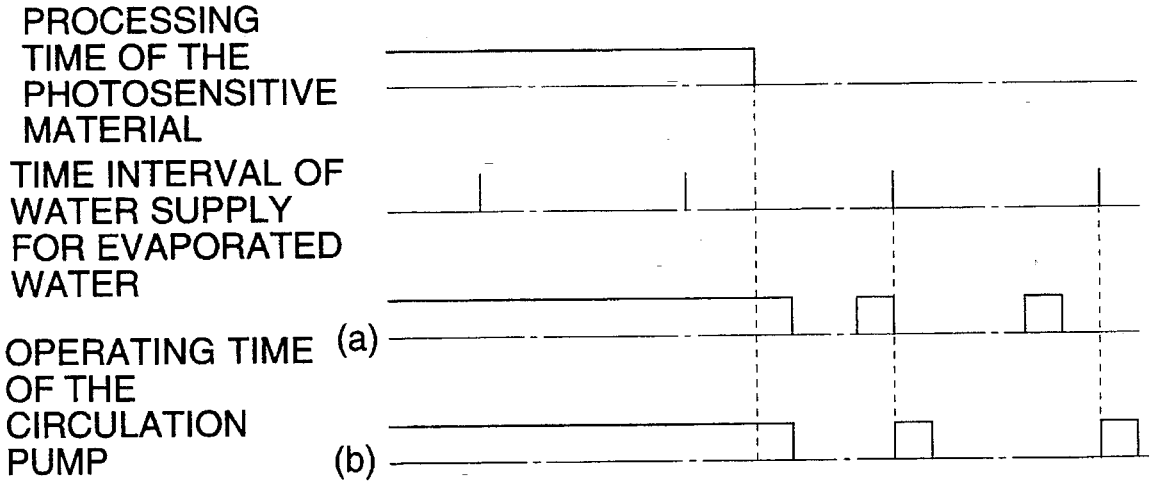
FIG. 19 is a time chart showing the conditions of the operation control of the circulation pump.

In this connection, it is preferable that the circulation pump 62 is controlled so that it is operated intermittently during the stoppage of processing as shown in FIG. 19 (intermittently circulating means during the stoppage of processing) in order to maintain uniform concentration and temperature of the processing solution in the processing tanks. Especially, when the evaporation water supply is controlled in the same way as that conducted during ordinary processing of the light-sensitive material, it is preferable that the circulation pump is controlled so that it is intermittently operated in timed relationship with the water supply. When the apparatus is structured so that the circulation pump 62 is intermittently operated in timed relationship with the water supply, variations of concentration and temperature of the processing solution due to the water supply can be controlled more precisely.

In FIG. 19, operating time "a" of the circulation pump shows the following: the circulation pump 62 is continuously operated for a predetermined period of time even after processing of the light-sensitive material has been completed, and then the pump is stopped; and after that, the circulation pump 62 is intermittently operated at every predetermined interval which is independent of the water supply operation. In FIG. 19, operating time "b" of the circulation pump shows the following: the circulation pump 62 is continuously operated during a predetermined period of time even after processing of the light-sensitive material has been completed, and then the pump is stopped; and after that, the circulation pump 62 is operated for a predetermined period of time in timed relationship with the water supply operation.

Developing processing may be continuously carried out until the number of times, in which the water supply to be carried out according to a predetermined water supply interval, can not be carried out (or the total amount of water supply at the water supply timing at which the water supply could not be conducted), corresponds to the limiting number of times (limiting amount) which is determined for each of processing tanks 1 through 3, even when the water supply tank 11 is empty; and the developing processing may be inhibited or interrupted (by the processing inhibition means) when the above-described number of times corresponds to the limiting number of times (the limiting amount). That is, developing processing is continued while it is presumed that the ordinary processing property can be maintained even when the water supply can not be conducted, and the maintenance operation for supplying the water into the water supply tank 11 can be sufficiently carried out.

In the same manner, even when there are no more tablet type processing agents, and replenishment can not carried out at a predetermined interval, the developing processing may be continued until the accumulated number of the replenishment timing arrives at a predetermined number of times after the stoppage of replenishment. Here, it is preferable that the number of times, in which no replenishment is allowed, is also set for each of the processing tanks, and further, the allowable limiting number of times can be adjustably set depending on the kinds of processing agents.

Further, as described above, when developing processing is continued under the condition that water supply can not be carried out at the predetermined interval, the following may be carried out. When the first water supply/replenishment operation is carried out after water has been supplied into the water supply tank 11 or spare tablet type processing agents have been replenished (replacement of the cartridge), the amount of water to be supplied under normal conditions or the number of tablets to be replenished under normal conditions may be collectively supplied/replenished (an increased amount supplying means).

As described above, the first water supply operation/replenishment operation after there has been no tablet type processing agent or no water in the water supply tank 11, may be automatically carried out ordinarily at a predetermined interval. Alternatively, this operation may be carried out at the time when the operator detects the water supply to the water supply tank 11 or the replacement of the cartridge in which tablet type processing agents are accommodated, or the operator may command water supply/replenishment operation by the manual switch (refer to FIG. 6) at the time of the water supply operation or the cartridge replacement operation.

In the water supply operation by the operator, data for the amount of water to be supplied under normal conditions, is read out from the memory, and the water supply operation corresponding to the read out amount of water may be carried out according to the trigger signal outputted by the operator. Further, the amount of water supply corresponding to a plurality of times of normal water supply operations (for example, four times) may be supplied at one operation.

Figure 6:
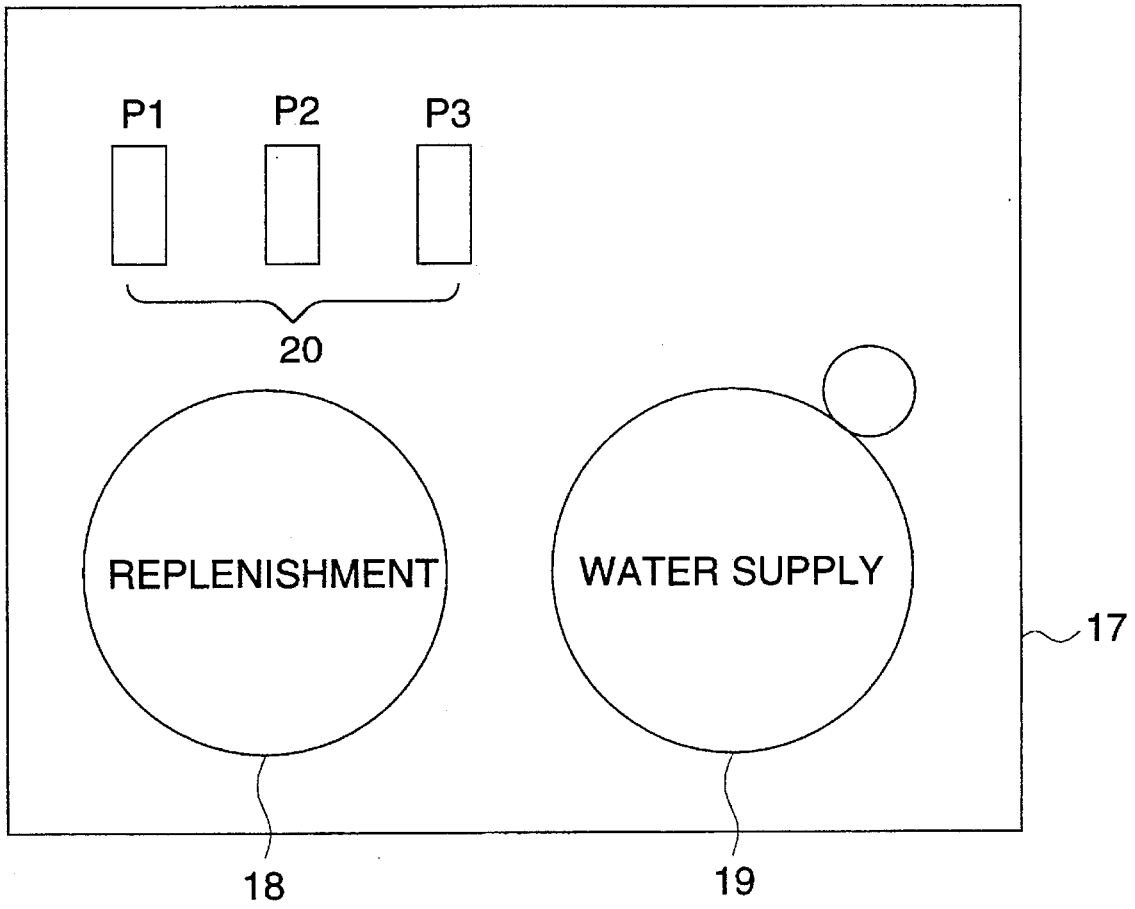
FIG. 6 is a view showing manual switches for processing agent replenishment and water supply.

FIG. 6 is a view showing an example of the manual switch 17 for the water supply/replenishment operated by the operator. The manual switch 17 is composed of: a replenishment switch 18 for directing the supply (replenishment) of the tablet type processing agents; a water supply switch 19 for directing the water supply operation; and an indicator lamp 20 for showing that the water supply/replenishment operation into the processing tanks 1 through 3 is being carried out.

Figure 20:
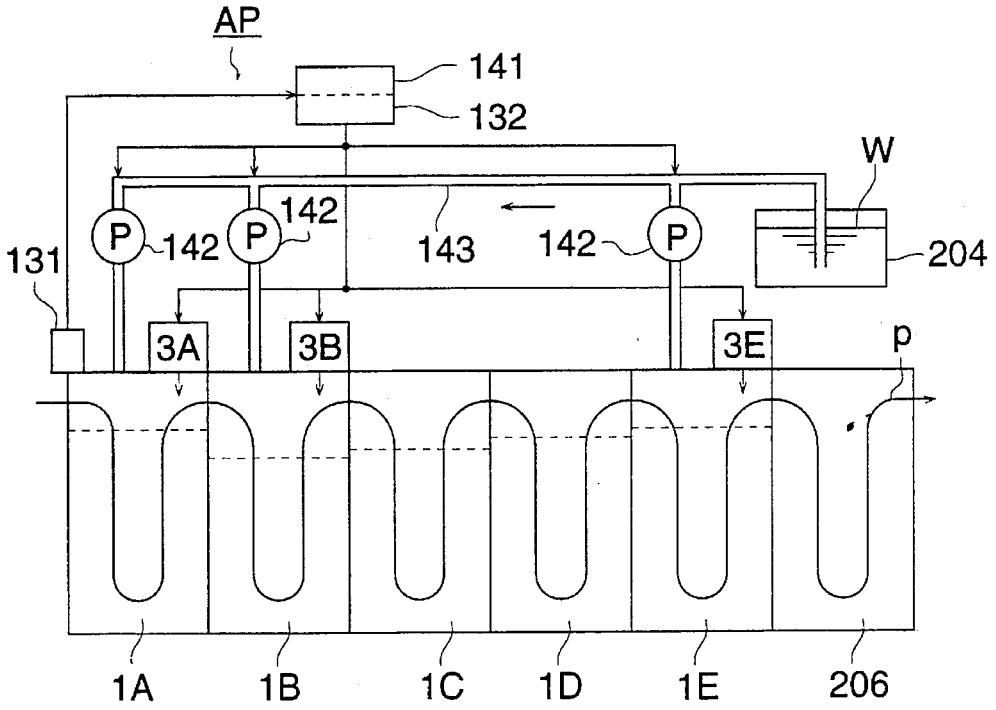
FIGS. 20(A), 20(B) and 20(C) are views showing the structure of an automatic processor according to the present invention.
Figure 20:
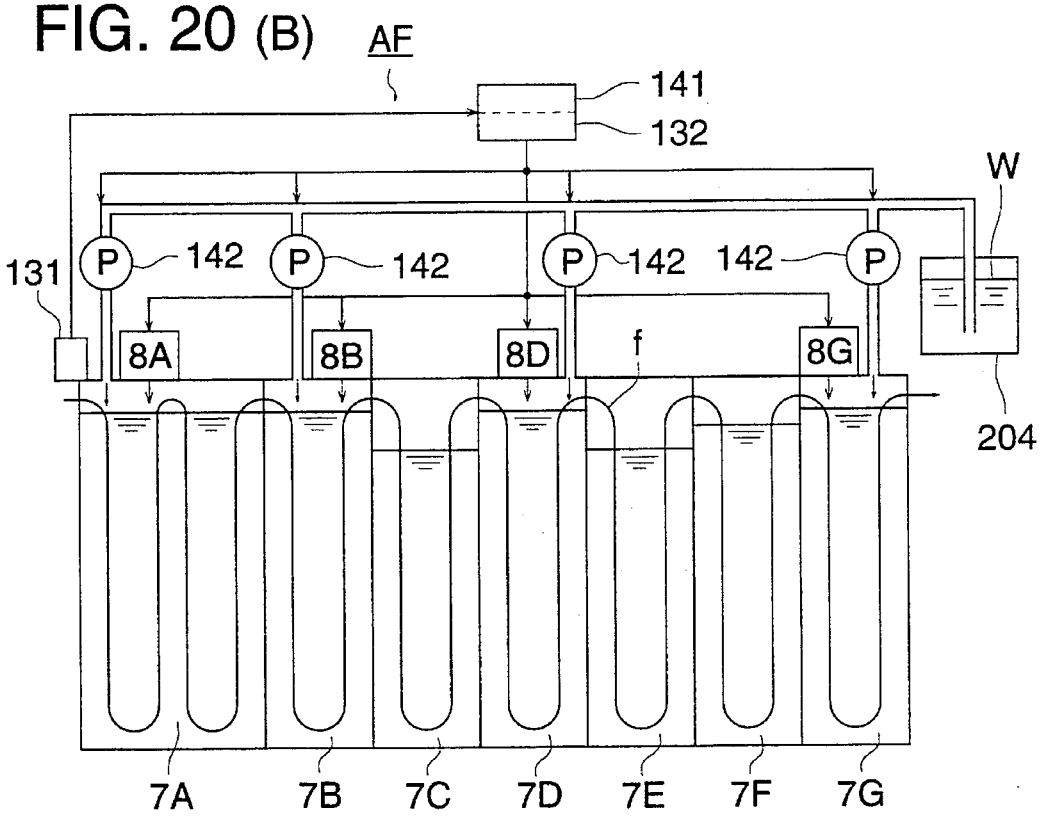
Figure 20:
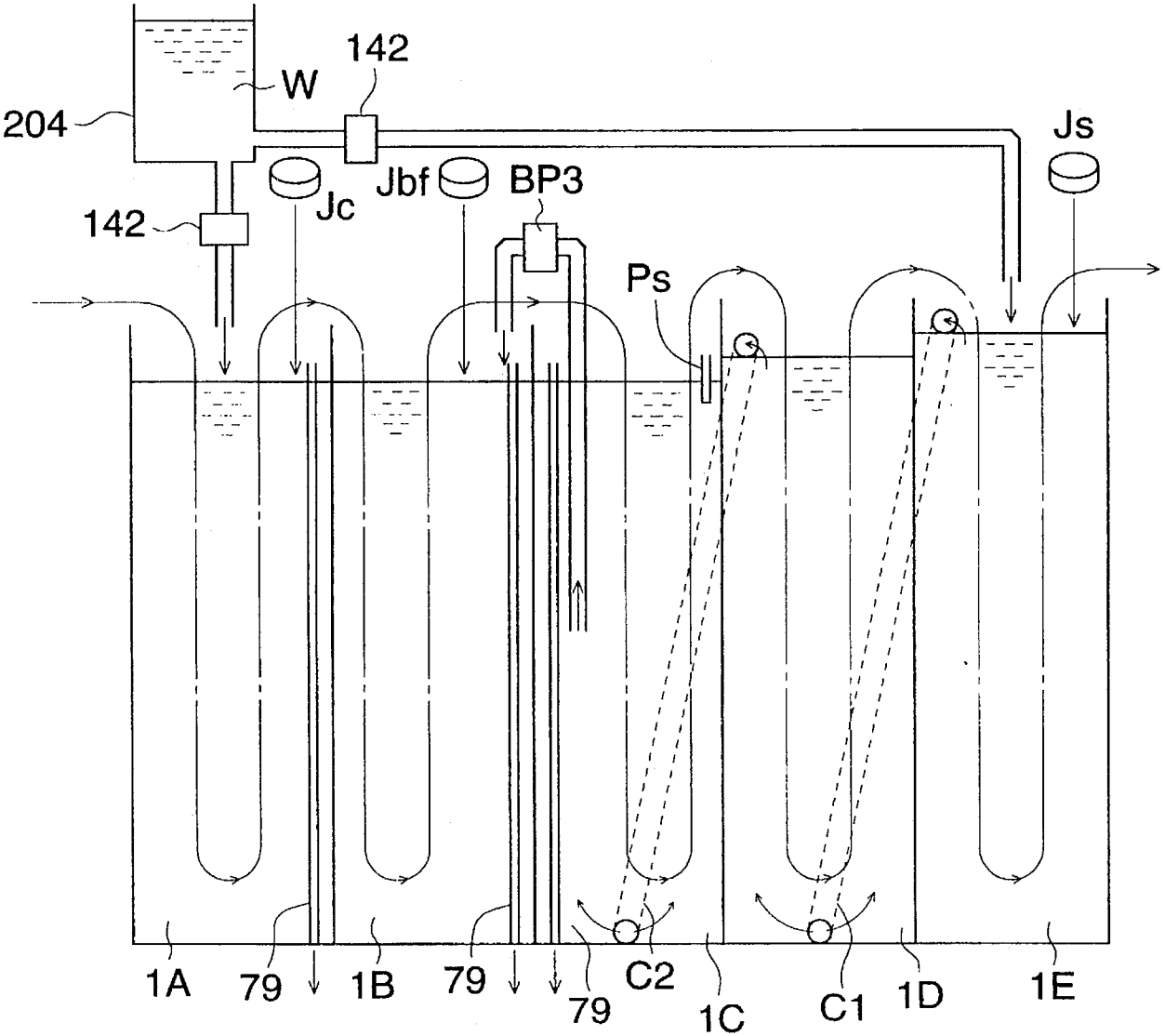

FIG. 20(A) is an arrangement view of the automatic processing apparatus AP for developing sheet-shaped photographic paper. In the automatic processing apparatus AP, the sheet-shaped photographic paper p is processed by the processing solutions in the color developing tank 1A, bleaching and fixing tank 1B, and stabilization tanks 1C, 1D, and 1E. After the processing has been completed, the sheet-shaped photographic paper p is dried. Solid processing agent supply apparatus 3A, 3B, and 3E for supplying respectively solid processing agents are provided on the color developing tank 1A, bleaching and fixing tank 1B, and stabilization tank 1E, and the supply of the solid processing agent is controlled by a solid processing agent supply control means 132, which will be described later. As illustrated in FIG. 20(A), the liquid levels of the stabilization tanks 1C, 1D and 1E are successively higher than the liquid level of the bleaching and fixing tank 1B. Consequently, the apparatus is structured into a counter-current system in which the solution which overflows from the tank 1E flows into the tanks 1D, 1C, 1B by the action of gravity. Replenishment water W in the replenishment water tank 204 is controlled by a replenishment water supply control means 141 through a bellows pump 142 and a feeding pipe 143 so that the replenishment water W is appropriately replenished into a dissolution tank, which will be described later.

FIG. 20(B) is an arrangement view of the automatic processing apparatus AF for developing negative photographic film. In the automatic processing apparatus AF, the negative photographic film "f" is processed by the solutions in the color developing tank 7A, bleaching tank 7B, fixing tanks 7C and 7D, and stabilization tanks 7E, 7F and 7G. After that, the negative photographic film "f" is dried. The solid processing agent supply apparatus 8A, 8B, 8D and 8G are respectively attached to the color developing tank 7A, bleaching tank 7B, fixing tank 7D and stabilization tank 7G. In this connection, the replenishment water tank 204 is constructed in the same manner as that shown in FIG. 20(A), so that the same reference numeral is attached to it.

FIG. 20(C) is a view showing another structure of the automatic processor AP for processing sheet-like printing papers, which is similar to FIG. 20(A).

In the automatic processor in this structure, the overflowing solution from the stabilizing tank 1E flows into the stabilizing tank 1D through a cascade pipe C1, and the overflowing solution from the stabilizing tank 1D flows into the stabilizing tank 1C through a cascade pipe C2.

Between the stabilizing tank 1C and the bleaching and fixing tank 1B, a suction pipe of a bellows pump BP3 is inserted into the processing solution in the stabilizing tank 1C as shown in the drawing. A delivery pipe of the bellows pump BP3 is provided above the bleaching and fixing tank 1B so that the processing solution in the stabilizing tank 1C can be delivered into the bleaching and fixing tank 1B. This system is structured such that the solution level of the stabilizing tank 1C is maintained to be substantially constant when the bellows pump BP3 is controlled and operated by a signal sent from a solution level detection sensor Ps.

In this case, in the same way as that shown in FIG. 20(A), this system is structured as follows. The tablet Jc for color development is dispensed into the color development tank 1A, the tablet Jbf for bleaching and fixing is dispensed into the bleaching and fixing tank 1B, and the tablet Js for stabilizing is dispensed into the stabilizing tank 1E, wherein each tablet is dispensed from the solid processing agent supplying apparatus, which is not shown in the drawing, by the solid processing agent supply control means, not shown in the drawing.

In this connection, overflowing pipes 79 are provided in the color development tank 1A, bleaching and fixing tank 1B and stabilizing tank 1C.

Figure 21:
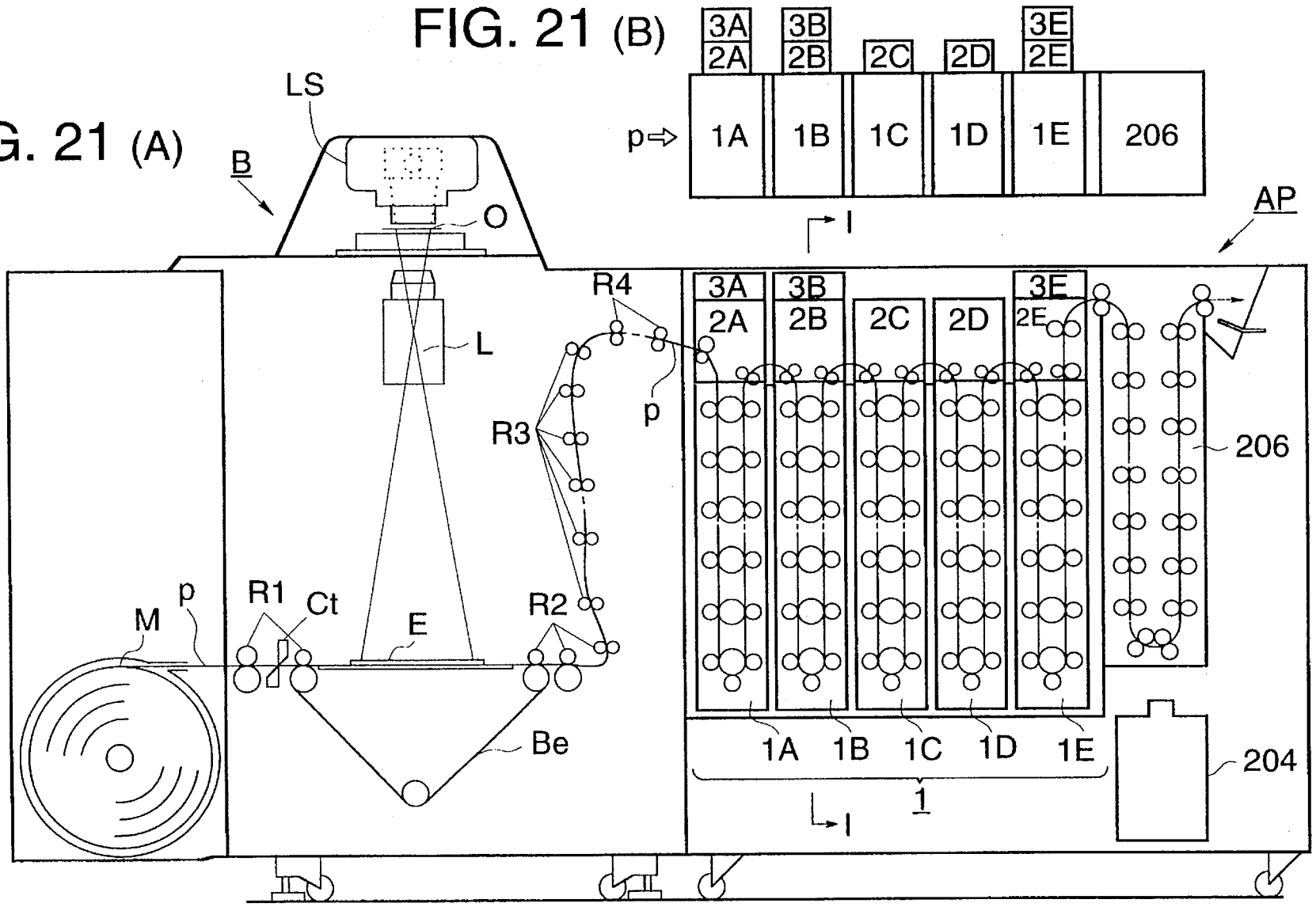
FIG. 21(A) is a view showing the entire structure of a silver halide photographic light-sensitive material processing apparatus (printer processor).
FIG. 21(B) is a plan view showing the structure of the automatic processor.

FIG. 21(A) is an overall arrangement view showing the construction of a silver halide photographic light-sensitive material processing apparatus (printer processor) in which the automatic processing apparatus AP and photographic printer B are integrated into one body.

In FIG. 21(A), in the lower left portion of the photographic printer B, there is provided a magazine M in which a roll of photographic paper (color paper), which is an unexposed silver halide photographic light-sensitive material, is accommodated. The photographic paper P is pulled out from the magazine M, conveyed by the feed rollers R1 and cut into a predetermined size by the cutter Ct. In this way, a sheet of photographic paper P can be obtained. This sheet of photographic paper P is conveyed by the belt conveyance means Be. Then an image of the original 0 is exposed onto the sheet of photographic paper P by a light source LS and a lens L in the exposure section E. The exposed sheet of photographic paper P is further conveyed by a plurality of pairs of feed rollers R2, R3 and R4, so that the sheet of photographic paper P is introduced into the automatic processing apparatus AP. In the automatic processing apparatus AP, the sheet of photographic paper P is successively conveyed by a roller conveyance means (a reference numeral is not attached to the means) into the color development tank 1A, bleaching and fixing tank 1B and stabilizing tanks 1C, 1D, 1E, wherein these tanks substantially compose a processing tank 1. Due to the foregoing, the sheet of exposed photographic paper P is subjected to color processing, bleaching and fixing processing and stabilizing processing. After the processing has been completed, the sheet of photographic paper P is dried by the drying section 206, and then discharged outside of the apparatus.

In this connection, the one-dotted chain line in the drawing shows a conveyance passage of the photographic paper P. In this example, the photographic paper P is cut into a sheet and introduced into the automatic processing apparatus AP. However, strip-shaped photographic paper may also be introduced into the automatic processing apparatus AP.

The automatic processing apparatus AP of the present invention may be constructed integrally with the photographic printer B, or alternatively, the automatic processing apparatus AP of the present invention may be constructed separately from the photographic printer B. The explanation of the present invention is made under the condition that the automatic processing apparatus AP includes the color development tank 1A, bleaching and fixing tank 1B and stabilizing tanks 1C, 1D, 1E, wherein these tanks substantially compose a processing tank 1. However, it should be noted that the present invention is not limited to the specific example. The present invention can be applied to an automatic processing apparatus having four tanks: a color developing tank, a bleaching tank, a fixing tank and a stabilizing tank. Further, the present invention can be applied to an automatic processing apparatus AP (shown in FIG. 20(B)) having more processing solution tanks than those described above.

FIG. 21(B) is an arrangement plan view of the automatic processing apparatus AP. In the color developing tank 1A, the bleaching and fixing tank 1B and the stabilizing tank 1E, there are provided dissolution tanks 2A, 2B, 2E, circulation tanks 2C, 2D and solid processing agent replenishment apparatus 3A, 3B, 3E for supplying the solid processing agent. Reference numeral 204 is a replenishment water tank for supplying replenishment water to the color developing tank 1A and the stabilizing tank 1E. In the present invention, any arbitrary solution which does not greatly affect the photographic performance, such as tap water, a solution including fungicide such as isothizoline, a solution including a small amount of ammonium or inorganic salt or distilled water, may be used as the replenishment water.

Figure 22:
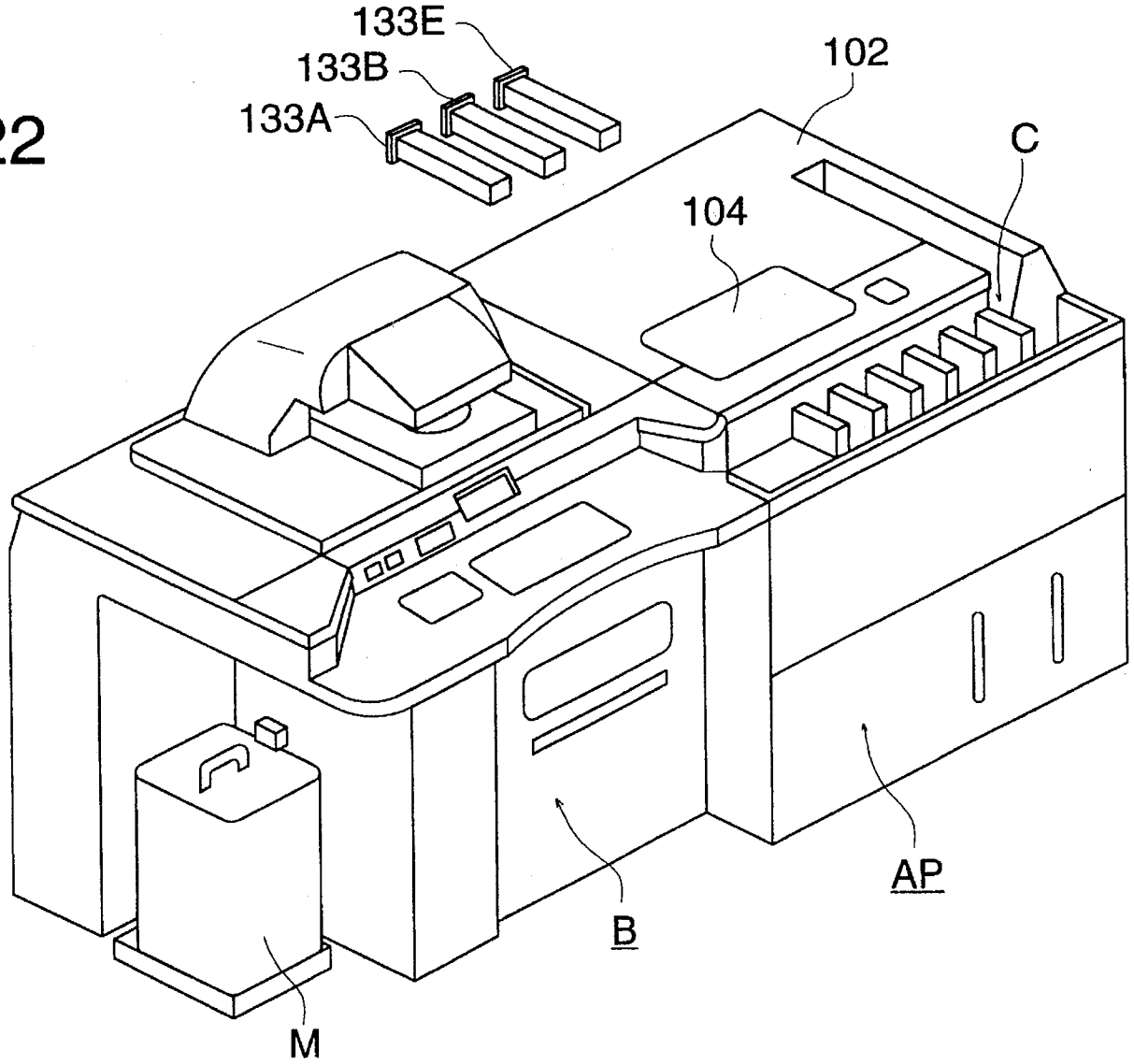
FIG. 22 is a perspective view of the above-described apparatus.

FIG. 22 is a perspective view showing the entire structure of the silver halide photographic light-sensitive material processing apparatus into which the automatic processing apparatus AP according to the present invention, a photographic printer (printer) and a sorter are integrated. In the drawing, a cover 104 of the upper portion of the automatic processing apparatus AP is opened and accommodation containers 133A, 133B and 133E, which will be described later, in which the solid processing agents are accommodated, are respectively attached to solid processing agent replenishment apparatus 3A, 3B and 3E provided in the automatic processing apparatus AP.

Figure 23:
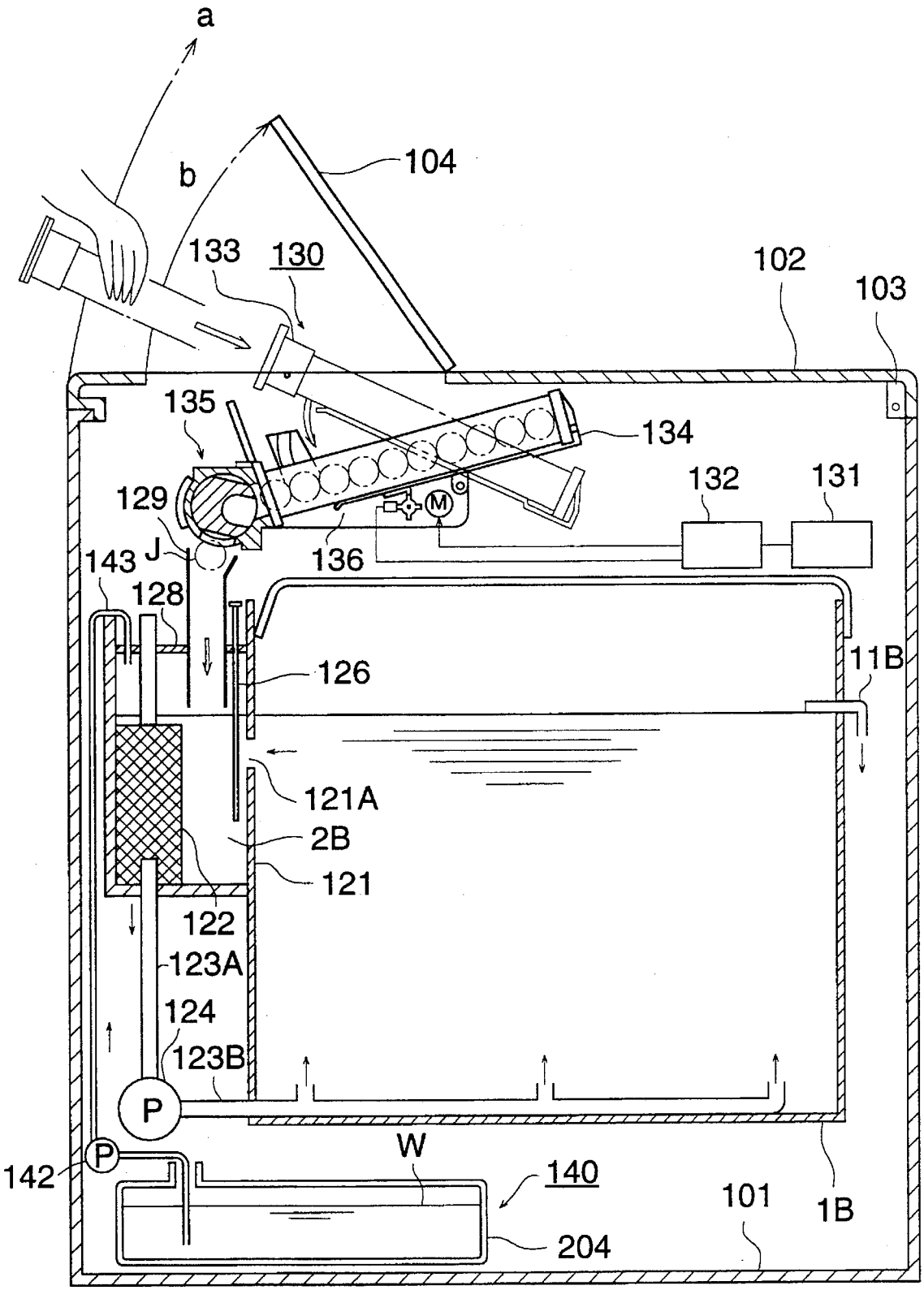
FIG. 23 is a sectional view of the automatic processor according to the present invention.

FIG. 23 is a sectional view of the bleaching and fixing tank 1B, which is the processing solution tank, taken on line I—I in FIG. 2(A) which shows the automatic processing apparatus AP, a dissolution tank 2B which is communicated with the bleaching and fixing tank 1B, and a processing agent supply means 130. In this connection, to enhance the understanding of the invention, the conveyance means for conveying the light-sensitive material is omitted in the drawing. In this example, explanations will be made under the condition that tablet type solid processing agent J is used as the solid processing agent.

The bleaching and fixing tank 1B for processing light-sensitive material is provided with a dissolution tank 2B integrally attached to the outside of the partition wall 121 which composes the bleaching and fixing tank 1B. The bleaching and fixing tank 1B and the dissolution tank 2B are separated from each other by the partition wall 121 in which a communication hole 121A is formed. Therefore, the processing solution (bleaching and fixing solution) is communicated through the communication hole 121A. Reference numeral 129 is a guide member (a guide path composition member) which receives the solid processing agent dispensed from the solid processing agent replenishment apparatus 130 and guides it above the dissolution tank 2B.

A cylindrical filter 122 is disposed in the dissolution tank 2B in such a manner that the cylindrical filter 122 can be replaced. The cylindrical filter 122 removes impurities from the processing solution, and prevents the solid processing agent J which is not yet dissolved, from entering into the circulation pump 124 and the bleaching and fixing tank 1B. The inside of the filter 122 is communicated with the suction side of a circulation pump 124 (circulation means) through a circulation pipe 123A, passing through the lower wall of the dissolution tank 2B.

The circulation system includes the circulation pipes 123A, 123B forming a circulation passage for the processing solution, and also includes the circulation pump 124. One end of the circulation pipe 123B is communicated with the delivery side of the circulation pump 124, and the other end penetrates an outer wall of the bleaching and fixing tank 1B, so that the circulation pipe 123B is communicated with the bleaching and fixing tank 1B. Due to the foregoing construction, when the circulation pump 124 is operated, the processing solution is sucked from the dissolution tank 2B and discharged into the bleaching and fixing tank 1B, so that the discharged processing solution is mixed with the processing solution in the bleaching and fixing tank 1B, and then sent to the dissolution tank 2B. In this way, the processing solution is circulated. The circulating direction of the processing solution is not limited to the direction shown in FIG. 23, but the direction may be reversed to that shown in FIG. 23.

A waste solution pipe 11B is provided for permitting the processing solution in the bleaching and fixing tank 1B to overflow, so a constant solution level can be maintained and an increase in the amount of components conveyed with the light-sensitive material from other tanks into the bleaching and fixing tank 1B can be prevented. Further, accumulation and increase of the amount of components oozing out from the light-sensitive material can be prevented.

A rod-shaped heater 126 penetrates an upper wall of the dissolution tank 2B, and is dipped in the processing solution in the dissolution tank 2B. The processing solution in the dissolution tank 2B and bleaching and fixing tank 1B is heated by this heater 126. In other words, the heater 125 is a temperature regulating means for regulating the temperature of the processing solution in the bleaching and fixing tank 1B, so that the temperature can be maintained in an appropriate range, for example, in a range from 20° to 55° C.

The replenishment water supply means 140 for supplying the replenishment water W to the dissolution tank 2B, is composed of the replenishment water tank 204, the bellows pump 142 and the feed water pipe 143, and appropriately replenishes the replenishment water by the replenishment water supply control means 141.

The solid processing agent supplying means 130 used for the light-sensitive material processing apparatus of the present invention includes: an accommodating container 133 for accommodating the tablet type solid processing agent J; an accommodating container loading means 134; a solid processing agent replenishment means 135; and a drive means 136. The upper cover 102 of the automatic processing apparatus AP is rotatably connected with the main body 101 accommodating the processing tanks 1A to 1E and the dissolution tanks 2A and 2B, through a support shaft 103 attached to the back of the main body. The upper cover 102 is lifted in the direction shown by a one-dotted chain line "a" in FIG. 23, so that the front and upper portions of the apparatus can be opened widely. In this way, inspection of the solid processing agent supplying means 130, and replacement of the filter 122 can be easily conducted.

A rotatable cover 104 is connected to a portion of the upper surface of the upper cover 102. When the cover 104 is opened as illustrated by a one-dotted chain line "b" in the drawing, and when the empty accommodating container 133, due to the advance of processing, is replaced with a new accommodating container 133 in which the tablet type solid processing agents J are loaded, the solid processing agent J is replenished.

Figure 24:
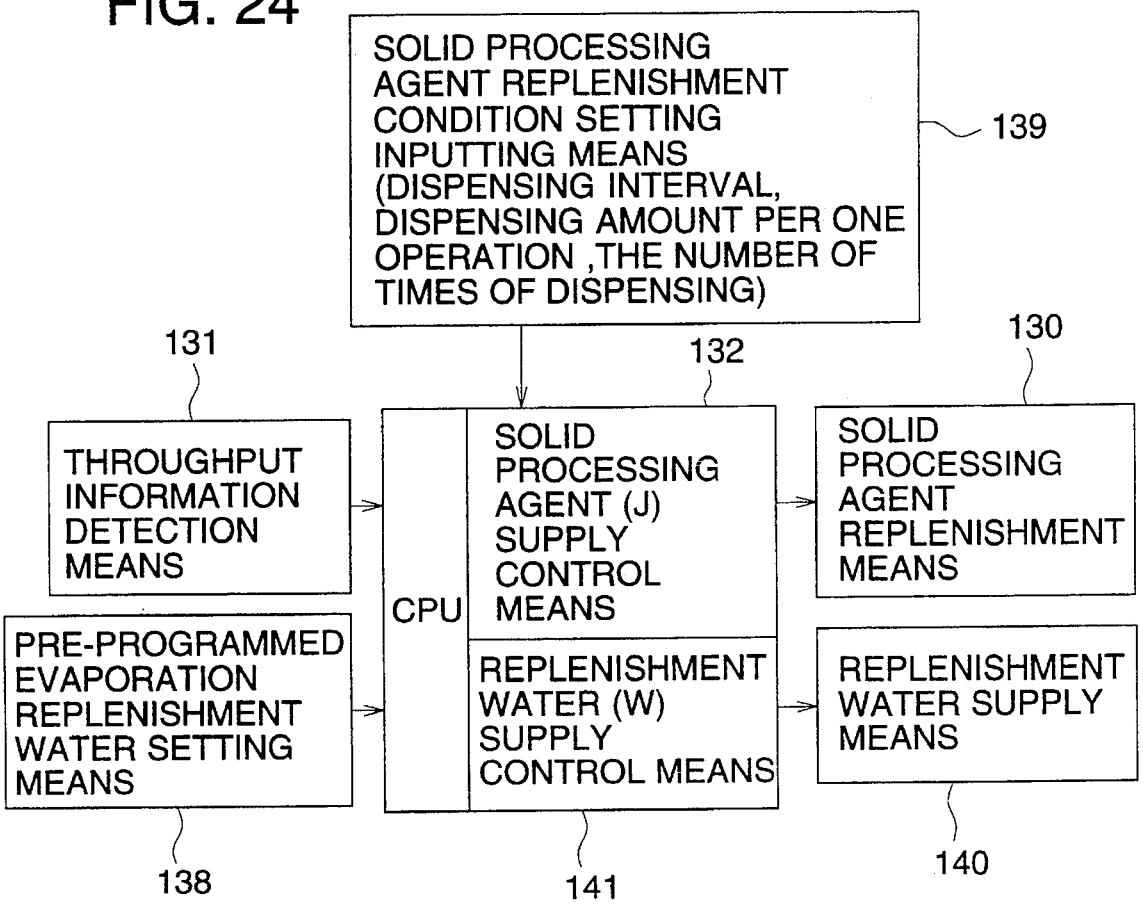
FIG. 24 is a block diagram for controlling the supply of solid processing agents and replenishment water.

FIG. 24 is a block diagram for showing the control of the supply of the tablet type solid processing agent J and the replenishment water W.

A throughput information detecting means 131 is disposed at the entrance of the automatic processing apparatus AP from which the light-sensitive material is conveyed (refer to FIGS. 20(A) and 20(B)), and detects the throughput of the light-sensitive material to be processed. This throughput information detecting means 131 comprises a plurality of detecting members which are disposed in a transverse direction. This throughput information detecting means 131 detects the width of the light-sensitive material, and also has the function to count the detection time. Since the conveyance speed of light-sensitive material is previously mechanically set, the throughput of light-sensitive material, that is, the area of the processed light-sensitive material can be calculated from the width and time information. An infrared ray sensor, micro-switch and ultrasonic sensor capable of detecting the width and conveyance time of the light-sensitive material can be used for this throughput information detecting means 131. A means for indirectly detecting the area of processed light-sensitive material may also be used for this throughput information detecting means 131. For example, in the case of the printer processor shown in FIG. 21(A), a means for detecting the amount of printed light-sensitive material may be adopted, or alternatively, a means for detecting the amount of processed light-sensitive material, the area of which is predetermined, may also be adopted. Concerning the detecting time, in this example, detection is carried out before processing, however, detection may also be carried out after processing or while the light-sensitive material is being dipped in the processing solution. In these cases, the throughput information detecting means 131 may be disposed at other appropriate positions so that detection can be conducted after processing or while the light-sensitive material is being processed. It is not necessary to provide the throughput information detecting means 131 for each of the processing tanks 1A, 1B, 1C, 1D, 1E, and it is preferable that one throughput information detecting means 131 is provided for each automatic processing apparatus AP. The solid processing agent supply control means 132 is a processing agent supply control means for controlling the supply of solid processing agent in accordance with a signal sent from the throughput information detecting means 131. Reference numeral 141 is a replenishment water supply control means for controlling the supply amount of replenishment water. Reference numeral 138 is a replenishment water amount setting means for setting the amount of the replenishment water, which is previously programmed, corresponding to the evaporated amount of the processing solution. Reference numeral 139 is a solid processing agent replenishment condition setting means.

Figure 25:
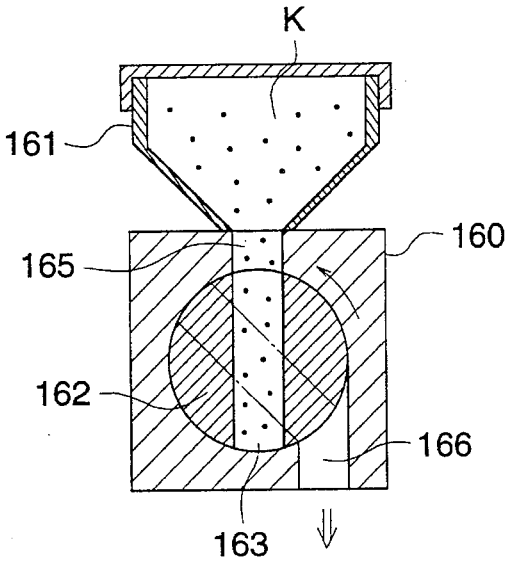
FIG. 25 is a sectional view of a supply apparatus of granular or powdery solid processing agents.

FIG. 25 shows another example of the solid processing agent supplying means according to the present invention. FIG. 25 shows a sectional view of the powdery processing agent supplying apparatus or the granular processing agent supplying apparatus. The supplying apparatus 160 is composed of a hopper 161 in which powdery or granular solid processing agent K is accommodated, a measuring hole 163 for measuring the amount of the solid processing agent K, and a rotary drum 162 for dispensing a predetermined amount of the solid processing agent K. This rotary drum 162 has a moisture proof function when the position of the measuring hole 163 is shifted from that of a dispensing portion. A predetermined amount of the granular solid processing agent K is measured by the measuring hole 163. The rotary drum 162 is rotated corresponding to a command from the light-sensitive material throughput detection means. When the rotary drum 162 is communicated with the dispensing portion 166, the rotary drum is stopped. A predetermined amount of granular solid processing agent K passes through the dispensing portion 166, and is supplied into the dissolving tank. After the completion of the supply, the drum 162 is rotated, and when the measuring hole 163 is communicated with a supplying portion 165, the drum 162 stops. Then, the measurement of the amount of the granular solid processing agent K starts. When processing advances and the amount of the granular solid processing agent K in the hopper 161 is decreased, new granular solid processing agent K is replenished into the hopper 161.

Figure 26:
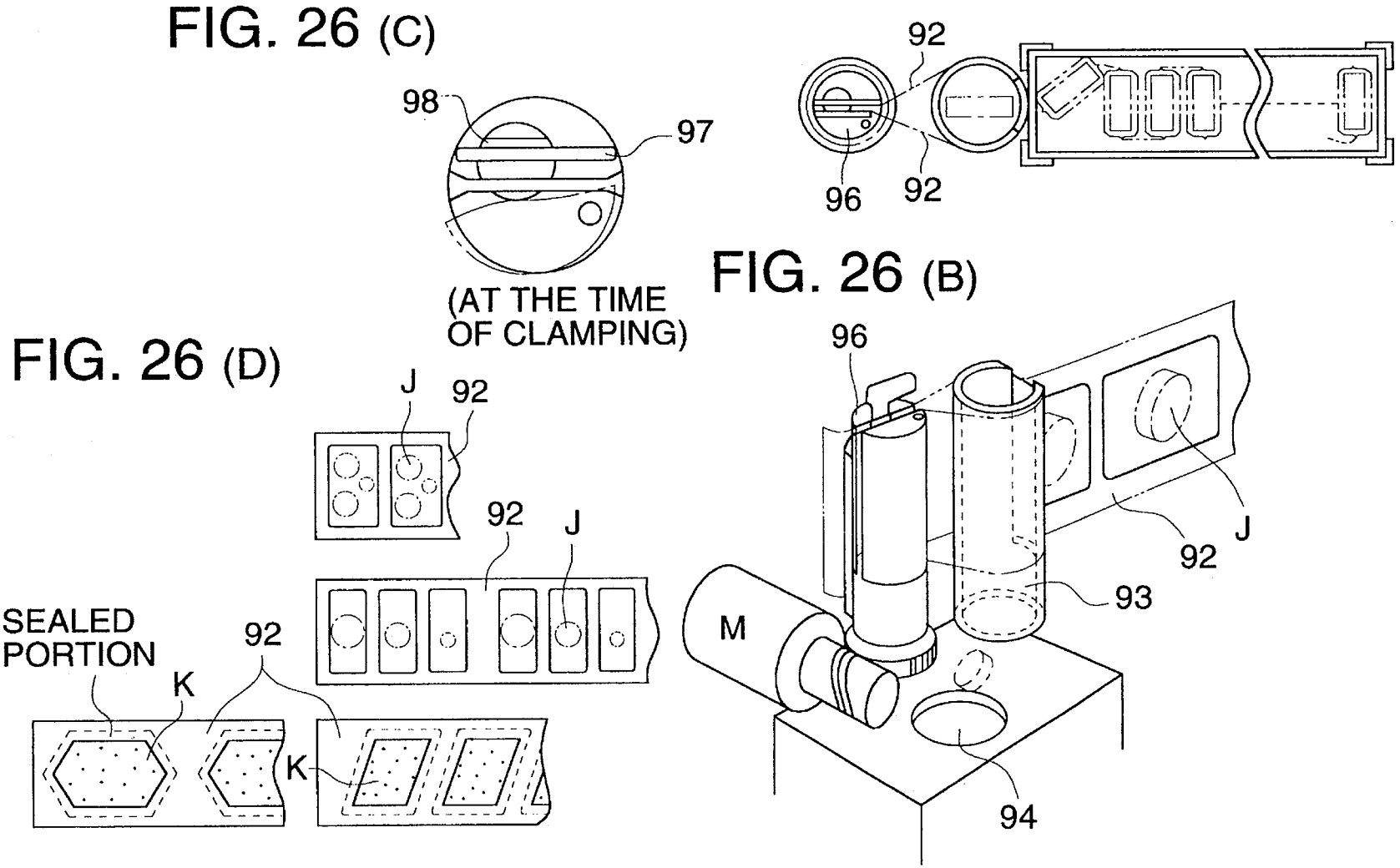
FIGS. 26(A) to 26(D) are perspective views and sectional views respectively showing a supply apparatus and a package body of solid processing agents.

FIG. 26 shows an example of the solid processing agent supplying apparatus of another preferred embodiment according to the present invention. FIG. 26(A) is a plan view, FIG. 26(B) is a perspective view, FIG. 26(C) is a plan view of the winding shaft, and FIG. 26(D) is a plan view of each package body.

The tablet solid processing agents J or granular solid processing agents K are packaged in a four-sided sealed package body 92 in the form as shown in FIG. 26(D).

As the material used for the package shown in FIG. 26(D), a generally used package made of high polymer, aluminum or complex material can be used. In this case, material having superior anti-humidity property and low oxygen transmissivity may be used.

A seal of the four sided sealed package 92 for the tablet solid processing agent J (or granular solid processing agent K) is peeled off through a cylinder 93, and the tablet solid processing agent J (or granular solid processing agent K) is dispensed into the processing tank through a dispensing opening 94. Here, the cylinder 93 and the winding shaft 96 act as a processing agent supply means. The package body 92 is structured such that it is wound by the shaft 96. In the winding operation, a knob 97 is set to its open condition, and the package body 92 is set onto the winding shaft 96, which is a fixing means of the processing agent accommodation package material, through a cylinder provided at the leading end portion of the package body 92. The package body 92 is fixed by a clamp 98 when the knob 97 is turned, and the package body is wound up. The tablet solid processing agent J (or granular solid processing agent K) drops from the dispensing opening 94, and is supplied into the dissolving tank. When processing advances and dispensing of the tablet solid processing agent J or the granular solid processing agent K which is packaged in a series of four-sided sealed package (hereinafter, called a serial package) is completed, a new four-sided sealed package, in which the tablet solid processing agent J or the granular solid processing agent K is accommodated, is set up for the supply of the processing agent.

Figure 27:
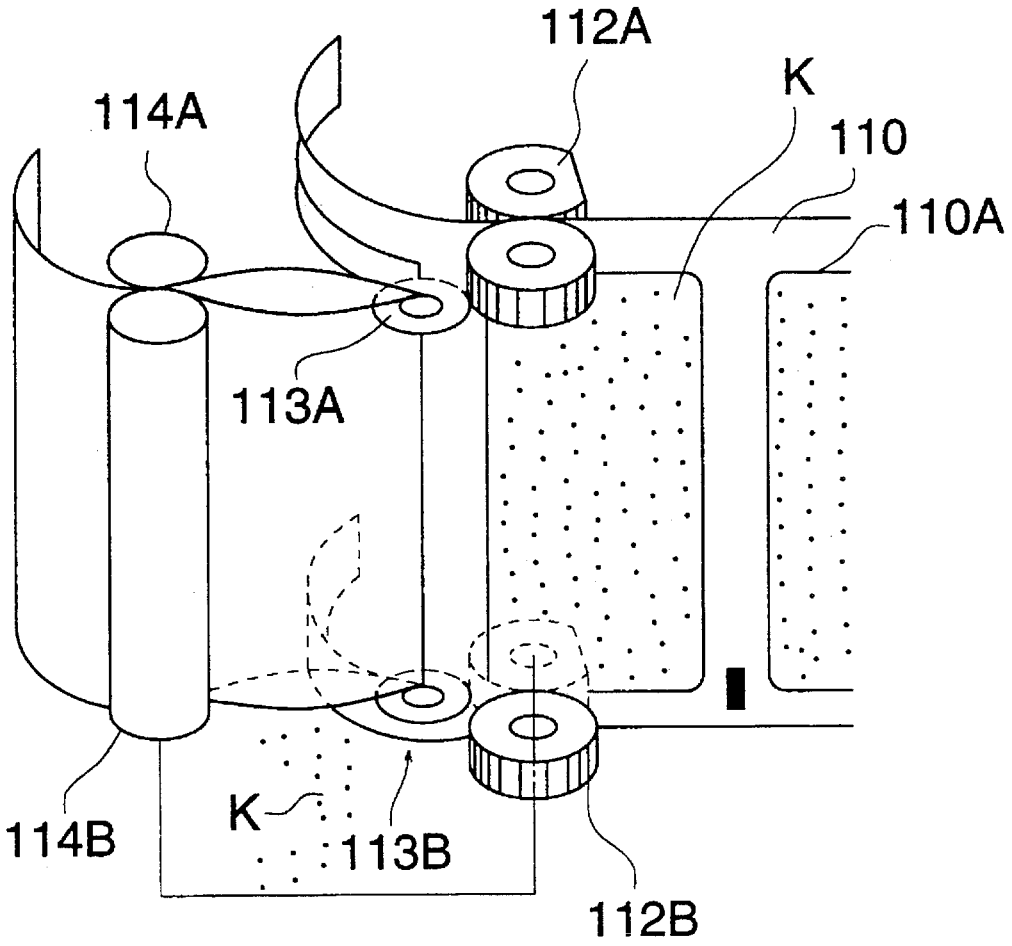
FIG. 27 is a perspective view showing an opening means of a 4-sided sealed package body in which solid processing agents are accommodated.

FIG. 27 is a perspective view showing an opening means for opening an individual package portion 110A of the four-sided sealed package body 110, wherein the granular or powdery solid processing agent K is accommodated in the individual package portion 11A. The package body 110 is conveyed by a pair of conveyance rollers (the first conveyance member) which are rotated while in pressure-contact with each other. The upper side and the lower side of the package body are cut by rotary cutters 113A and 113B which are vertically installed. Then, the accommodated granular or powdery processing agent K drops and is supplied into the dissolving tank. After cutting, the package body 110 is conveyed by the second conveyance rollers 114A and 114B, and is stored in a collection portion, not shown in the drawing. As processing advances, the solid processing agent is supplied in the same way as in the apparatus shown in FIG. 26.

In this connection, the solid processing agent described in the present invention is the processing agent in the shape of powder, granule, tablet or pellet, and the solid processing agent may also be processed to resist humidity as necessary. Powder, used in the present invention, means an aggregate of fine granule crystals. Granule, used in the present invention, means a granule into which the powder is granule-processed. Tablet or pellet means a processing agent in which powders or granules are compression molded into a predetermined shape. In the present invention, the tablet processing agent is preferable in the above-described solid processing agents. Since each tablet is previously measured, the supplying amount can be accurately controlled by the number of operations of the supplying apparatus.

Figure 28:
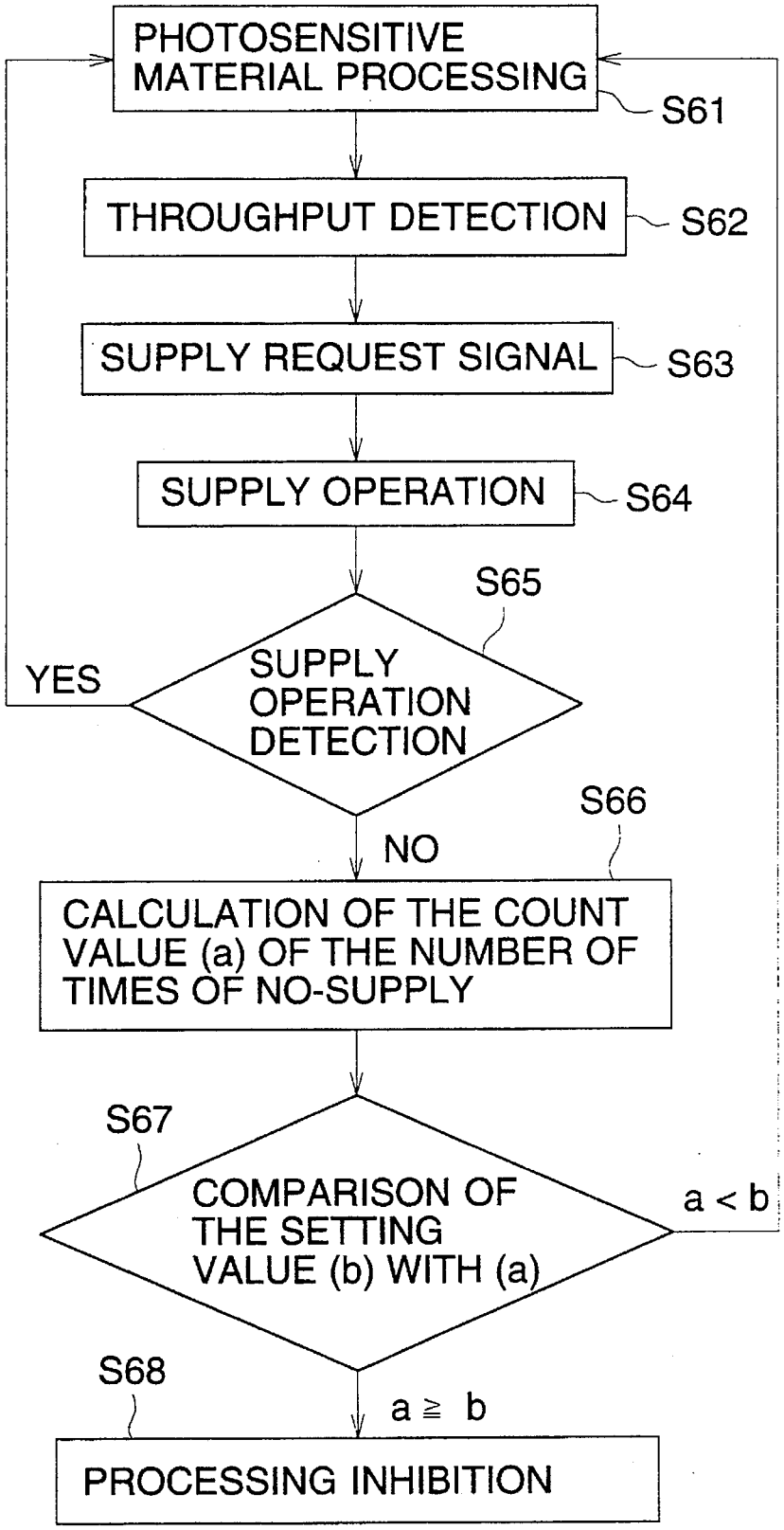
FIG. 28 is a flow chart showing an example of operations of the automatic processor.

Referring to the flow chart in FIG. 28, operations of an example of an automatic processing apparatus for silver halide photographic light-sensitive material according to the 5th embodiment will be explained below. In the drawing, S shows individual steps in the sequence.

As light-sensitive material processing (S61) advances in the processing tank 1, the throughput detection (S62) is carried out as necessary by the throughput information detecting means 131. When the throughput is equal to a predetermined value, the throughput detection means generates a supply request signal (S63), a supply operation (S64) is carried out by the solid processing agent supply means 130. When the supply operation is carried out, a supply detection means detects (S65) whether the solid processing agent was actually supplied, or not.

When the solid processing agent in the accommodating container 133 is empty, and when the supply detection means detects that no supply was carried out in (S65), the sequence advances to the next step as shown by an arrow mark indicating NO in the drawing. The counted value (a) of the number of times of no-supply is integrated by a counter (S66). The counted value (a) is compared with a setting value (b), which was previously set, by a comparator (S67). When (a)<(b), the sequence returns to (S61), and light-sensitive material processing is continuously carried out. Light-sensitive material processing (S61) is advanced without replacing the accommodating container 133 with the new fully loaded accommodating container 133 of the solid processing agents, and the light-sensitive material processing is carried out until the relationship between the counted value (a) and the set value (b) is (a)≧(b). In (S67), when (a)≧(b), the processing is inhibited (S68), that is, the automatic processor is under the condition in which further processing for light-sensitive material is not received. On the other hand, when the accommodating container 133 is replaced with a fresh container before the processing inhibition (S68), the supply operation is detected in (S65), and the sequence advances to the next step as shown by an arrow mark of YES in the drawing. Then, the sequence returns to (S61), and the light-sensitive material processing is carried out. When 'NO' supply is detected by the supply detection means in (S65), the operator is warned to replace the accommodating container 133.

As described above, when the automatic processing apparatus for silver halide photographic light-sensitive material is structured as in the 5th embodiment, the following advantages are obtained. Since stoppage of the supply operation, or the supply of the solid processing agent is actually confirmed by sensors or the like, the insufficient amount of supply can be directly calculated. Further, the apparatus can also be structured such that the replenishment amount is measured when the amount smaller than a predetermined value is replenished. Accordingly, the accuracy of the replenishment amount is greatly improved. Further, concerning the replenishment water, when the apparatus is structured as that of the 18th embodiment, the following advantages can be obtained. Since stoppage of the replenishment operation, or the supply or no-supply of the replenishment water can be positively confirmed by sensors or the like, the insufficient supply amount can be directly calculated. Further, the apparatus can also be structured such that the replenishment amount is measured when the amount smaller than a predetermined value is replenished. Accordingly, the accuracy of the replenishment amount is greatly improved.

Figure 29:
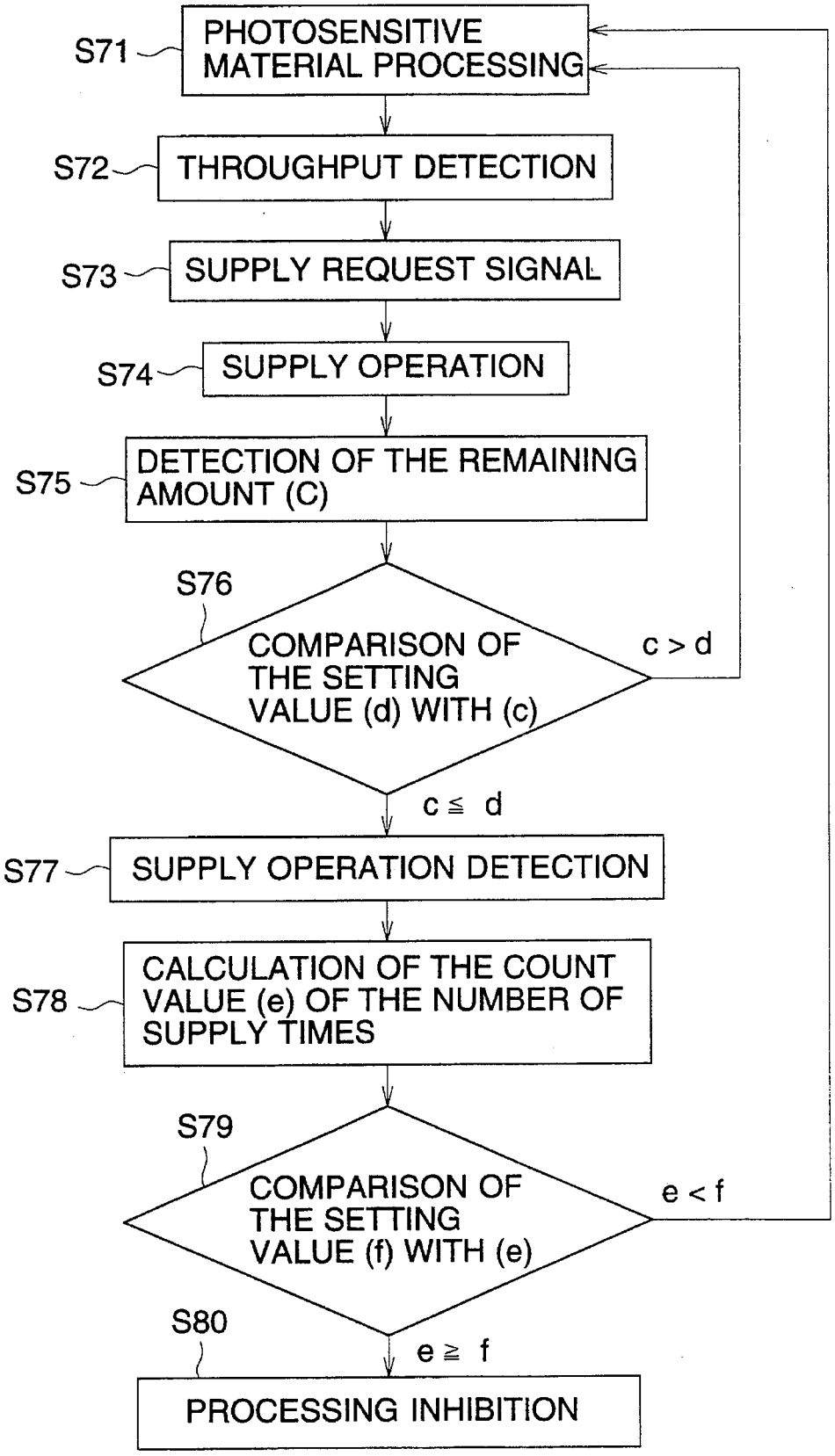
FIG. 29 is a flow chart showing another example of operations of the automatic processor.

Referring to the flow chart in FIG. 29, operations of an example of the automatic processing apparatus for silver halide photographic light-sensitive material according to the 6th embodiment will be explained.

As light-sensitive material processing (S71) advances in the processing tank 1, throughput detection (S72) is carried out when necessary. When the throughput value arrives at a predetermined amount, the throughput information detection means 131 generates a supply request signal (S73), and a supply operation (S74) by the solid processing agent supply means 130 is carried out. When the supply operation (S74) is carried out, a remaining amount (c) is detected (S75), and the remaining amount (c) is compared with a predetermined set value (d) by a comparator (S76). When the relationship between the set value (d) and the remaining amount (c) is c>d in (S76), the sequence returns to (S71), and light-sensitive material processing is carried out. When c≦d, supply operation detection (S77) is carried out. Addition of the number of supply operations detected in (S77) is carried out by a counter, and the count value (e) of the number of supply operations is obtained. A preset value (f) is compared with the count value (e) (S79), and when e<f, the sequence returns to (S71) and light-sensitive material processing is carried out. When the light-sensitive material processing (S71) is carried out without replacing the accommodating container 133, the light-sensitive material processing is carried out until the relationship between the count value (e) and the preset value (f) is e≧f. When e≧f in (S79), the sequence advances to processing inhibition (S80). On the other hand, when the accommodating container 133 is replaced until the sequence advances to the processing inhibition (S80), the remaining amount (c) is detected in (S75), and the sequence returns to (S71). Accordingly, the light-sensitive material processing is carried out without problems.

Since the set value (d) to remain in the accommodating container 133 is set and compared with the remaining amount (c) as described above, control, in which a specified amount of the solid processing agent or the replenishment water is caused to remain, is easily carried out. As a remaining amount detection means, an arbitrary means, for example, a means to measure weight, or to measure volume by a liquid level detection sensor, or the like, can be used.

When the relationship between the set value (d) in (S76) and the set value (f) in (S79) is $d<f$, the number of the supply operations carried out based on a predetermined control can be counted under a condition, in which the solid processing agent remains in the automatic processing apparatus for silver halide photographic light-sensitive material.

Further, when $c \leqq d$ in (S76), the supply operation is actually stopped, the number of the supply operations to be carried out essentially is counted, and the control in this example may be applied.

Further, concerning the replenishment water, when the apparatus is structured as that in the 19th embodiment, the control, in which a specified amount of the solid processing agent is caused to remain, can be easily carried out.

Figure 30:
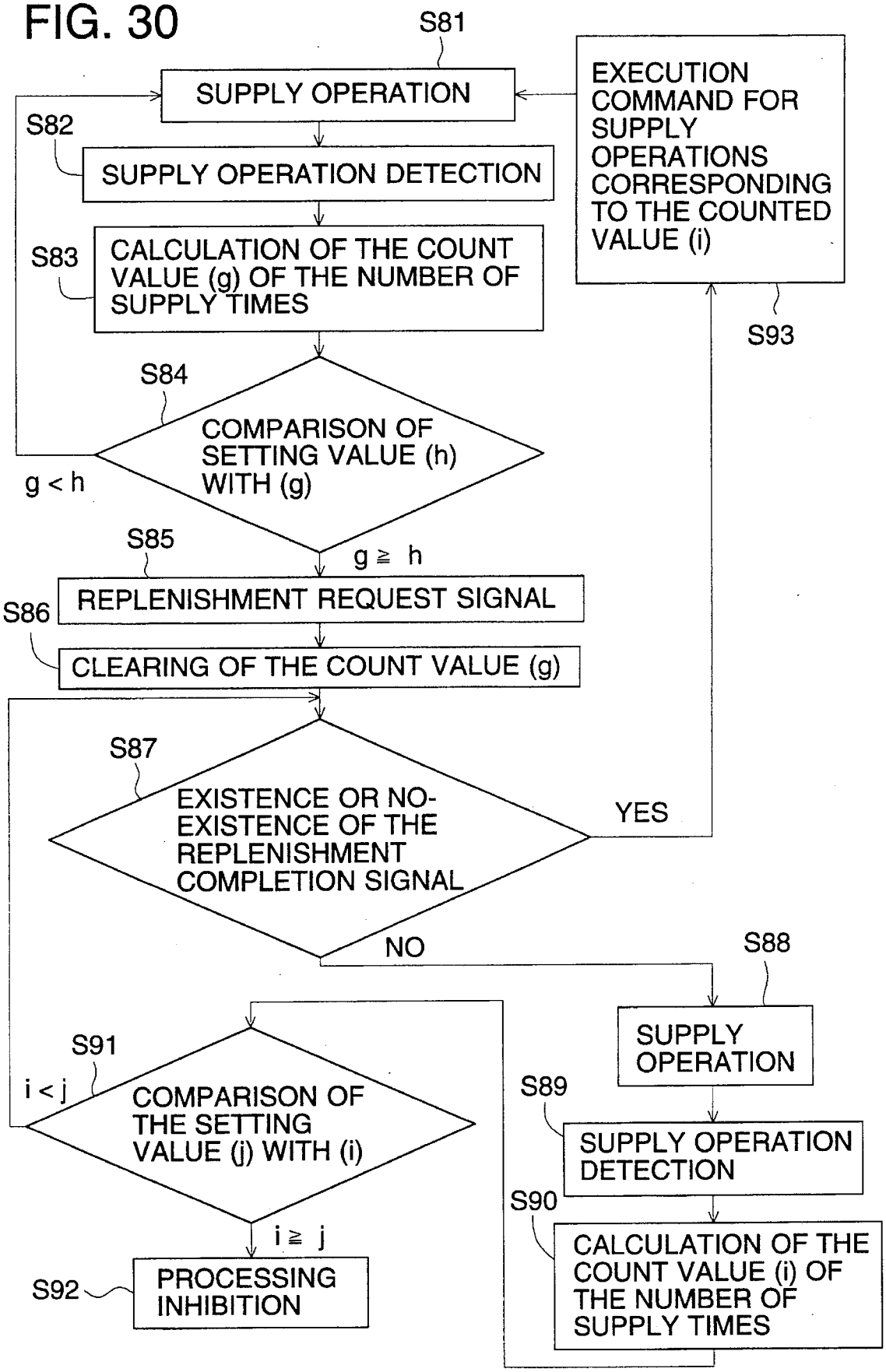
FIG. 30 is a flow chart showing still another example of operations of the automatic processor.

Next, referring to the flow chart in FIG. 30, an example of the automatic processing apparatus for the silver halide photographic light-sensitive material according to the 7th and the 8th embodiments will be explained below.

In this example, the throughput is detected accompanied with light-sensitive material processing, and further, when the supply request signal is generated, the supply operation (S81) is carried out. When the supply operation (S81) is carried out, the supply operation is detected by the sensor (S82). The number of supply operations detected in (S82) is counted by the counter, and the counted value (g) of the number of supply operations is integrated (S83). Next, the set value (h) is compared with the counted value (g) by the comparator (S84). When the relationship between the set value (h) and the counted value (g) is $g<h$, the sequence returns to (S81), and light-sensitive material processing is carried out. When $g \geqq h$, the supply request signal is generated (S85) and the counted value (g) by the counter is also cleared (S86). Next to (S86), existence or no existence of the supply completion signal is judged by the sensor for detecting the loading of the accommodating container 133 (S87). Here, in this example the apparatus is structured such that a preset and predetermined number of solid processing agents is replenished. When it is judged that no supply completion signal is generated in (S87), the supply operation (S88), supply operation detection (S89), calculation (S90) of the counted value (i) of the number of supply operations are carried out in the same manner as those in (S81) and (S83). The counted value (i) in (S90) is compared with the set value (j) by the comparator (S91). When $i<j$, the sequence returns to (S87) and the existence or no existence of the supply completion signal is judged in (S87), then the sequence advances to (S88). The supply operation is carried out without replacement of the accommodating container 133, and counting of the counted value (i) of the number of supplies further advances in (S91). In (S91), light-sensitive material processing is carried out until $i \geqq j$. When $i \geqq j$ in (S91), the processing is inhibited (S92). On the other hand, when $i<j$ in (S91), the sequence returns to (S87). When it is judged that the supply completion signal is generated, the accommodating container 133 is replaced, and the increased amount supply operation command of the amount corresponding to the counted value (i) is generated (S93). The sequence returns to (S81), and the supply operation is carried out. The increased amount supply operation in this case may be a collective supply operation, or a divided supply operation according to the 9th or the 21st embodiment. Here, collective supply means that the solid processing agent or the replenishment water corresponding to the insufficient supply amount is supplied at the generation of the supply request signal at one time. Divided supply means that the solid processing agent or the replenishment water according to the predetermined control is supplied in such a manner that its amount is increased more than that at the normal supply operation, and the insufficient supply amount is replenished with the increased amount supply at a plurality of times.

As described above, when the automatic processing apparatus is structured according to the 7th or the 20th embodiment, the apparatus can be structured in such a manner that only the operation amount of the supplying means is checked, and accordingly, the structure of the apparatus can be simplified. The checking operation was explained in the example as the checking operation of the number of supply operations. Further, when the apparatus is structured as described in the 8th or the 21st embodiment, the rapid return to the ideal concentration of the processing solution by the supply amount according to the predetermined amount can be realized. As a control means, the following means may be allowed. A manual supply switch by the operation of the operator may be provided other than a predetermined control, or when the replenishment is carried out by the method, for example, in which the accommodating container, in which the solid processing agents are loaded, is replaced when necessary, an automatic means which detects completion of the replacement may be accepted.

Further, when the apparatus is structured as described in the 9th or the 22nd embodiment, the divided supply method can be applied. The insufficient supply amount is compensated for when processing of the light-sensitive material advances and the solid processing agent is supplied according to the predetermined control by the solid processing agent supplying means 130. However, in this case, the supply amount of the solid processing agent is increased to compensate for the insufficient supply amount. In this structure, no switch is necessary, and a plurality of times, such as 2 or 4 times, of the supply amount can be supplied with respect to the predetermined control, and thereby, the structure of the automatic processor can be simplified.

Further, when the apparatus is structured as described in the 10th or the 23rd embodiment, it is not necessary that the increased amount supply is carried out for each completion of the replenishment operation, resulting in easier operation and easier control.

Further, when the apparatus is structured as described in the 11th embodiment, the amount equal to the insufficient supply amount is replenished in such a manner that the insufficient amount is compensated for, by the following method: a plurality of accommodating containers 133, in which a predetermined amount of the solid processing agent is accommodated, are integrated into a single package; for example, the package unit, in which the amount to process a specified amount of the light-sensitive material is packaged, corresponds to demands of consumers (mini-laboratories, or the like); and the sufficient supply amount is replenished with each package unit. When the package unit is used, the supply amount can return to the supply amount according to a predetermined control, that is, it can return to the ideal supply amount without fail. Further, the difference between order units of the processing agent is not generated, resulting in easier control.

TABLE 1

| | Color negative film processing | | | | Color paper processing | | |
|---|---|---|---|---|---|---|---|
| | Color developing | Bleaching | Fixing | Stabilizing | Color developing | Bleaching and fixing | Stabilizing |
| S/V | 2.0 | 25.0 | 27.0 | 1.8 | 1.7 | 5.5 | 4.0 |
| L/V | 0.03 | 0.05 | 0.08 | 0.08 | 0.014 | 0.025 | 0.075 |

Specifically, when the package unit is made in such a manner that a plurality of types of processing agents which can process a specified amount of light-sensitive material are integrated, there are prominent effects for the control.

This means that the spent package unit can be totally replaced with a new package unit, resulting in the minimum storage area.

Specifically, in the case where the following is set: the accommodating container 133A, in which the solid processing agent to be supplied to, for example, the color developing tank 1A, is accommodated, is replaced N times; the supply of the total amount in the accommodating container has been completed; and at the same time, the total amount in the accommodating containers 133B and 133E are supplied according to a predetermined control after the accommodating containers 133B and 133E are replaced a plurality of times, there is a case in which the solid processing agent remains in 133B or 133E because of the insufficient supply even when the supply of the total amount in the accommodating container 133A has been completed. Accordingly, the remaining amounts are controlled so that the total amount is supplied. The package unit can be controlled at the time when the supply of the total amount has been completed.

Further, the package unit includes 133A, 133B and 133E corresponding to the amount by which 100 $m^2$ of the sheet-like paper P can be processed, and the apparatus is set in such a manner that the (N+1)th replacement is required at the time when 100 $m^2$ of the paper P is processed. When the insufficient supply occurs when the N-th replacement of 133A, 133B and 133E is carried out, the total amount is supplied into the processing tanks. When the (N+1)th replacement is carried out and the supply of the processing agent in the package unit has been completed, the supply operation advances to a new package unit.

Further, when the apparatus is structured as that in the 10th or 20th embodiment, and when the processing agent supply amount is set for each type of the processing agent and/or each amount of the processing solution, the processing performance can be maintained, and further, since the insufficient supply amount can be set to the maximum, the time margin can be obtained at the maximum.

Further, the apparatus may be structured as that in the 12th or the 24th embodiment, an example of which will be explained below.

In this example, when the setting value (a limiting value) of the insufficient supply amount of the solid processing agent is defined as S (g), the setting value (a limiting value) of the insufficient supply amount of the replenishment water is defined as L (l), the amount of the processing solution in the processing tank is defined as V (l), and S/V (g/l) and L/V are respectively set to values as shown in Table 1, then, the replenishment operation can be carried out without influencing the photographic performance, and with a sufficient time margin.

The preferable S/V range shown in Table 1 is 0.5 to 10 for color developing processing, 0.5 to 50 for bleaching, fixing, and bleaching and fixing processing, and 0.5 to 10 for stabilizing processing. The preferable L/V range is 0.005 to 0.05 for color developing processing, 0.01 to 0.15 for bleaching, fixing, bleaching and fixing processing, and 0.05 to 0.5 for stabilizing processing.

In the present invention, when the insufficient supply amount occurs, it is preferable that a request signal for solid processing agent or replenishment water is generated to the operator. As a signal, an arbitrary means such as a sound, a message on a display screen, activation of a lamp, etc., can be accepted.

At this time, the supply operation after the request signal generation may be stopped or may be carried out. Further, when the insufficient supply amount occurs for either the solid processing agent or the replenishment water, another supply operation may be stopped so that its supply amount becomes insufficient. In this case, when both of these supply amounts are insufficient, fluctuations of the concentration of the processing solution are maintained almost constant, and when the fluctuation range is not so large, the light-sensitive material can still be processed. When the solid processing agent is controlled by the predetermined control and the supply amount of the replenishment water is insufficient, fluctuations of the concentration of components which are consumed by the light-sensitive material are maintained almost constant, and when the fluctuation range is not so large, the light-sensitive material can still be processed. When the replenishment water is controlled by the predetermined control, and the supply amount of the solid processing agent is insufficient, fluctuations of the concentration of the processing performance inhibiting components which are dissolved out from the light-sensitive material are maintained almost constant, and the fluctuation range is not so large, the processing can still be carried out.

When the apparatus is structured as that in the 13th embodiment, a tablet is previously chemically determined, and therefore, the supply amount can be accurately controlled by the number of times of the operation of the supplying apparatus.

Figure 7:
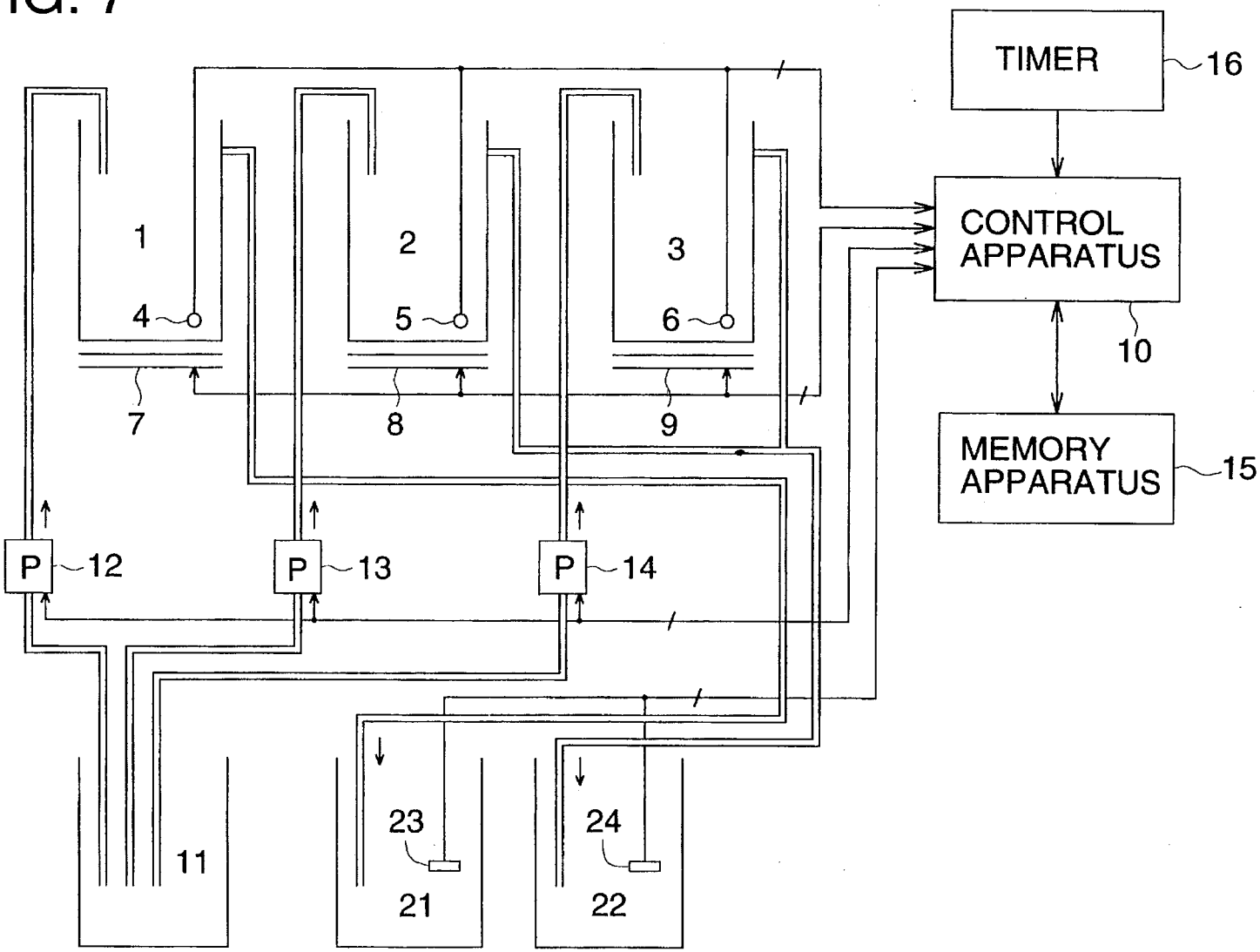
FIG. 7 is a view of the system structure showing the structure in which a waste water tank is provided.

In the automatic processing apparatus, as shown in FIG. 7, when the liquid level in the processing tanks is controlled in such a manner that the processing solution exceeding a predetermined liquid level in processing tanks 1 through 3 overflows and is discharged into waste water tanks 21 and 22, the evaporation amount can be assumed by correlation of the amount of waste water with the amount of water supply, and the evaporation water supply can be appropriately carried out according to the result of that assumption.

In FIG. 7, the same components as those in the above-described FIG. 4 are denoted by the same number and symbols, and the detailed explanation is therefore omitted.

In FIG. 7, the waste water of the processing tanks 2 and 3 in which fixing and washing processing is carried out, is discharged into a common waste water tank 22. The waste water of the processing tank 1 in which bleaching processing is carried out is discharged into an independent waste water tank 21. Liquid level sensors 23 and 24 for detecting a predetermined amount of waste water are respectively disposed in waste water tanks 21 and 22. When the liquid level sensors 23 and 24 detect a predetermined amount of waste water in the waste water tanks 21 and 22, the waste water is transferred into a relatively larger waste water tank, not shown in the drawings.

Here, the waste water, transferred into the above-described larger waste water tank, may be concentrated so that the distilled water can be produced. The distilled water is supplied into the water supply tank 11 and may be recycled in the apparatus.

Figure 8:
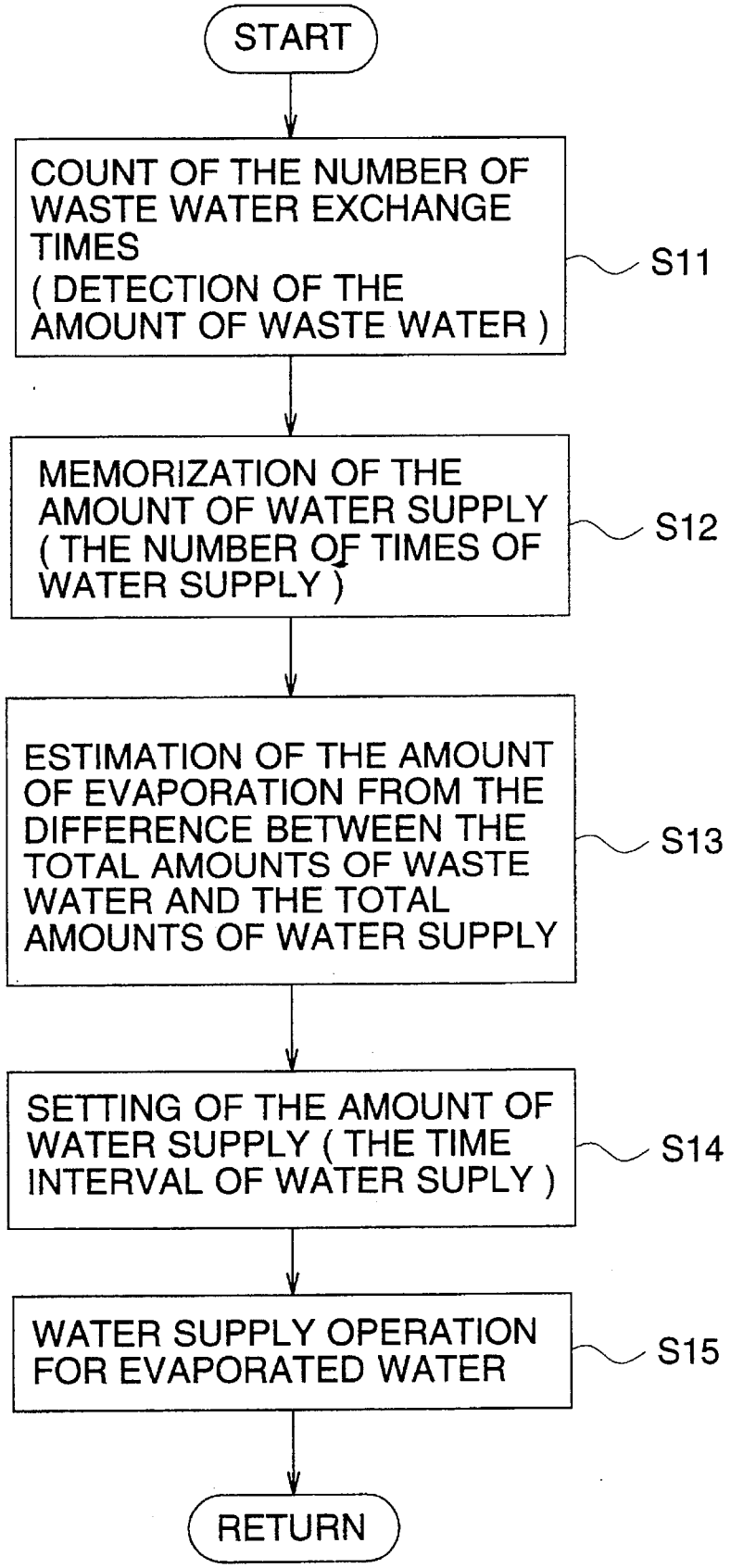
FIG. 8 is a flow chart showing the evaporation water supply control based on the amount of waste water.

Next, referring to the flow chart in FIG. 8, the evaporation water supply control based on the detection of the amount of waste water will be explained below.

Initially, in order to detect the amount of waste water in processing tanks 1 through 3, the number of times of a waste water replacement operation, which is carried out every time when a predetermined amount of waste water is stored in the waste water tanks 21 and 22 as described above, are counted (S11).

That is, the above-described replacement operation is carried out whenever a predetermined amount of waste water is stored in the waste water tanks 21 and 22. Accordingly, the amount obtained when the amount of waste water, corresponding to the liquid level detected by the liquid level sensors 23 and 24 is multiplied by the number of times of waste water replacement, is detected as the total amount of waste water. In this case, the amount of waste water may also be linearly detected by a flow sensor or the like.

While the amount of waste water is detected, the amount of water supply (history of the water supply operation) supplied by the water supply operation (including evaporation water supply and the water supply corresponding the supply of the processing agents) at a predetermined time interval from the water supply tank 11 is successively stored in the memory so that the total amount of water supply can be obtained (S12). When the total amount of water supply is found, only the number of times of water supply may be stored so that the total amount of water supply can be simply obtained assuming that a predetermined average amount of water supply is supplied by one water supply operation.

Here, when there is no evaporation, the amount of water almost corresponding to the supplied amount, is discharged from processing tanks 1 through 3 as the waste water. Actually, however, water evaporates from the processing tanks 1 through 3, and therefore, there is a difference, correlated with the amount of evaporation, between the total amount of water supply and that of waste water.

Accordingly, the amount of evaporation is assumed based on the difference between the total amount of water supply obtained from the history of the water supply operation and the total amount of waste water detected according to the number of times of replacement of the waste water (S13). Then, the amount of water supplied at one operation by the evaporation water supply operation at a predetermined interval is adjustably set based on the result of that assumption (S14). Here, the interval of the evaporation water supply may be changed, instead of the amount of water supply at one operation, or together with the amount of water supply at one operation.

When the amount of water supply or the interval of the evaporation water supply in the evaporation water supply operation at a predetermined interval is adjustably set, the water is supplied in the processing tank 11 according to characteristics after this change (S15).

Due to the above-described structure, since the amount of evaporation is assumed from the difference between the total amount of waste water and that of water supply, the amount of evaporation can be assumed without detecting environmental conditions, and the water supply operation corresponding to the evaporation can be carried out more easily.

In the example described above, parameters correlating with the amount of evaporation are the amount of waste water (the total amount of waste water) and the history of water supply operation (the total amount of water supply). An evaporation amount correlation parameter detecting means is realized by liquid level sensors 23 and 24, and the calculation and memory function in the control apparatus 10.

The above-described evaporation water supply control is not limited to the automatic processing apparatus in which solid processing agents are used, however, it may also be applied to apparatus in which replenishing solutions are replenished as processing components.

When no heater is provided in the water supply tank 11 as shown in FIG. 4 and FIG. 7, it is assumed that the temperature of supplied water is approximately the same as the ambient temperature. In contrast to this, processing tanks 1 through 3 are heated by heaters 7 through 9 which are controlled based on the result of the detection by the temperature sensors 4 through 6 (a processing solution temperature detecting means) by the control apparatus 10, as a processing solution temperature adjusting means, so that the temperature of the processing solutions are optimum in each process. Accordingly, when the ambient temperature is low, a large temperature difference results between the temperature of the supplied water and that of the processing solution. Therefore, in the evaporation water supply and the water supply corresponding to the processing agent replenishment, when water in the water supply tank 11 is supplied into processing tanks 1 through 3, there is a possibility that the temperature of the processing solution is lowered due to the above-described temperature difference.

Figure 9:
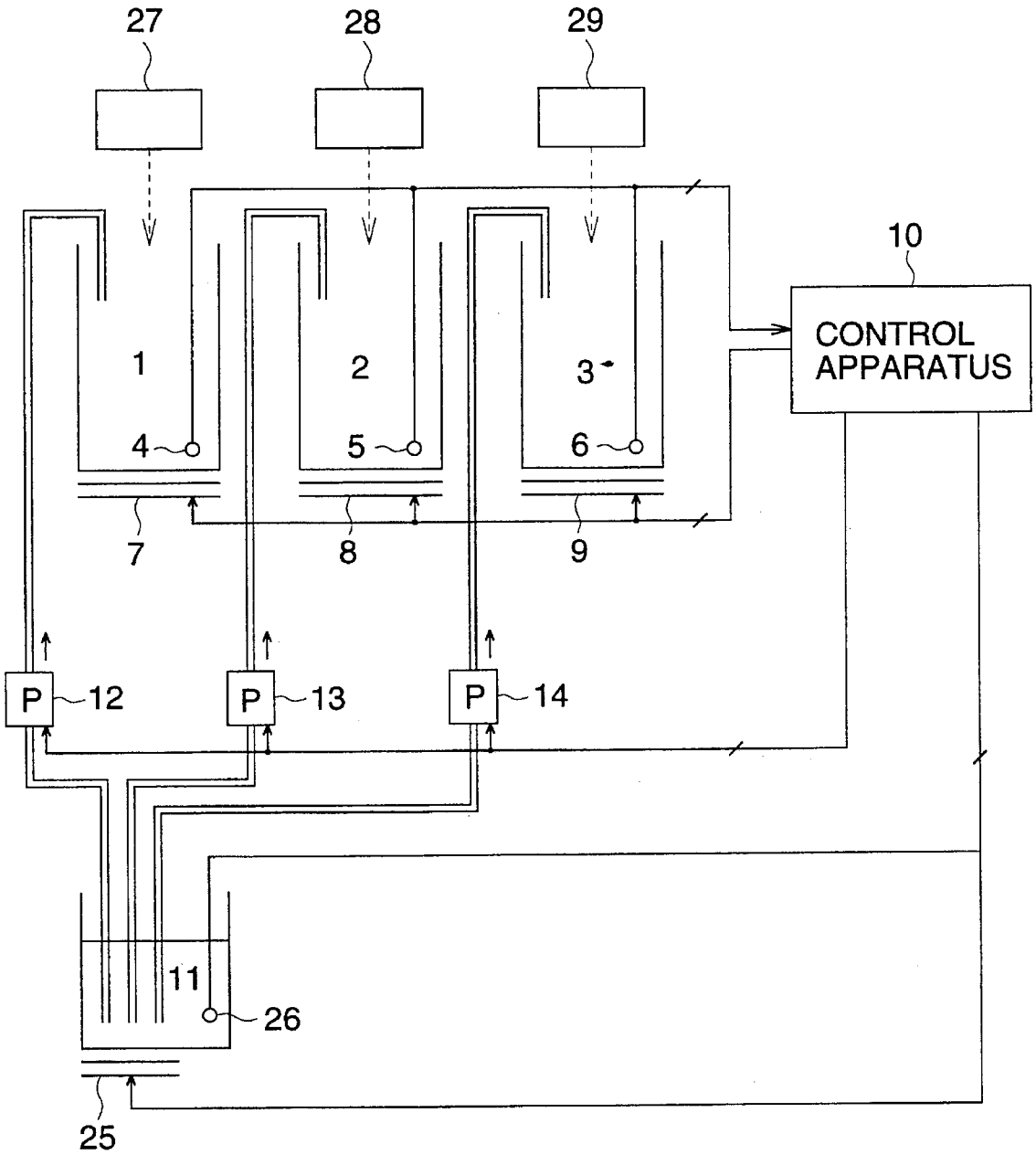
FIG. 9 is a view of the system structure showing the structure in which a heater is provided in a water supply tank.

Accordingly, as shown in FIG. 9, the water supply tank 11 is also provided with a heater 25 (a water supply tank heating means) and a temperature sensor 26 for detecting the temperature of the water supply (a water supply temperature detecting means). The power supply to the heater 25 may be controlled by the control apparatus 10, as a water supply heating adjusting means, based on the result of the detection by the temperature sensor 26 so that the water temperature in the water supply tank 11 is equal to a target temperature which is near the set temperature in the processing tanks 1 through 3 (or the result of the detection of the temperature of the processing solution).

When sensors for respectively detecting the temperature of the processing solution and that of water in the water supply tank 11 are provided, the temperature of the supplied water can be controlled, with the great accuracy, corresponding to the variation of the set temperature of the processing solution. Further, when the water supply temperature is set, the temperature of the processing solution can be positively changed.

Generally, the temperature in processing tanks 1 through 3 are adjusted so that the temperature in each tank is different from other tanks. However, each processing temperature is not so much different from other temperatures, and therefore an average processing temperature is determined as a target temperature for the supply water. Accordingly, the temperature of the water supplied from water supply tank 11 which is provided as a common tank, can be very close to that of the processing solutions in the processing tanks 1 through 3, so that lowering of the temperature of the processing solution due to the water supply operation can be avoided.

Specifically, when the automatic processing apparatus is provided with the tablet processing agent supplying apparatus 27 through 29 (solid processing agent replenishing means), the dissolution time of the supplied tablet type processing agent greatly depends on the temperature of the processing solution. When the temperature of the processing solution is lowered due to the water supply operation, the dissolving time is much longer, and the processing capacity is barely maintained. Accordingly, when the water supply tank 11 is heated as described above, and the difference between the temperature of the processing solution and that of the supplied water is kept negligible, the dissolving time of the tablet type processing agents can be stabilized in a short time, and a predetermined processing capacity can be stably maintained.

In the automatic processing apparatus which is structured so that the water in the water supply tank 11 is heated to a predetermined temperature, as shown in FIG. 9, the above-described evaporation water supply control may be preferably carried out. Further, when evaporation water supply is carried out from the water supply tank 11, processing components may also be replenished with the replenishment solution.

In this connection, because the lowering of the processing capacity due to the increase of the processing amount can be prevented, the replenishment interval of the tablet type processing agent and the water supply interval corresponding to the replenishment of the processing agents are preferably set corresponding to the accumulated value of the throughput (processed sheet area or the number of sheets) of the light-sensitive material. However, when throughput per unit time is low, the time interval of the replenishment is longer and there is a possibility that the processing solution has deteriorated with the passage of time.

Figure 10:
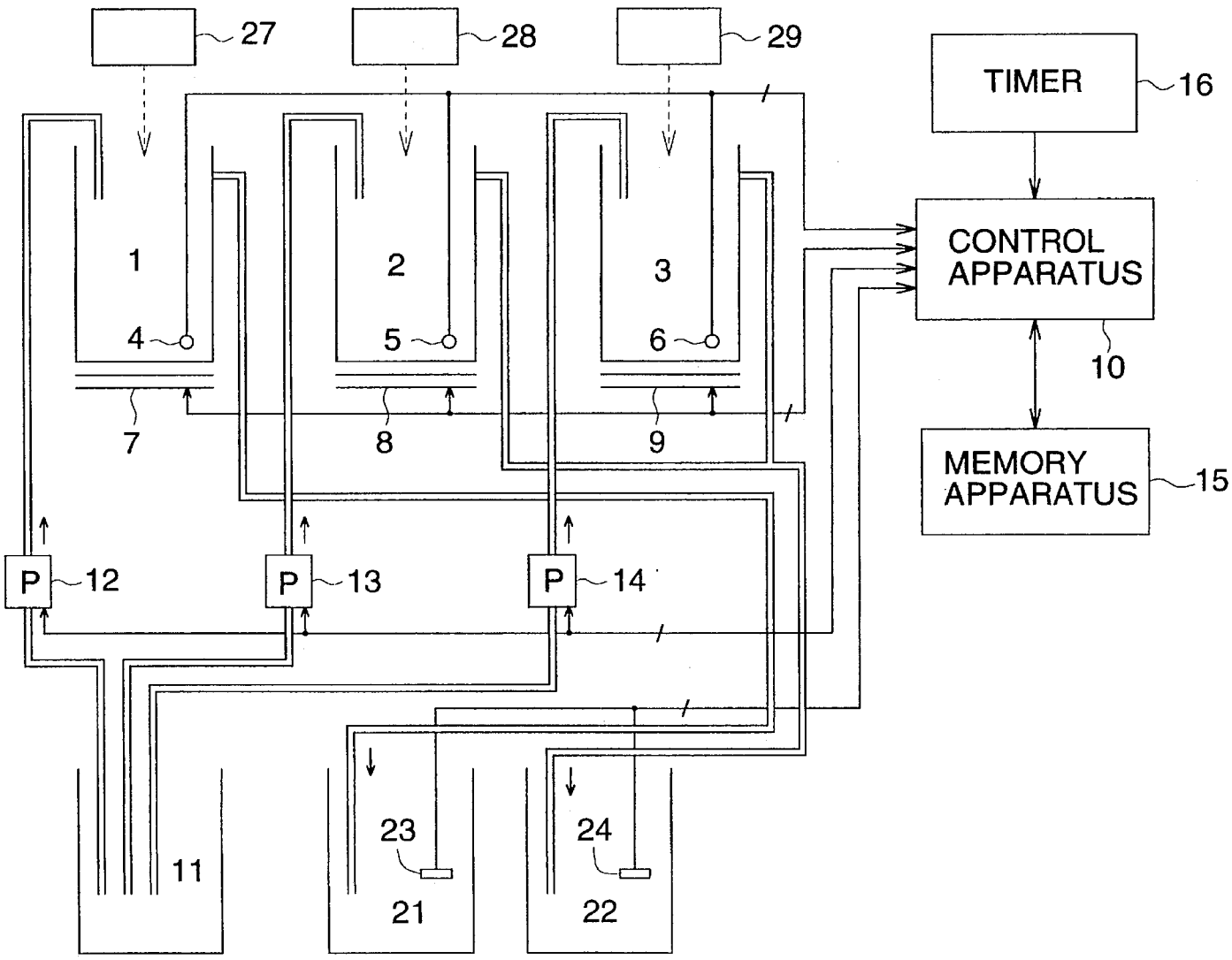
FIG. 10 is a view of the system structure showing the structure in which tablet supplying apparatus, a waste water processing system, and a water supply system are provided.
Figure 11:
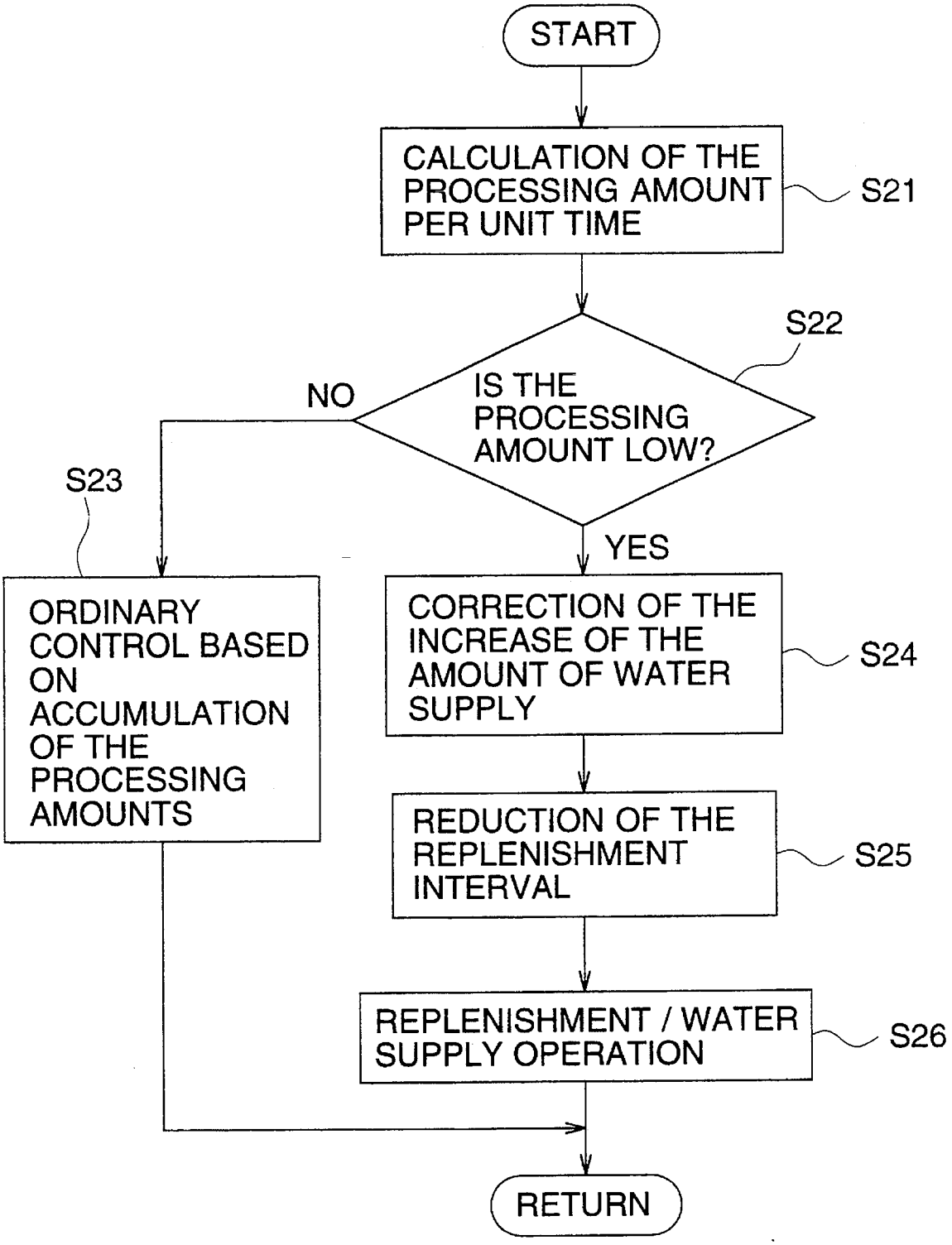
FIG. 11 is a flow chart showing a compensation control of the processing agent replenishment and water supply operation at the time of low throughput.

Accordingly, as shown in FIG. 10, in the automatic processing apparatus in which tablet processing agents supplying apparatus 27 through 29 (processing component replenishing means) for supplying the tablet type processing agents into processing tanks 1 through 3 at a predetermined interval are provided, and which is structured so that processing solutions overflowing from processing tank 1 through 3 are discharged into waste water tanks 21 and 22, characteristics of replenishment/water supply may be changed, as shown in the flow chart in FIG. 11, so that the deterioration of the processing solution can be avoided.

In this example, as shown in the flow chart in FIG. 11, the control apparatus 10 has functions as a throughput detecting means, replenishment interval reduction means, and water supply amount increase means.

In the flow chart shown in Pig. 11, initially, the processed sheet area or the number of processed sheets per unit time is calculated (S21), and next, it is discriminated whether the processing is carried out under a low processing condition in which the throughput per unit time is lower than a predetermined value (S22).

The processing condition, in which the throughput of the light-sensitive material is low, may be calculated as described above based on the detection of sheets, or the operator may input data showing the low processing condition.

Here, when it is discriminated that the throughput per unit time exceeds a predetermined amount, the replenishment operation of the tablet type processing agents and the water supply operation are carried out at the basic replenishment interval, or with a basic water supply amount, and at the basic water supply interval, which are ordinarily based on an accumulated value of the throughput (S23).

On the other hand, when the throughput is judged to be lower than a predetermined value, the amount of water supply at one operation in the water supply operation conducted at a predetermined interval, is increased, for example, by 10% (S24), and also the replenishment interval of the tablet type processing agent is reduced, for example, by 10% so that the replenishment is carried out more frequently (S25). The replenishment/water supply operation is carried out according to the characteristics corrected corresponding to such low processing conditions (S26).

The increase of the amount of water supply may be realized by the reduction of the water supply interval.

That is, when the throughput per unit time is low, the ordinary replenishment interval determined by the accumulated value of the throughput is reduced so that the replenishment is carried out more frequently. The amount of water supply is also increased corresponding to the replenishment and avoids that the chance of replenishment is greatly reduced when the throughput per unit time is low. Accordingly, even when the throughput per unit time is low, the fatigued condition of the processing agents in processing tanks 1 through 3 can positively be avoided, so that the processing capacity can be maintained.

In the above-described example, the solid processing agents are replenished as processing components. However, replenishment liquids may be replenished as processing components in the automatic processing apparatus. Also in this case, it is preferable that the basic replenishment interval is determined based on the accumulated value of the throughput. When the throughput per unit time is low, the replenishment interval is reduced so that further replenishment operations can be obtained.

In above-described examples, the common water supply tank 11 is connected to the processing tanks 1 through 3. However, when the waste water stored in the waste water tank is concentration-processed so that distilled water is produced, water is supplied from the water supply tank, in which the distilled water obtained when the waste water is recycled, is stored, to the fixing tank 2 and the washing tank 3. Another water supply tank in which city water is stored may be provided with respect to the bleaching tank 1, and the city water may also be supplied to the breaching tank.

Further, the capacity of the water supply tank is preferably set so that its capacity is at least the maximum water supply requirement per day.

Further, the following structures are preferable: a floating ball is provided on the surface of water in the water supply tank to prevent contact of water with air as much as possible; the water supply tank is structured so that its capacity is adjustable and water is airtightly sealed without allowing air to enter the tank; and further, silver-ions are produced in the water supply tank so as to prevent mold generation.

Further, the water supply tank is preferably structured detachably so as to be easily cleaned, and the water supply to the water supply tank may be carried out by a cartridge.

In this connection, when processing components are replenished by the supply of solid processing agents, the water supply is required for the replenishment of processing agents as described above. However, tablet type processing agents are not dissolved immediately when they are supplied into the processing solution, and gradually dissolved over 30 through 60 minutes although the dissolving time is changed depending on conditions of temperature and humidity.

Accordingly, when the water, the amount of which corresponds to that of the replenishment of the processing agents, is simultaneously supplied with the replenishment operation, the concentration is largely lowered once, and gradually recovers while the processing agents are being dissolved. Accordingly, the variation of concentration is larger. Therefore, in the example, which will be described below, the timing of water supply is controlled so as to sufficiently suppress the variation of concentration of the processing solution accompanied by the water supply and replenishment operation.

Figure 12:
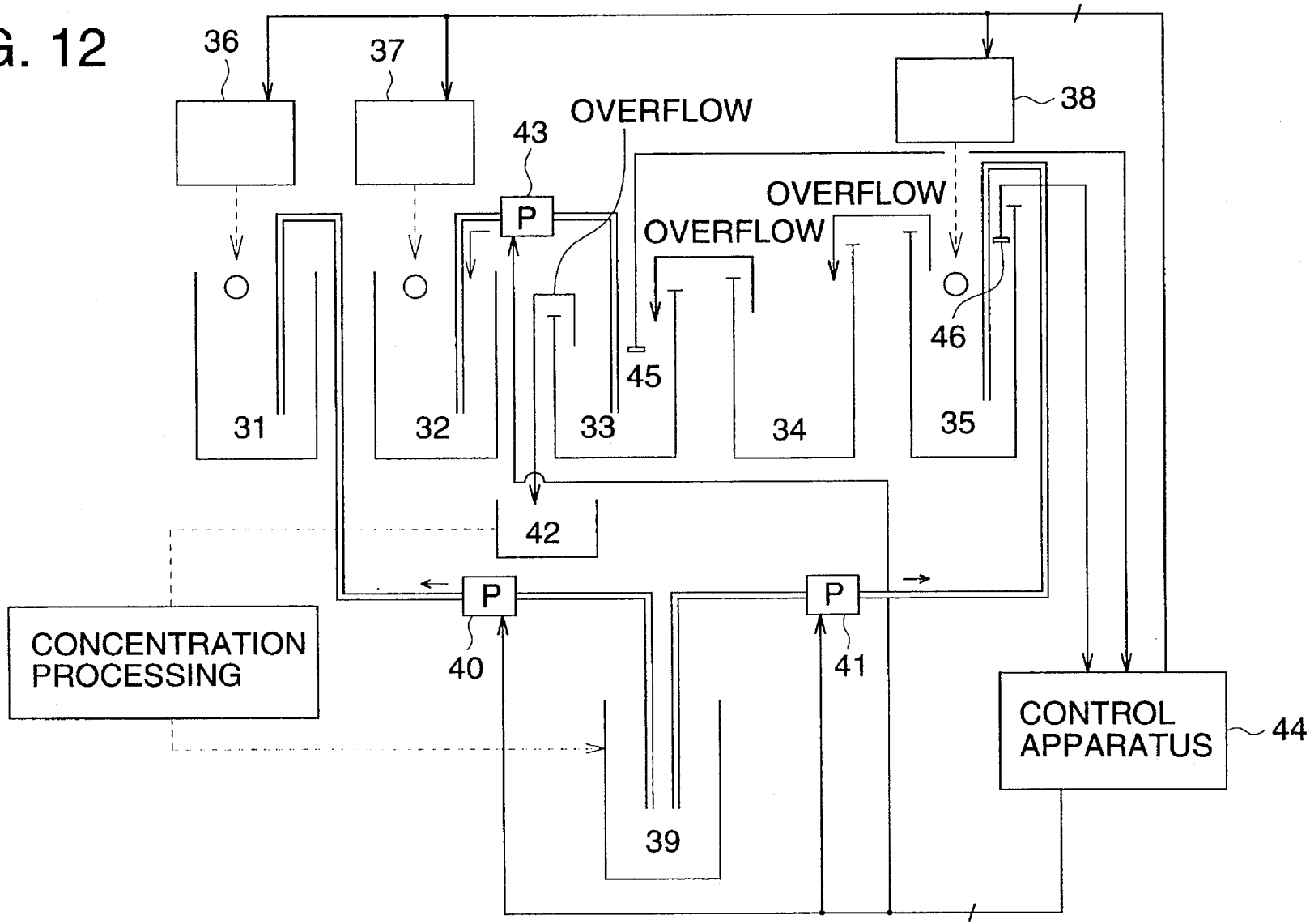
FIG. 12 is a view of the system structure of 3 washing tanks.

FIG. 12 is a view showing the structure of the system of the automatic processing apparatus in the example. The system is composed of a processing tank 31 for bleaching processing, a processing tank 32 for fixing processing, and 3 processing tanks 33, 34 and 35 for washing processing.

Tablet supplying apparatus (a processing agent replenishment means) 36, 37 and 38 for supplying solid processing agents which are formed into tablets, are respectively provided on the bleaching processing tank 31, fixing processing tank 32, and washing processing tank 35.

Further, a water supply tank 39 for supplying water to each processing tank is provided, and the water is supplied from the water supply tank 39 to processing tank 31 by a pump 40. Water is supplied from the water supply tank 39 to the washing processing tank 35 by a pump 41 (a washing solution supplying means).

Processing solution is supplied to the 3 washing tanks 33, 34 and 35 when the solution overflows from one washing tank to other washing tanks. The processing solution (washing solution) overflowing from the washing tank 35 (the furthest washing tank from the fixing tank 32), into which water is supplied from the water supply tank 39 (the washing solution tank), enters the adjoining washing tank 34, and the processing solution (washing solution) overflowing from the processing tank 34 enters the washing tank 33 which is nearest to the fixing tank 32. The processing solution (washing solution) overflowing from the washing tank 33 is stored in the waste water tank 42.

The waste water stored in the waste water tank 42 is periodically concentration-processed, and the distilled water obtained thereby is supplied to the water supply tank 39, so that the distilled water can be recycled in the apparatus.

The water supply to the fixing tank is carried out from the adjoining washing tank 33 using the pump 43 (a fixing tank water supply means).

Due to the above structure, the water supply operation required for the supply of tablets by tablet supplying apparatus 36 through 38 is carried out by the control of the pumps 40, 41, and 43. Pumps 40, 41 and 43 are driven by a control apparatus 44. Due to this structure, the structure of the water supply operation system can be simplified as compared with the case where water is respectively supplied to a plurality of washing tanks by a pump. Further, when washing solution is supplied from the washing tank 33 to the fixing tank 32, the water supply system to the fixing tank 32 can also be simplified.

When a liquid level abnormality (a water supply requirement signal) is detected by a liquid level sensor 45 provided in the washing tank 33, or by a liquid level sensor 46 provided in the washing tank 35 after the water supply operation to the washing tank by the pump 41, an amount of water, which is a predetermined multiple of the normal amount of the water supply, is supplied by the pump 41 as an error of the water supply operation, and the liquid level abnormal condition is controlled so as to be eliminated.

Information of the processed sheet area is inputted into a control apparatus 44 (corresponds to a subsidiary control section 82). This information of the processed sheet area is accumulated. The control apparatus 44 directs tablet supplying apparatus 36 through 38 to supply tablet type processing agents every time when the accumulated value of the processed area reaches a predetermined value which is set for each processing tank.

Figure 13:
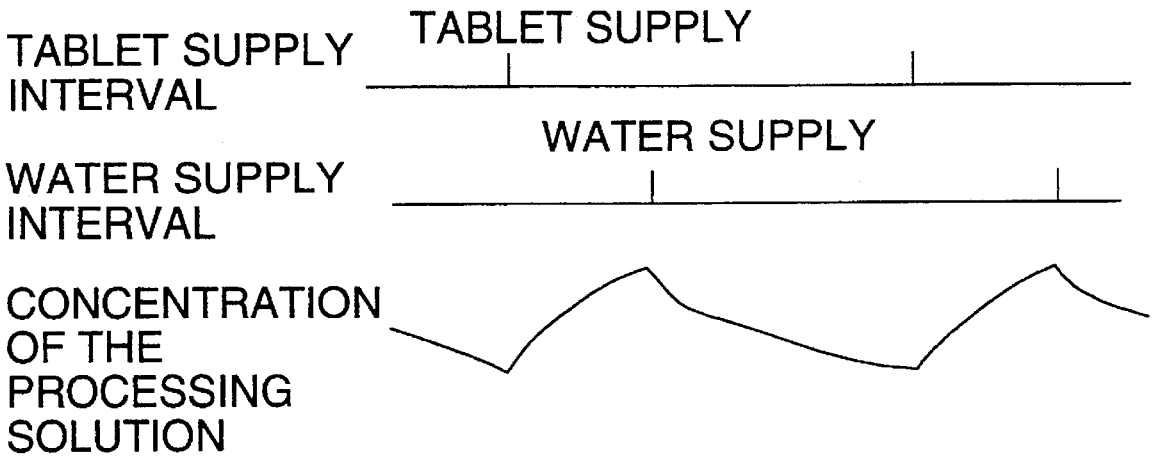
FIG. 13 is a time chart showing the correlation of the replenishment operation with the water supply operation.

On the other hand, in the water supply control corresponding to this tablet supply, as shown in FIG. 13, the pump corresponding to each processing tank is driven and water is supplied to the processing tank into which the tablets are supplied, after the period of time, which is set for each processing tank in which tablets are presumed to be in a partially dissolved condition, has passed.

In the case where water is supplied whenever the accumulated value of the processed sheet area reaches a predetermined value which is set for each processing tank, and the evaporation water supply is carried out based on an amount of the evaporation water supply which is set by an evaporation water supply amount setting means, the water supply timing may be forcibly delayed with respect to the tablet supply timing (a water supply timing delay means) when the tablet supply timing overlaps with the water supply (including the evaporation water supply) timing.

That is, the concentration of the processing solution is low at the tablet supply timing, and when water is supplied at the same time, the concentration is greatly decreased. Accordingly, when the tablet supply timing overlaps with the water supply timing, the water supply timing is forcibly delayed. Water is supplied when supplied tablets are dissolved and the concentration of the processing solution recovers to some degree, and fluctuation of the concentration of the processing solution can be avoided.

As described above, when the water supply timing is forcibly delayed with respect to the tablet supply timing (a water supply means for processing agents), the variation of concentration of the processing solution due to the replenishment and water supply operations can be suppressed compared with the case in which water is supplied at the same time as the tablet supply timing.

Tablet replenishment and water supply intervals are set for each processing tank, and therefore, the replenishment and water supply can be carried out corresponding to the different dissolving time of the tablet type processing agents in each processing tank.

Figure 14:
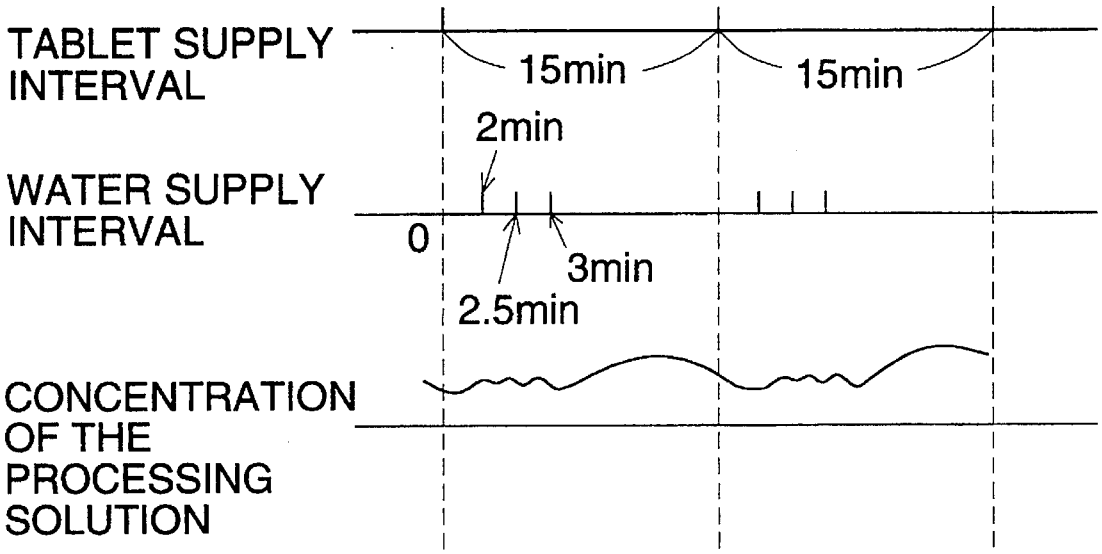
FIGS. 14(A) through 14(F) are time charts showing the correlation of the replenishment operation with the water supply operation.
Figure 14:
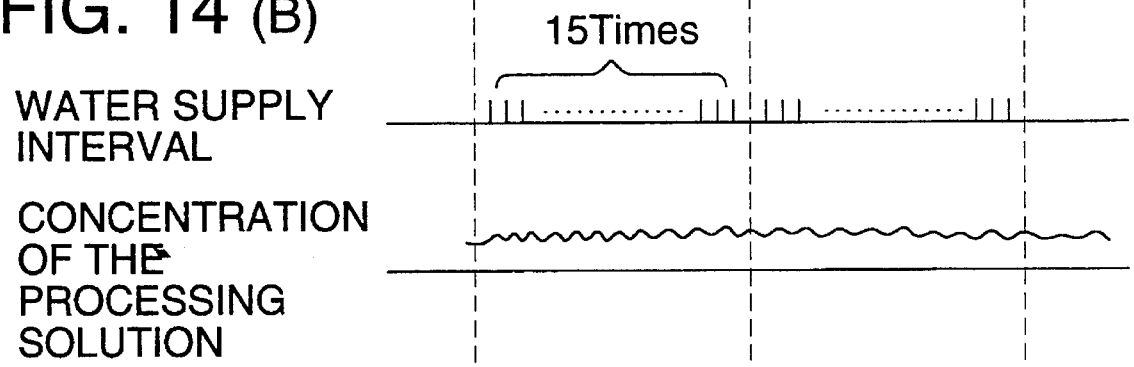
Figure 14:
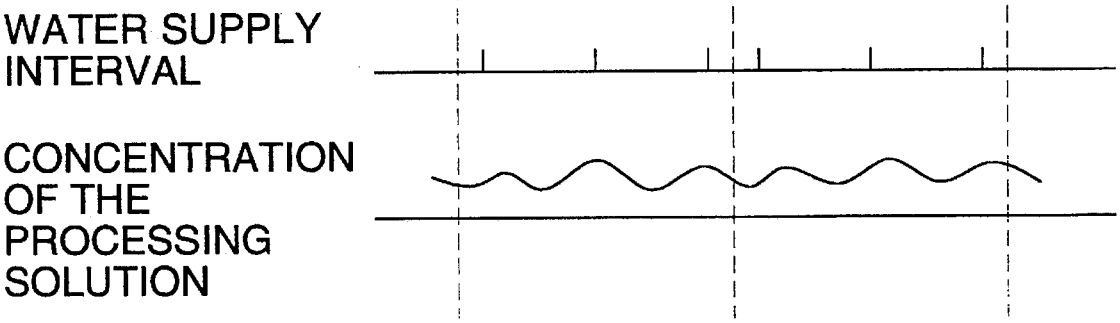
Figure 14:
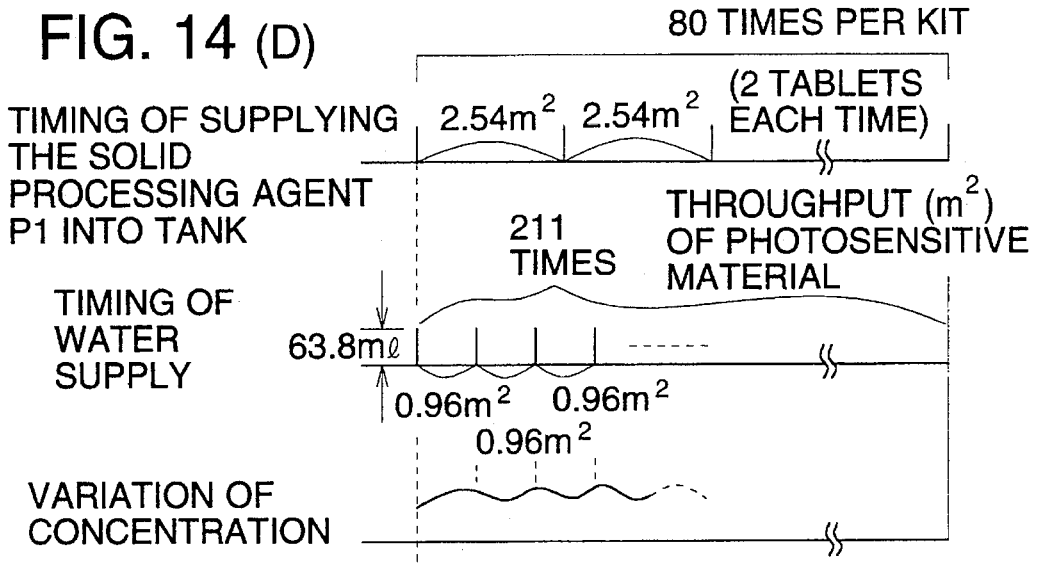
Figure 14:
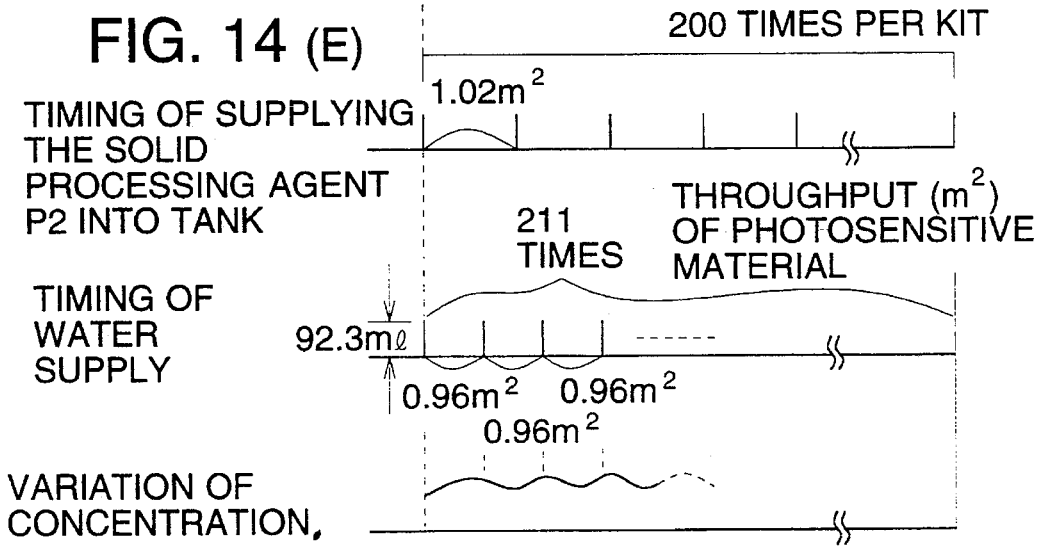
Figure 14:
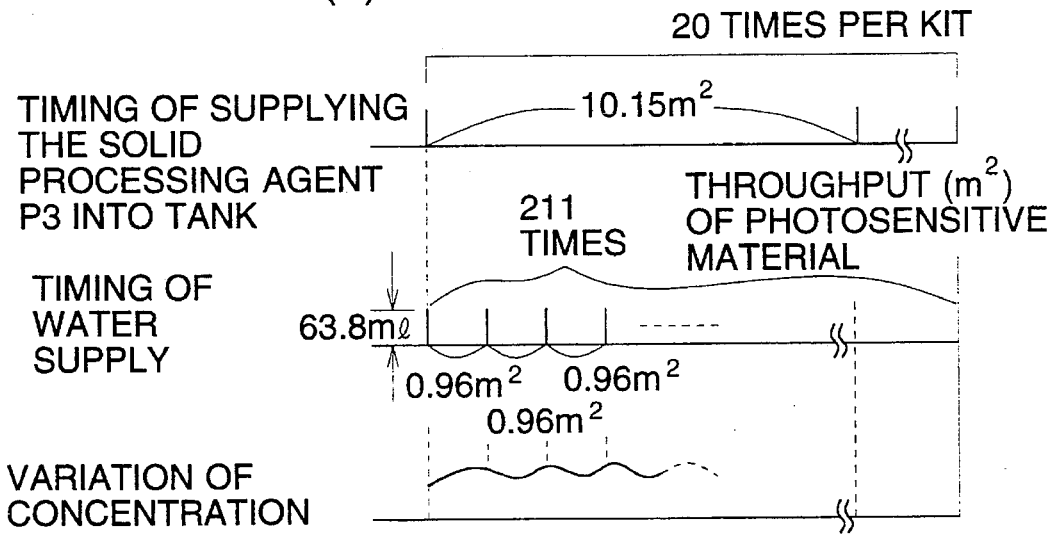

Further, in the example shown in FIG. 14, the amount of water required for the each tablet replenishment is divided into a plurality of individual amounts (a division water supply means for processing agents). That is, since tablet type processing agents are dissolved gradually, a small amount of water is supplied a plurality of times in accordance with the degree of dissolution. This method can suppress the variation of the concentration as compared with the case in which the water supply timing is delayed.

In order to divide the amount of water required for each replenishment of tablets into smaller amounts and to supply a smaller amount of water into the processing tank a plurality of times, the following water supply may be carried out. Water is supplied at every predetermined interval after the supply of tablets, or when the water supply operation is carried out at a predetermined interval based on the accumulated value of the processed sheet area, the water supply operation is carried out each time when the accumulated value reaches the value sufficiently smaller than the accumulated value of processed areas at which tablets are replenished.

When the value of the accumulated processed area, by which the water supply interval is determined, is made smaller so that the amount of water supply corresponding to the replenishment of tablets is divided into a plurality of smaller amounts, even when the replenishment intervals for each tank are different from each other, the water supply interval is made common for respective tanks, and the amount of water supply at one operation can be made different for each processing tank according to the requirement of each tank.

In also the case where the water supply operation of the amount of water corresponding to the replenishment operation of 1 time is carried out when being divided into a plurality of times of operations, the replenishment and water supply intervals may be set for each processing tank so that these intervals can cope with the requirement for replenishment and the dissolving time of the processing agents.

Here, an example of the water supply control for reducing variations of concentration smaller will be described below.

Control 1

When the concentration of the solutions in the processing tanks is stabilized for developing and other processing in the water supply method in which water is supplied in timed relationship with the supply of solid processing agents, there is a case in which the amount of water supply is larger depending on the dissolving time of solid processing agents and the supply interval. Further, even when the amount of water supply per one operation is relatively small, there is a case in which variations of concentration in a short period of time affect the processing property, so that it is necessary to control the above-described cases.

In the case of a tank P2 of the sheet developing apparatus, the period of water supply is about 4 minutes during continuous running (operation in the maximum processing capacity). In this example, 2 minutes after the supply of solid processing agents, water of about 48 ml are supplied two times at the interval of 30 sec.

(When processing is continuously carried out, the interval of the supply of solid tablets is increased larger than that of the following cycle of supply, however, in this example, water is supplied 2 minutes after the supply of the solid processing agents.)

During no processing, when the concentration of the processing solutions are maintained high, solid components adhere to the wall of the tank and the processing solutions tend to be non-uniform. Accordingly, this condition should be avoided.

In the case of tablet type processing agents

| | The cycle of the supply of solid processing agents | The amount of water supply |
|---|---|---|
| P1 | 2 tablets per 2.35 $m^2$: corresponding to 15 minutes (during continuous operation) | 151 ml for each operation of tablet supply |
| P2 | 2 tablets per 0.608 $m^2$: corresponding to 4 minutes (during continuous operation) | 96 ml for each operation of tablet supply |
| P3 | 1 tablet per 14.06 $m^2$: corresponding to 92 minutes (during continuous operation) | 2432 ml for each operation of tablet supply |

P1: developing processing
P2: bleaching and fixing processing
P3: stabilizing processing In this connection, it is necessary that about 2.5 liters of water are supplied at one operation with respect to one tablet of solid processing agent in the processing tank for P3 (stabilizing processing). However, when the above-described amount of water is supplied at one operation, variations of concentration can exceed its limit. Even if its limit is not exceeded, for example, when 300 ml of water are supplied at one operation into the processing solution of 10 liters in the processing tank, a variation of concentration of about 3% is generated even when the concentration will be uniform after stirring. However, although conditions are different depending on the speed of circulation of the processing solution, when the speed is not extremely large, or when the circulation is carried out in a short period of time, a portion in which the concentration is locally changed (lowered) by about 10 to 20% is generated, and the variation of the concentration can become several times that of the steady state.

Different from the conventional case where the concentrated solution is diluted and replenished, when the solid processing agents are replenished separately from water replenishment, the concentration is instantly changed. Accordingly, it is a major problem to control this variation so that this variation does not adversely affect the processing of the light-sensitive material.

In the present invention, although influence on the concentration of the processing solution around the light-sensitive material is different depending on the structure of he tank between the portion, in which solid processing agents are dissolved, and the portion in which developing processing of the light-sensitive material is carried out, the following occurs. Considering also the case where solid processing agents are dissolved near the conveyance portion for the light-sensitive material, the local variation of the concentration of about 3 through 6 times is instantaneously detected. In order to maintain the processing stability, the following is considered. In P1 and N1 (color developing processing), when the increase or decrease of concentration of 3% occurs with respect to a predetermined value of concentration, this is considered to be generally the limit of variation of the concentration. Accordingly, when the total of a predetermined amount of water (in the case of P1, 151 ml) is supplied at one operation, the concentration varies as if water of 450 to 900 ml is locally supplied, and there is a possibility that the concentration is lowered by about 9% at maximum in the tank, the capacity of which is 10 liters. In order to obtain smooth moderation of this variation and to control the variation within the allowable range of 3%, it is required to divide the amount of water into 3 individual amounts. In the case of the processing tank the capacity of which is 10 liters, the predetermined amount of 151 ml is divided into 3 individual amounts in the coloring tank, and the amount of 50 ml of water is supplied into the tank at one time. As a result, problems are not caused in the processing property. Occasionally, there is a possibility that the concentration is lowered by about 20% in the case where the supplied portion of the solid processing agents is near the processing area of the light-sensitive material. Accordingly, there are cases where the amount of water is required to be divided into 5 or 10 individual and equal amounts.

Further, in other tanks, except the coloring tank, the allowable range of water supply is larger and the amount of water supply may be a little larger. In the tank for P2, the allowable range is 5% of the upper limit. Accordingly, when the volume of the tank for P2 is almost the same as that of the color developing tank, the upper limit of water supply is about 83 ml. Since the required amount of water supply at one replenishment operation of processing agents is 96 ml, the total amount of water supply exceeds the above-described upper limit. Accordingly, the total amount of water supply should be divided into 2 individual equal amounts for supply. Therefore, the amount of 48 ml each may be supplied. Since the allowable range of variation of the concentration in the tank for P3 is 10%, the amount of water supply of about 166 ml each can be supplied. The volume of the processing tank for P3 is generally 2 through 4 times the volume of tanks for P1 and P2, and therefore, variations of the concentration in the steady state operation is difficult to occur. However, the local variation of the concentration in the tank for P3 occurs in the same way as that in other tanks. Accordingly, although the influence on the processing performance in the tank for P3 is smaller than that in other tanks, the tank for P3 is dealt with in the same way as other tanks in this example. In the tank for P2 in the above example, the amount of 96 ml is divided by 2 into 48 ml each, and 48 ml each is supplied two times at intervals of 15 through 30 sec, 2 minutes after the supply of the solid processing agents. In tank for P3, it is necessary that the amount of 2432 ml is divided by 15 into about 166 ml each for supply. The dissolving speed of solid processing agents for the tank for P3 is set longer, that is 60 minutes, and this time is shorter than the water supply cycle. Basically, since the variation of the concentration is smaller in the case where the supply of water is completed while the solid processing agents are being dissolved, the water supply operation is started 2 minutes after the supply of the solid processing agents, and about 166 ml of water is supplied at intervals of 3 minutes for a total duration of 45 minutes.

The number of divisions of the amount of water and the start timing of water supply can be appropriately adjusted. Basically, however, the upper limit of the amount of water supply at one operation is preferably set smaller than about 50 ml in the case of the color developing tank, about 83 ml in bleaching and fixing processing, and about 166 ml in stabilizing processing, with respect to the volume of the processing tank.

The required amount of water supply is composed of the following amounts: the amount carried at the time when the light-sensitive material is conveyed from the tank in which the processing amount is currently being processed to the next tank; the overflow amount forcibly discharged from the tank in which the processing solution is currently used for processing; and the amount determined when the volume of the supplied processing agent is considered. Accordingly, the amount of water supply is determined depending on the throughput of the light-sensitive material. Here, the features of the present invention are as follows: when the required amount of water is supplied to the processing section, the upper limit value (threshold value) at one operation is determined for each processing tank, and the apparatus is controlled so that the amount of water, which is smaller than the upper limit, is supplied to each processing tank.

The upper limit of the amount of water supply is defined as follows:

$$\frac{1}{6} \times V \times A \leqq L \leqq \frac{1}{3} \times V \times A$$

L: The upper limit of the amount of water supply V: the volume of the processing section A: the allowable range of variations of concentration of the processing solution in the processing tank. In this definition, the lower bound is determined so that local variations of concentration do not become larger as described above, and the larger the integer is, the smaller is the amount of water supply at one operation. However, it is necessary to increase the number of water supply by the water supply means so that the amount of water supply at one operation is further decreased and the required total amount of water is supplied. Accordingly, the control methods become complex. Therefore, the upper limit of the amount of water supply are preferable when the water supply control is carried out for variations of concentration.

The volume of the processing section is the sum of the volume of the processing tank, the volume of the constant temperature tank, the volume of pipes communicating the processing tank with the constant temperature tank, and the volume of the circulation pump.

The allowable ranges of the variation of concentration of the processing solution are respectively determined for the processing solution in each processing tank and they are respectively ±3%, ±5%, and ±10%. These values are found by the following method: in the density judgement of the reproduced photographic print or the exposed negative film by control strips of density, which is ordinarily used in photographic processing. The density reference and the reflection density of the reproduced photographic print or negative film measured by a reflection density meter are compared with each other; and thereby it is judged whether the density is within the allowable range. When the concentration of the processing solution exceeds the above-described allowable range of the concentration at the time of the water supply, the photographic density exceeds its allowable range. The approximate allowable ranges of variations of concentration in the processing tanks for maintaining the variation of the density after development (Stein density) of the unexposed portion of the film lower than 0.02, and for maintaining the allowable range of the density, obtained in the developing apparatus to be controlled, of the portion of the film, the exposed amount of which is the same as that corresponding to the density of 0.8 of the above-described reference, within ±0.10 with respect to the above-described density of 0.8, are respectively ±3%, ±5%, and ±10%.

As a method of the water supply in the case where the required amount of water supply is more than the upper limit, the following embodiments can be considered. (1) All the amount of water supply is 36 ml, and when the upper limit value of the water supply at one operation is 10 ml, the water supply of 10 ml is carried out respectively three times, and after that, an additional water supply of 6 ml is carried out (the total amount of water is 36 ml). (2) The amount of water supply is 36 ml, and when the upper limit value of the water supply at one operation is 10 ml, the amount of water supply at one operation is kept uniform and close to the upper limit of 10 ml, and the water supply of 9 ml is respectively carried out 4 times (the total amount of water supply is 36 ml).

EXAMPLE 1

In this example, the water, the amount of which is uniform at each operation, is supplied to each processing tank.

The water is supplied in timed relationship with the shortest supply cycle of the solid processing agents. Even when the supply cycle is long, since the concentration is increased after the supply of the solid processing agents, it is preferable that water is supplied, if possible, just after the supply of the processing agents for the concentration stability, although the timing of water supply is not necessarily the same as that of the supply of the solid processing agent.

In tanks for P1, P2 and P3, water is supplied after about 2 minutes after the supply of the solid processing agents.

The number of water supply cycles, the amount of water supply at one operation, and the interval of water supply are as follows:

P1: at 2 minutes, 2 minutes 30 sec., and 3 minutes, at intervals of 30 sec., the amount of water supply at one operation is about 50 ml, and the total water supply amount is 151 ml.

P2: at 2 minutes, and 2 minutes 30 sec., at intervals of 30 sec., the amount of water supply is 48 ml each, and the total water supply amount is 96 ml.

P3: at 2 minutes, 2 minutes 30 sec., . . . , at intervals of 30 sec., the amount of water supply is about 140 ml each, and the total water supply amount is 2432 ml.

EXAMPLE 2

In this example, the amount of water supply at one operation in each processing tank is decreased as compared with Example 1, and the intervals for water supply are almost equal as follows.

In Example 1, in tanks for P1 and P2, timing of the water supply is relatively earlier after the supply of solid processing agents, and is non-uniform in the supply interval of the solid processing agent. In Example 2, the interval of water supply is previously made uniform by prior calculation, so that relatively fresh processing solution can be continuously produced. In this connection, the interval of water supply is based on the supply interval of the solid processing agents during continuous operation (at the time of the operation with the maximum processing capacity).

P1: 1 minute, 2 minutes, 3 minutes, . . . , at intervals of 1 minute, the amount of water supply is about 10 ml each, the number of times of water supply is 15, and the total amount of water supply is 151 ml.

P2: 1 minute, 1 minute 30 seconds, . . . , at intervals of 30 seconds, the amount of water supply is about 20 ml each, the number of times of water supply is 5, and the total amount of water supply is 96 ml.

P3: 1 minute, 2 minutes 30 seconds, . . . , at intervals of 1 minute, the amount of water supply is about 27 ml each, the number of times of water supply is 90, and the total amount of water supply is 2432 ml.

EXAMPLE 3

In this example, the amount of water supply at one operation in each processing tank is the same as that in Example 1, and the interval of water supply within the supply interval of solid processing agents is made almost uniform as follows:

In this example, different from Example 2, the amount of water supply close to the upper limit of the variation of concentration in each processing tank is almost equal within the supply interval of the solid processing agents, and the number of times of water supply is fewer and the control is simpler.

P1: at 1 minute, 6 minutes, and 11 minutes, at intervals of 5 minutes, the number of times of water supply is 3, the amount of water supply is about 50 ml each, and the total amount of water supply is 151 ml.

P2: at 1 minute, and 3 minutes, at intervals of 2 minutes, the number of times of water supply is 2, the amount of water supply is about 48 ml each, and the total amount of water supply is 96 ml.

P3: at 1 minute, 6 minutes, . . . , at intervals of 5 minutes, the number of times of water supply is 18, the amount of water supply is about 140 ml each, and the total amount of water supply is 2432 ml.

A water pump which can feed 2 through 4 ml per second may also be operated for the water supply as a variation of this example. In the case of the tank for P1, the total amount of the water supply corresponding to one supply operation of the solid processing agents, may be intermittently supplied at intervals of 45 sec. through 60 sec. for a total of 15 minutes by small amounts per operation. This is also an embodiment of the present invention.

The dissolving speed of solid processing agents supplied into processing tanks for P1, P2 and P3 is adjusted so that the concentration in the processing tank is constantly maintained corresponding to each processing. A new processing solution is produced corresponding to the required processing. The dissolution time of solid processing agents are respectively set to 25 minutes, 37 minutes, and 60 minutes. These times correspond to the supply intervals of the solid processing agents.

In the foregoing, the water, the amount of which is divided by two into about 48 ml each, was supplied into the processing tank for P2 at intervals of 30 seconds. This depends on the following reason: although the circulation cycle of the processing solution depends on the type of apparatus (large or small of the capacity of the processing tank and the flow speed), since the circulation cycle is about 1 minute, the divided water supply cycle is a period of time during which the low concentration of processing solution, into which water has been supplied, is recovered to the higher concentration of the solution into which water needs to be supplied. The cycle of water supply was determined to be 30 sec., during which dispersion is large.

Due to the improvement of the light-sensitive material, processing, which is effective against variations of the concentration of the processing solution, can be carried out. Currently, however, variation of about 2 through 3% is the limit of the variation of concentration in the color developing processing tank such as P1 or N1.

The limit of variation of the concentration like that described above is 5 through 10% in also other types of processing. Even when the volume of the processing tank is 10 liters, there is no problem in the processing performance when the amount of water supply is set as described above, in order to avoid the instantaneous variation described earlier, although the degree of influence on the variation of concentration at the instant of the water supply is different depending on the distance from the place, into which water is supplied, to the place, from which the light-sensitive material is conveyed, and the structure between them.

It is preferable that the upper limit of the amount of water supply into each processing tank at one operation is made to almost correspond to the ratio of each upper limit of the variation of concentration in P1, P2 and P3 tanks, and the amount of water supply at one operation is set, even in the case where the the amount of water supply is divided or not, or the total amount of water supply with respect to the total amount of throughput of the light-sensitive material, which will be described later, is divided into equal individual amounts and supplied corresponding to throughput of light-sensitive material.

Since the upper limits of the variations of concentration in processing tanks are respectively ±3%, ±5%, and ±10%, the amounts of water supply are preferably set based on the reference values of, for example, 50 ml, 83 ml, and 166 ml, and further the reference values of, for example, 70 ml, 116 ml, and 232 ml when the structure is different from that in this example.

Of course, alternatively, water may be supplied when the amount of water supply is changed within the allowable range of the variation of concentration.

Control 2

The concept of the upper limit of the amount of water supply at one operation is the same as that described in Control 1. The control method in which the amount of water supply necessary for the predetermined throughput of the light-sensitive material is supplied at not the supply interval of processing agents, but, at equal intervals in the total process, will be described below.

A predetermined reference amount of water is supplied depending on the predetermined throughput of light-sensitive material.

The number of units of processing agents P1, P2 and P3 are respectively 160 units (tablets), 400 units (tablets) and 20 units (tablets) per kit. The amount of water supply necessary for processing the light-sensitive material using all the processing agents in 1 kit is about 21 $m^3$ for respective processing tanks. As will be described below, the upper limits of the amounts of water supply into the processing tanks at one operation are respectively set for processing agents P1, P2 and P3 so that the variation of concentration of processing solution does not occur due to sudden water supply.

Conventionally, about 150 ml of a processing solution obtained when a condensed solution is diluted two times, is used for processing each 1 $m^2$ of light-sensitive material. In this case, the concentration of the supplied solution is almost the same as that of the solution in the processing tank, and accordingly, no problem occurs.

Since solid processing agents are used for developing processing at this time, and water is supplied for solid processing agents, the variations of concentration of processing solutions when water is supplied, cause a problem, and therefore the water, the amount of which is appropriate for suppressing the variation of concentration as much as possible, is supplied into the processing solutions.

As described above, the total amount of water supply for each processing tank is 21 $m^3$. When it is previously considered that the concentration variations of 3 through 6 times in the processing solutions respectively occur locally with respect to the allowable ranges of concentration variations of 3%, 5%, and 10%, in the steady state condition, for respective processing agents P1, P2 and P3, as described in a paragraph of the divisional water supply, the amounts of water supply of ⅓ through ⅙ times of the allowable values are determined as upper limits of the amounts of water supply. When instantaneous and local variations of the concentration are considered, as an example, the amounts of water supply at one operation are respectively set to 100 ml, 167 ml, and 334 ml for respective allowable values of 300 ml, 500 ml, and 1000 ml in the steady state condition with respect to the volume of the processing tanks of 10 liters for respective processing agents P1, P2 and P3.

The upper limits of water supply are respectively set to 70 ml, 95 ml, and 190 ml for processing agents P1, P2, and P3. The cycle of water supply is set to 1 per throughput of light-sensitive material of 0.8 through 1.1 $m^2$. The upper limits of water supply are respectively set to 70 ml, 95 ml, and 190 ml for P1, P2 and P3 for the following reason: the upper limits are set within the range in which the variation of density of the light-sensitive material after development, does not cause any problem in the quality, when the concentration of the processing solution is suddenly changed by the water supply, which will be described later. Actually, in this example, water is supplied for every throughput of light-sensitive material of 0.95 $m^2$. In this method, basically, water is supplied without depending on the timing of the supply of solid processing agents. Of course, when the timing of water supply is matched with that of the supply of the solid processing agents, the water supply may be delayed individually.

Conventionally, the method of supplying of solid processing agents is widely known, but in this case, the amount of water supply is usually not considered. In the present invention, since the small amounts of water are successively supplied, the variations of concentration are extremely decreased. As a result, more stable developing processing for photographic prints and negative film can be realized.

Conventionally, in the supply of processing solutions by the method for supplying condensed solutions, changes of developing performance occur due to the mixture of fresh solution and weakened solutions. Methods for solving this problem have been proposed, however, in the above case, since the change of concentration itself is not basically caused, the problem of the amount of water supply is a problem which has occurred only after the method using solid processing agents has been proposed.

When the amount of water supply for one operation is large, as in the case where water is supplied corresponding to the replenishment of the solid processing agents, it is clear that the variation of the concentration exceeds the limit. Even when the amount of water supply for one operation is not excessively large, for example, when replenishment water of 300 ml is supplied into a processing solution of 10 liters in the processing tank for one operation, the variation of the concentration of about 3% is caused even when the concentration of the solution becomes uniform after stirring. Further, although conditions are different depending on the circulation speed of the processing solution, when there is no circulation, or during a short period of time even when the circulation is carried out, sometimes, the portion, in which the concentration varies locally more than 20%, occurs. In this case, the variation of the concentration is several times the established limit.

Different from the conventional case where the concentrated solution is diluted and replenished, when the solid processing agents are replenished independent of water replenishment, concentration is instantly changed. Accordingly, it is a large problem to control the variation so that this variation does not adversely affect the processing of the light-sensitive material. (The above-described water supply is the same as the divisional water supply method)

In the present invention, the influence on the concentration of the processing solution on the periphery of the light-sensitive material is different depending on the structure between the region in which solid processing agents are dissolved and the region in which the light-sensitive material is being developed. When it is considered that solid processing agents are dissolved near the conveyance area of the light-sensitive material, because the variation of concentration of 3 through 6 times is detected instantaneously and locally, the amount of water of 67 ml is supplied for every 0.95 $m^2$ of throughput of the light-sensitive material in the present invention, and supplied for every 1 $m^2$ for P1, so that processing stability can be maintained. Two tablets of solid processing agents are supplied per every 2.35 $m^2$, and therefore, the supply of the solid processing agents and that of water do not overlap with each other. That is, the least common multiple of the intervals is made as large as possible so that the timing of supply of the water does not overlap with that of the solid processing agents.

The volume of the processing tank for P1 is 10 liters. The amount of water supply for one operation is 67 ml which is about 1/200 of the volume of the processing tank, so that the variation of concentration is very small.

In the case of tablet type processing agents

| | The cycle of the supply of solid processing agents | The amount of water supply (The total amount: 21 $m^3$) |
|---|---|---|
| P1 | 2 tablets per 2.35 $m^2$: corresponding to 15 minutes (during continuous operation) | 64.3 ml × 2.35 = 151 ml for one operation |
| P2 | 2 tablets per 0.608 $m^2$: corresponding to 4 minutes (during continuous operation) | 158 ml × 0.608 = 96 ml for one operation |
| P3 | 1 tablet per 14.06 $m^2$: corresponding to 92 minutes (during continuous operation) | 173 ml × 14.06 = 2432 ml for one operation |

In this replenishment method, since water is supplied corresponding to the throughput of the light-sensitive material, even when the supplying cycle interval of the solid processing agents is large, replenishment water of a predetermined amount is supplied a plurality of times between the previous supply and the succeeding supply. It is preferable that water is supplied relatively just after the supply of the solid processing agents so that concentration is stabilized.

In this example, the amount of replenishment water for evaporation is respectively 9 ml for P1, 6.1 ml for P2, and 30 ml for P3 per hour during normal operation. The replenishment water, due to evaporation, of several ml through several tens ml is supplied per hour although the amount of water supply is different depending on dimensions of the processing tank, the processing speed, the circulation cycle of the processing solution, and the structure, and is further dependent on the difference between environmental conditions such as seasonal variations. During non-operation, since the evaporation amount is very small, the amount of water supply is decreased to half of the normal amount of the usual water supply.

Of course, water to replace evaporated water is supplied to prevent large variations of concentration. The replenishment water for replenishing the amount of evaporation, and the replenishment water for dissolving the solid processing agents and for maintaining the concentration constant, are replenished from the same tank in this example.

In example 1, for P1 and P3, water is supplied at a relatively earlier time after the supply of solid processing agents, and that timing is irregular. Accordingly, the replenishment method, in which the intervals of water supply are equalized by previous calculation, is adopted, so that relatively fresh processing solutions are continuously produced.

P1: at 1 minute, 2 minutes, and 3 minutes, . . . , at intervals of 1 minute, the number of times of water supply is 15, the amount of water supply is about 10 ml each, and the total amount of water supply is 151 ml.

P2: at 1 minute, and 1 minute and 30 sec, . . . , at intervals of 30 sec., the number of times of water supply is 5, the amount of water supply is about 20 ml each, and the total amount of water supply is 96 ml.

P3: at 1 minute, 2 minutes 30 sec., . . . , at intervals of 1 minute 30 sec., the number of times of water supply is 90, the amount of water supply is about 27 ml each, and the total amount of water supply is 2432 ml.

In this example, different from Example 2, the amount of water supply close to the amount corresponding to the upper limit of the variation of concentration in each processing tank is almost equalized within the supply interval of the solid processing agents, and the number of times of water supply is smaller and the control is simpler.

P1: at 1 minute, 6 minutes, and 11 minutes, at intervals of 5 minutes, the number of times of water supply is 3, the amount of water supply is about 50 ml each, and the total amount of water supply is 151 ml.

P2: at 1 minute, and 3 minutes, at intervals of 2 minutes, the number of times of water supply is 2, the amount of water supply is about 48 ml each, and the total amount of water supply is 96 ml.

P3: at 1 minute, 6 minutes, . . . , at intervals of 5 minutes, the number of times of water supply is 18, the amount of water supply is about 140 ml each, and the total amount of water supply is 2432 ml.

The water supply in above-described Control 1 and Control 2 is the water supply corresponding with the replenishment of solid processing agents. The control of the water supply for evaporated water, for making up for the water evaporated from the processing tank, as described above, is carried out together with the control of the dissolution water supply. In the water supply for the evaporated water, when a signal is outputted from the timer means, the amount of water obtained by the above-described evaporation amount detection means is supplied to the processing tank. When the supply of solid processing agents, water supply and replenishment of water are simultaneously carried out, the timing of water supply and the replenishment of water may be delayed. Further, when the water supply and replenishment of water are carried out simultaneously, the replenishment of water may be delayed. Here, when the supply of solid processing agents, water supply and replenishment of water are simultaneously carried out, it means that the difference of time between the start of the supply of solid processing agents, and the start of water supply and the start of replenishment of water is within 1 minute.

Here, effects of the invention of the above-described Control 1 are shown in A through C in FIG. 14. A through C in FIG. 14 respectively correspond to Examples 1 through 3 in Control 1, and show each timing of water supply while the light-sensitive material is continuously processed by the automatic processing apparatus, and the variation of the concentration at that time. The variation of concentration in FIG. 14 is conceptually shown. As clearly can be seen in the drawing of the variation of concentration in A through C in FIG. 14, when water is supplied to the processing tank by the method of the present invention, the variation of concentration can be controlled to be within a predetermined range.

Next, effects by the invention of Control 2 are shown in D through F in FIG. 14. D through F in the drawing show each timing of water supply while the light-sensitive material is continuously processed by the automatic processing apparatus, and the variation of concentration at that time, in processing tanks P1, P2, and P3 in the example in Control 2. As clearly can be seen in the drawing of the variation of concentration in D through F in FIG. 14, when water is supplied to the processing tank by the method of the present invention, the variation of concentration can be controlled to be within a predetermined range. Further, since the timing of the water supply is not controlled when being triggered by the supply of solid processing agents, and water can be supplied directly based on the throughput of the light-sensitive material, the control is easier than that in the above-described Control 1.

In this connection, in the above-described Control 1 and Control 2, data of an amount of water supplied when the light-sensitive material is processed, is stored in a memory means. This data is stored as the amount of water itself. In this case, an embodiment in which a liquid level sensor such as a float sensor, or a flow sensor is provided in the processing tank, and an amount of water supply is controlled, or an embodiment in which data of an amount of water supply is stored in a memory as an amount of operation of a water supply means to supply a target amount of water, can also be considered. In any case, data is stored in the memory in such a manner that an amount of water supply for one operation is smaller than the above-described upper limit value L of the amount of water supply. A RAM (Random Access Memory), or the like, is used as the memory means. In the case of the RAM, it is necessary that the content of memory is backed up when the power supply is turned off. A rewritable P-ROM may also be used as the memory. However, sometimes, there occurs the case in which the amount of water supply is timely and frequently changed, and accordingly, in this case, the RAM is preferable.

In this connection, in the structure of the processing tanks shown in FIG. 12, the excess washing solution supplied into the washing processing tank 33 overflows and is discharged into the waste water tank 42. In this case, it is most essential to avoid large amounts of washing solution being discharged into the waste water tank 42. However, when water is supplied to the fixing tank 32, the liquid surface of the washing tank 33 is lowered. Accordingly, it is necessary that water is supplied to the washing tank 33 (washing tank 35) at least when water is supplied from the washing tank 33 to the fixing tank 32.

Here, when the water supply operation to the fixing tank 32 by the pump 43 is simultaneously started with the water supply operation to the washing tanks 33 through 35 by the pump 41, the water supply operation to the washing tank 33 is simultaneously carried out with the discharge operation of the washing solution from the washing tank 33. Accordingly, the liquid surface rises slowly during the water supply operation to the washing tank 35, and thereby a water supply operation error is detected, so that there is a possibility that the excessive water supply operation is carried out.

Figure 15:
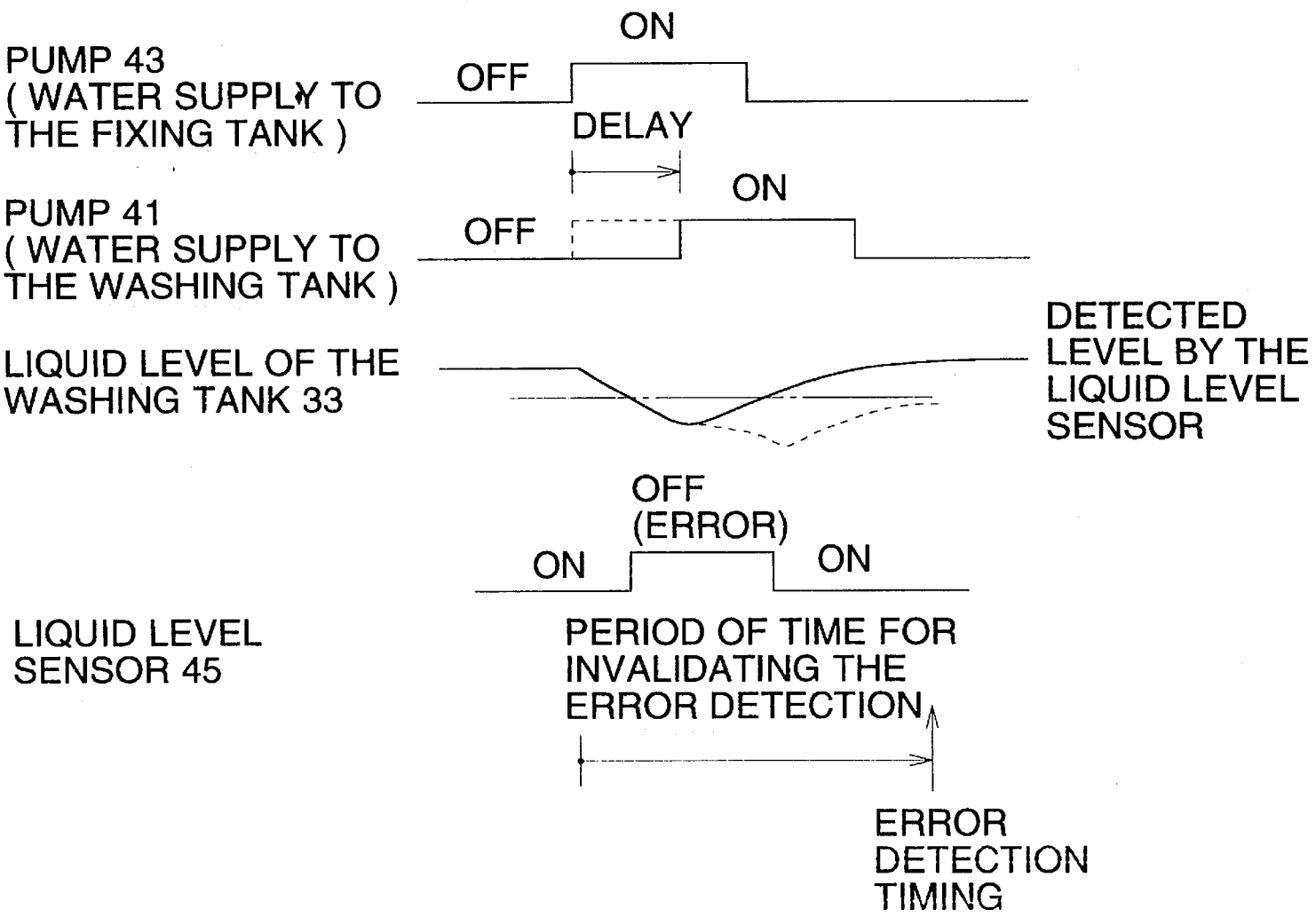
FIG. 15 is a time chart showing the correlation of the water supply operation to the washing tank with the water supply operation to a fixing tank.

Accordingly, in this example, as shown in FIG. 15, the water supply operation to the washing tank 35 by the pump 41 is delayed by a predetermined time from the start of the water supply operation to the fixing tank 32 by the pump 43 (the water supply operation start timing control means). Thereby, the lowering of the liquid surface of the washing tank 33 is controlled during the water supply operation to the fixing tank 32 so that the liquid surface of the washing tank 33 can securely rise during the water supply operation to the washing tank 35. Accordingly, erroneously detected water supply operation errors can be avoided. Thereby, an increase in the amount of washing solution overflow from the washing tank 33 by the excessive water supply operation can also be avoided.

The above-described delay processing of the water supply operation may be structured so that the water supply operation to the washing tank 35 is started after the water supply operation to the fixing tank 32 has been completed. Further, it may be structured so that the water supply operation to the washing tank 35 is started during the water supply operation to the fixing tank 32. The delay time of the water supply operation is appropriately determined depending on the setting for the liquid surface, the capacity of the processing tank and the capacity of the pump in each apparatus.

Here, in the above-described water supply operation, the abnormality of the liquid surface of the washing tank 33 being erroneously detected when the liquid surface is lowered by the water supply operation to the fixing tank 32 causes a problem. Accordingly, the control apparatus 44 may override the liquid surface lowering detection (a replenishment requirement signal) by the liquid surface sensor 45 during a predetermined period of time after the water supply operation from the washing tank 33 to the fixing tank 32 (replenishment requirement overriding means), to avoid the lowering of the liquid level being erroneously judged when accompanied with the water supply operation to the fixing tank 32.

When the apparatus is structured as described above, even when the lowering of the liquid surface is detected by the liquid surface sensor 45 during the water supply operation, this detection is not considered as a water supply operation error. When the water supply operation has been completed and the liquid level is stabilized, it can be judged whether the amount of water supply is insufficient. Accordingly, an excessive water supply operation can be avoided.

The error detection of the water supply operation in the washing tank 33 may be conducted after a predetermined period of time has elapsed after the water supply operation has been completed. In this case, the period of time during which the liquid surface lowering detection is overridden is the time in which a predetermined period of time has elapsed after the pump 41 stops.

Further, instead of overriding the detection of the lowering of the liquid surface for a predetermined period of time as described above, when the difference between the overflowing liquid level and the liquid level at which the lowering of level is detected by the liquid level sensor 45 in the washing tank 33, is larger than the liquid level corresponding to the amount of water supply to the fixing tank 32, it can be prevented that the liquid level of the washing tank 33 is lowered below the level at which the lowering of the liquid level is detected by the liquid level sensor 45, and erroneous judgement of the lowering of liquid level of the washing tank 33, accompanied with the water supply operation to the fixing tank 32, can be avoided.

That is, the liquid level detected by the liquid level sensor 45 corresponds to the required liquid level in the washing tank 33. Accordingly, when a liquid level higher than the level in which the water supply to the fixing tank 32 is anticipated with respect to the above-described detection liquid level, is considered to be the overflowing liquid level, it is avoided that the liquid level of the washing tank 33 is lowered below the liquid level to be detected by the liquid level sensor 45 when the water supply is carried out to the fixing tank 32.

In this connection, as shown by the system structure in FIG. 10, in the automatic processing apparatus having a system in which processing components are replenished as tablets by tablet supplying apparatus 27 through 29, when processing agents are changed to different kinds, the temperature (set temperature) of the processing solution to be heated by heaters 7 through 9 (a processing temperature adjustment means), and appropriate replenishment intervals are changed. Further, the appropriate value of the water supply control, required when the above-described tablet type processing agents are supplied, and the appropriate value of the evaporation water supply control, corresponding to the evaporation from the processing tank, are also changed.

Accordingly, the control apparatus 10 may be structured so that the control apparatus 10 detects the kind of tablet, reads out data appropriate for the corresponding tablet from data in which appropriate temperature of the processing solution, the replenishment interval, and the amount of water supply are previously stored for each kind of tablet, and controls heater 7 through 9, tablet supplying apparatus 27 through 29, and pumps 12 through 14 (the control means depending on conditions of processing agents).

The above-described kind of tablets may be given by the operator. Alternatively, the cartridge in which tablets are accommodated may be different for each kind of tablet, and the control apparatus 10 may detect the difference of the cartridge and the kind of the tablet type processing agents. The shape of the above-described cartridge may be different for each kind of tablet, or discrimination information such as bar-codes may be attached to the cartridge.

Further, in the case where the apparatus is structured so that a plurality of tablet type processing agents are accommodated in the cartridge as described above and the cartridge is set into the main body of the apparatus, when the supply interval of the processing agents is longer, sometimes, the processing agents accommodated in the cartridge have deteriorated due to environmental conditions of temperature and humidity, and the initially set data of the temperature of processing solution, the replenishment interval, and the amount of water supply is no longer appropriate for processing.

Accordingly, the elapsed time after the cartridge has been set into the main body of the apparatus is measured, and when the time is long, the deterioration of the processing agents, due to the moisture absorption during the elapsed time, is presumed. Thereby, data of the temperature of the processing solution, the replenishment interval, and the amount of water supply may be corrected (the control means depending on conditions of processing agents).

Further, even when the elapsed time after the setting of the cartridge is the same, when the ambient temperature or ambient humidity is different from other cases, a mode of the deterioration of the processing agents is different. Accordingly, the ambient temperature or ambient humidity is detected in parallel with the measurement of the elapsed time after the setting of the cartridge, and a mode of deterioration of the processing agents is presumed from the elapsed time and conditions surrounding the apparatus during the elapsed time. Thereby, it is preferable that the control apparatus is structured so that data of the temperature of the processing solution, the replenishment interval, and the amount of water supply is corrected.

As described above, when the elapsed time after the cartridge has been set into the apparatus is combined with conditions of the ambient temperature and ambient humidity, and the deterioration of the processing agents is presumed, information of the ambient temperature and ambient humidity may be obtained by direct detection by sensors, or indirect detection by input of information of season and region by the operator.

In each example described above, the structure of the tablet type processing agent supplying apparatus is not limited to that of the apparatus in which tablets are dropped by the rotation of the rotor as shown in FIG. 2, however, the the apparatus may have a structure in which rolling of the tablet type processing agent is used so that the tablet is dropped into the processing solution.

Further, the apparatus may have a structure in which water evaporated from the processing tank is collected by a dehumidifier and supplied back to the water supply tank.

Further, it can be clearly seen that the processing tank is not limited to bleaching, fixing, and washing, and further, the number of tanks, in the case where the washing tank is composed of a plurality of tanks, is not limited.

As described above, according to the automatic processing apparatus of the present invention, the water supply corresponding to the amount of evaporation from the processing tank can be automatically carried out, and the rise of the concentration when the evaporation occurs can be avoided, so that acceptable processing performance can be maintained.

Specifically, when the apparatus is structured so that the amount of evaporation is presumed based on the temperature of the processing solution, ambient temperature, ambient humidity, and throughput of the light-sensitive material, the apparatus can very accurately cope with the change of the amount of evaporation due to the variations of the above-described conditions.

Further, when the apparatus is structured so that the amount of evaporation is presumed from the correlation of the amount of waste water from the processing tank with the history of the water supply, it is not necessary that conditions, by which the amount of evaporation is changed, are precisely detected, and the amount of evaporation can be presumed. Accordingly, the water supply for evaporation can be carried out by a fairly simple structure.

Further, when the amount of waste water is detected from the number of times of replacement of the waste water in the waste water tank, the detection of the amount of the waste water can be simply realized.

Further, when the water supply operation corresponding to the amount of evaporation is carried out at predetermined intervals, and the amount of water supply according to the result of the assumption of the amount of evaporation is adjusted when the interval of the water supply operation or the amount of water supply at one operation is adjusted, then the setting of the water supply operation corresponding to the amount of evaporation can be easily carried out.

In the automatic processing apparatus according to the present invention, a means for heating the water supplied to the processing tank is provided. Thereby, the temperature of the processing solution can be close to that of the supplied water without being affected by the temperature around the apparatus, and it can be avoided that the temperature of the processing solution is lowered when water is supplied and the temperature is lowered below the appropriate temperature.

Specifically, in the structure in which processing components are replenished as solid processing agents, since the dissolving time of the solid processing agents is affected by the temperature of the processing solution, when the lowering of the temperature of the processing solution due to the water supply operation can be avoided as described above, a prolonged dissolving time can be avoided, which is an effect of the present invention.

In the above-described supplied water heating control, when the temperature of the processing solution and the temperature of the supplied water are respectively detected, and a supplied water heating means is controlled based on the result of the detection, the temperature of the processing solution can be highly accurately close to the temperature of the supplied water.

Further, in the automatic processing apparatus according to the present invention, when the throughput per unit time is low, the replenishment interval of the processing components is shortened. Accordingly, even when the throughput is lowered in the structure in which the replenishment interval is determined based on the accumulation of the throughput, the deterioration of the processing solution can be assuredly avoided, which is also an effect of the present invention.

Here, when the apparatus is structured so that the basic replenishment interval is determined based on the accumulation of the throughput of the light-sensitive material, the apparatus can cope with the deterioration of the processing solution caused by the increase of the throughput, and the deterioration of the processing solution can be securely avoided even when the throughput is lowered.

Further, when the processing components are replenished by solid processing agents, the amount of water supply is increased when the replenishment interval is shortened, accordingly, the concentration of the processing solution can be securely stabilized.

On the other hand, in the automatic processing apparatus according to the present invention, when the apparatus is structured so that the water supply operation corresponding to the replenishment of solid processing agents is carried out by shifting the timing with respect to the replenishment interval, or the amount of water supply required for the replenishment of processing agents is divided into a plurality of individual amounts and the individual amount of water is supplied, in the structure in which solid processing agents are replenished into the processing tank at a predetermined interval, the variation of concentration of the processing solution caused by the replenishment and water supply operations can be controlled, which is still another effect of the present invention.

Further, in the automatic processing apparatus according to the present invention, water is supplied to each washing tank when a plurality of washing tanks respectively overflow. In the structure in which the washing solution is supplied from the washing tank to the fixing tank, water is supplied to the washing tank after the supply of the washing solution to the fixing tank has started. Accordingly, an excessive amount of water supply which overflows from the washing tank and is wasted, can be reduced, which is yet another effect of the present invention.

Further, in the water supply operation in the structure of the processing tank composed of a plurality of washing tanks, when the result of detection of the lowering of the liquid level of the washing tank caused by the water supply operation is overridden for a predetermined period of time, it can be avoided that the lowering of the liquid level, that is, an error of the water supply operation is erroneously judged. As a result, it can provide the effect in which an excessive water supply operation can be avoided.

Further, instead of the overriding processing of the detection of the lowering of the liquid level, when the correlation of the liquid level of the overflow with the detected liquid level by the liquid level sensor is set, it can be avoided that the error of the water supply operation is erroneously judged when the washing solution is supplied from the washing tank to the fixing tank. Due also to the above-described structure, the excessive water supply operation can be avoided, which is another effect of the present invention.

On the other hand, in the automatic processing apparatus according to the present invention, the apparatus is structured so that processing is continued for the period in which the processing capacity can be maintained even when the water supply operation required for the replenishment of the solid processing agents and the replenishment operation can not be carried out at the predetermined interval when there is no solid processing agent available, or no water in the water supply tank is available. Accordingly, an interruption in processing can be avoided. Therefore, it can provide the effect in which the operability is improved, and the maintenance property for solid processing agents and water supply is improved.

Further, as described above, when the replenishment of the processing agents and water supply can be conducted again after processing has been continued under the conditions that the replenishment and water supply could not be carried out, the processing agents and water, including the amount of the processing agents and the amount of water, which could not be replenished and supplied under the above-described conditions, can be replenished and supplied by the first restart operations. Accordingly, it can provide the effect in which the processing performance can be maintained at the restart time.

As described above, in the automatic processing apparatus for silver halide photographic light-sensitive material according to the 1st embodiment, when the insufficient supply of the solid processing agent occurs and the insufficient supply amount arrives at a predetermined value, the further processing of the silver halide photographic light-sensitive material is inhibited. Accordingly, the manufacturing of the silver halide photographic light-sensitive material whose photographic characteristics are deteriorated by the delay of the replacement operation and the continuous lowering of the chemical activity of the processing solution, is not carried out.

Further, in the automatic processing apparatus for silver halide photographic light-sensitive material according to the 2nd embodiment, even when processing of the silver halide photographic light-sensitive material advances further and the chemical activity of the processing solution is slightly lowered while the supply of the solid processing agent is being stopped, the lowered chemical activity can return to normal conditions when the supply is started again.

Further, in the automatic processing apparatus for silver halide photographic light-sensitive material according to the 3rd embodiment, even when the amount of the solid processing agent is insufficient, processing is continuously carried out until the insufficient supply amount arrives at a predetermined value, and the processing is stopped when the insufficient supply amount arrives at the predetermined value. Accordingly, even when the amount of the solid processing agent is insufficient and the processing agent is not supplied according to the predetermined control, continuous processing can still be carried out while the normal processing performance can be maintained, and the replenishment operation can be carried out with a sufficient time margin. Even when the apparatus is structured in such a manner that the supply is carried out while a specific amount of the solid processing agent remains at the time of replenishment, the specific amount by which the operability is not affected can be minimized, and reduction of the size of the automatic processor is not adversely affected. Further, the deterioration of the solid processing agent due to humidity can be minimized.

Further, in the automatic processing apparatus for silver halide photographic light-sensitive material according to the 4th embodiment, even when the insufficient supply amount occurs, an amount corresponding to the insufficient supply amount is supplied into the processing tank by the solid processing agent increased supply means in such a manner that the insufficient supply amount is compensated for. Accordingly, the activity of the processing solution in the processing tank can be maintained at an ideal value, and the photographic processing performance can be stabilized.

In the automatic processing apparatus for silver halide photographic light-sensitive material according to the 14th embodiment, when an insufficient supply of replenishment water occurs and the insufficient supply amount exceeds a predetermined value, further processing of the silver halide photographic light-sensitive material is stopped. Accordingly, the manufacturing of the silver halide photographic light-sensitive material, whose photographic characteristics are deteriorated by the delay of the replacement operation and the continuously lowering of the chemical activity of the processing solution, is not carried out.

Further, in the automatic processing apparatus for silver halide photographic light-sensitive material according to the 15th embodiment, even when processing of the silver halide photographic light-sensitive material further advances and the activity of the processing solution is slightly lowered while the supply of the replenishment water is being stopped, the lowered chemical activity can return to normal conditions when the supply is started again.

Further, in the automatic processing apparatus for silver halide photographic light-sensitive material according to the 16th embodiment, even when the amount of the replenishment water is insufficient, processing is continuously carried out until the insufficient supply amount arrives at a predetermined value, and the processing is stopped when the insufficient supply amount arrives at a predetermined value. Accordingly, even when the amount of the replenishment water is insufficient and the replenishment water is not supplied according to the predetermined control, continuous processing can be carried out while the normal processing performance can be maintained, and the replenishment operation can be carried out with a sufficient time margin. Even when the apparatus is structured in such a manner that the supply is carried out while a specific amount of the replenishment water remains at the time of replenishment, the specific amount by which the operability is not affected can be minimized, and reduction of the overall size of the automatic processor is not adversely affected.

Further, in the automatic processing apparatus for silver halide photographic light-sensitive material according to the 17th embodiment, even when an insufficient supply amount occurs, the amount equal to the insufficient supply amount is supplied into the processing tank by the solid processing agent increased supply means in such a manner that the insufficient supply amount is compensated for. Accordingly, the chemical activity of the processing solution in the processing tank can be maintained at an ideal value, and the photographic processing performance can be stabilized.

Further, in the structure in which solid processing agents are used, the amount of water supply, the replenishment interval, and set temperature (temperature of the processing solution) are changed depending on the kind of solid processing agents, the waiting time in the structure in which the processing agents are accommodated in a cartridge for replenishment, and environmental conditions of temperature and humidity during the waiting time. Accordingly, it can provide the effect in which the water supply, replenishment and heater control can be carried out under appropriate conditions, corresponding to the change of the kind of the processing agents and the deterioration of the processing agents.

Further, in the automatic processing apparatus according to the present invention, the processing solution circulation pump in the processing tank is continuously operated for a predetermined period of time after the processing of the light-sensitive material has been completed. Accordingly, it can provide the effect in which the solid processing solutions replenished just before the completion of the processing can be satisfactorily dissolved under the condition that the processing solution is circulating.

Further, when the circulation pump is intermittently operated even when the processing of the light-sensitive material is stopped, the concentration and temperature of the processing solution can be maintained constant during the stoppage of the processing, which is further effect of the present invention.

Further, in the automatic processing apparatus according to the present invention, when the replenishment timing of the solid processing agents and the timing of water supply overlap, the timing of water supply is forcibly delayed. Accordingly, the water supply operation can be carried out during dissolving of solid processing agents, and thereby, the variation of concentration of the processing solution can be suppressed.

What is claimed is:

1. An apparatus for processing a silver halide photographic light-sensitive material, comprising:

(a) a processing tank for receiving the material and for storing a processing solution to process the material; and (b) supply means for supplying a solid processing agent to said processing tank, wherein when a supply-shortage of the solid processing agent reaches a preset amount, further receiving of the material for processing is inhibited.

2. The apparatus of claim 1, wherein said supply means additionally supplies said processing agent to compensate for said supply-shortage of the solid processing agent, after said supply means stops and thereafter restarts supplying of the solid processing agent.

3. The apparatus of claim 1, wherein said supply means supplies a set value of the solid processing agent on the basis of a predetermined control, and said apparatus further comprising:

computing means for computing a supply-shortage of the solid processing agent supplied from said supply means by comparing a counted value of the number of times of no-supplying with the set value; and inhibition means for inhibiting the receiving of the material for processing, when a supply-shortage computed by said computing means reaches said preset amount.

4. The apparatus of claim 3, wherein said computing means detects the number of no-supplying operations of the solid processing agent in accordance with said predetermined control.

5. The apparatus of claim 3, wherein said computing means computes the supply-shortage by detecting the solid processing agent number of supplying operations of said supply means when a remaining amount of the solid processing agent in said supply means is a preset remaining amount or less.

6. The apparatus of claim 3, wherein said computing means computes the supply-shortage by detecting the said processing agent number of supplying operations of said supply means after a predetermined amount of the solid processing agent has been replenished to said supply means.

7. The apparatus of claim 3, wherein said compensating means supplies the supply-shortage only when the receiving of the material for processing is inhibited by said inhibition means.

8. The apparatus of claim 3, wherein said predetermined control is at least one of a control on the basis of a processing amount of the material, a control on the basis of an amount of operation duration period of said apparatus, and a control on the basis of a concentration of said processing solution in said processing tank.

9. The apparatus of claim 1, wherein said supply means supplies a set value of the solid processing agent on the basis of a predetermined control, and said apparatus further comprising:

computing means for computing a supply-shortage of the solid processing agent supplied from said supply means by comparing a counted value of the number of times of no-supplying with the set value; and compensating means for compensating for a supply-shortage computed by said computing means so that processing agent for making up for the supply-shortage is additionally supplied to said processing tank.

10. The apparatus of claim 9, wherein after the solid processing agent has been replenished to said supply means, said compensating means causes supply at one time the same amount of the solid processing agent as that of the supply-shortage, independent of a supply of the solid processing agent on the basis of said predetermined control.

11. The apparatus of claim 9, wherein after solid processing agent has been replenished to said supply means, said compensating means supplies a part of the same amount of the solid processing agent as that of the supply-shortage until all amount of the supply-shortage is completed to supply at each time when the supply of the solid processing agent on the basis of said predetermined control is conducted.

12. The apparatus of claim 9, wherein when a processing amount of the material reaches a prescribed amount, said compensating means causes supply of processing agent to said processing tank to compensate for the supply-shortage at one time, independent of a supply of the solid processing agent on the basis of said predetermined control.

13. The apparatus of claim 1, wherein said preset amount of said supply-shortage is set by at least one of types of said solid processing agent and an amount of processing solution in said processing tank.

14. The apparatus of claim 1, wherein said solid processing agent is a tablet.

15. The apparatus of claim 1 further comprising:

water supply means for supplying a replenishment water to said processing tank, wherein when a supply-shortage of the replenishment water reaches a predetermined amount, further receiving of the material for processing is inhibited.

16. The apparatus of claim 15, wherein said water supply means supplies replenishment water to compensate for said supply-shortage of the replenishment water, after said water supply means stops and thereafter restarts supplying of the replenishment water.

17. The apparatus of claim 16, wherein said water supply means supplies the replenishment water on the basis of a prescribed control, and said apparatus further comprising:

water computing means for computing a supply-shortage of the replenishment water supplied from said water supply means by comparing a counted value of the number of times of no-supplying with a set value of the replenishment water on the basis of a predetermined control; and compensating means for compensating for a supply-shortage computed by said water computing means so that the supply-shortage of the replenishment water is additionally supplied to said processing tank.

18. The apparatus of claim 17, wherein after the replenishment water has been supplied, said compensating means causes supply at one time of the same amount of the replenishment water as that of the supply-shortage, independent of a supply of the replenishment water on the basis of a predetermined control.

19. The apparatus of claim 17, wherein after the replenishment water has been supplied, said compensating means causes supply of a part of the same amount of a replenishment water as that of the supply-shortage until all amount of the supply-shortage is completed to supply at each time when the supply of the replenishment water on the basis of a predetermined control is conducted.

20. The apparatus of claim 16, wherein a compensating means causes supply supplies the supply-shortage of the replenishment water only when the receiving of the material for processing is inhibited by an inhibition means.

21. The apparatus of claim 15, wherein said water supply means supplies a set value of the replenishment water on the basis of a predetermined control, and said apparatus further comprising:

water computing means for computing a supply-shortage of the replenishment water from said water supplied supply means by comparing a counted value of the number of times of no-supplying with the set value of the replenishment water, wherein when a supply-shortage computed by said water computing means reaches said predetermined amount, an inhibition means for inhibiting the receiving of the material for processing inhibits the further receiving of the material for processing.

22. The apparatus of claim 21, wherein said water computing means detects the number of no-supplying operations of the replenishment water in accordance with said predetermined control.

23. The apparatus of claim 21, wherein said water computing means computes the replenishment water supply-shortage by detecting the number of supplying operations of said water supply means when a remaining amount of the replenishment water in said water supply means is a preset remaining amount or less.

24. The apparatus of claim 21, wherein said water computing means computes the replenishment water supply-shortage by detecting the number of supplying operations of said water supply means after a predetermined amount of the replenishment water has been replenished.

25. The apparatus of claim 15, wherein said predetermined amount of said supply-shortage of the replenishment water is set by at least one of types of said solid processing agent and an amount of processing solution in said processing tank.

* * * * *